US006886828B2

(12) United States Patent
Saito

(10) Patent No.: US 6,886,828 B2
(45) Date of Patent: May 3, 2005

(54) SHEET FINISHING APPARATUS AND IMAGE FORMING APPARATUS EQUIPPED WITH THE SAME

(75) Inventor: Takashi Saito, Yamanashi-ken (JP)

(73) Assignee: Nisca Corporation, Yamanashi-ken (JP)

( * ) Notice: Subject to any disclaimer, the term of this patent is extended or adjusted under 35 U.S.C. 154(b) by 261 days.

(21) Appl. No.: 10/347,246

(22) Filed: Jan. 21, 2003

(65) Prior Publication Data

US 2003/0137102 A1 Jul. 24, 2003

(30) Foreign Application Priority Data

Jan. 22, 2002 (JP) ..... 2002-012547

(51) Int. Cl.[7] ..... B65H 5/00

(52) U.S. Cl. ..... 271/225; 270/58.08; 270/58.14; 271/251

(58) Field of Search ..... 271/225, 251; 270/58.08, 58.14

(56) References Cited

U.S. PATENT DOCUMENTS 6,006,065 A * 12/1999 Seki ..... 399/407

6,568,669 B2 * 5/2003 Hosaka ..... 270/58.12

FOREIGN PATENT DOCUMENTS

JP 11-11787 * 1/1999 ..... B65H/37/04

* cited by examiner

*Primary Examiner*—Donald P Walsh
*Assistant Examiner*—Kenneth W Bower
(74) *Attorney, Agent, or Firm*—Manabu Kanesaka

(57) ABSTRACT

A sheet finishing apparatus is provided with a discharge device for discharging a sheet; a support device arranged below the discharge device; a storage device arranged below the support device; an aligning device having a reference member as a reference to align the sheet and alignment rotating members for moving the sheet to the reference member; a shift device for shifting the discharge device to move the sheet to a position where the sheet can contact the alignment rotating members; a finishing device for finishing the sheet aligned by the discharge device, the shift device and the aligning device in a state that the sheet straddles between the support device and the storage device; and a transport device for transporting the sheets finished by the finishing device to the storage device.

18 Claims, 48 Drawing Sheets

SHEET FINISHING APPARATUS AND IMAGE FORMING APPARATUS EQUIPPED WITH THE SAME

BACKGROUND OF THE INVENTION

This invention relates to a sheet finishing apparatus for selectively applying a finishing process such as jog discharge, alignment or binding to sheets fed from an image forming apparatus such as a laser printer or copier, and more particularly, relates to an image forming apparatus equipped with the sheet finishing apparatus.

A conventional sheet finishing apparatus is mounted to an image forming apparatus such as a laser printer or a copier, for example, as shown in FIG. 48. In such a sheet finishing apparatus, alignment rotating bodies, while rotating, touch a sheet fed to a finishing tray from the image forming apparatus to align the sheet at a predetermined aligning position established on one side of the finishing tray.

In such a conventional sheet finishing apparatus, when the sheets are discharged to the finishing tray with a center reference in which the center of the sheets with various sizes is aligned at a reference position, an edge of a smaller sheet is located far from the alignment rotating bodies, thereby making it difficult to align such a small sheet properly. When the sheet is discharged so that a side of the sheet is aligned at a side discharge reference position opposite to the center reference position in the finishing tray, it is still difficult to align the small sheet properly for the same reason. Furthermore, in the conventional sheet finishing apparatus described above, the finished sheets are stored in a storage tray arranged separately from a dedicated finishing tray after the sheets are finished and bound at the finishing tray that supports the discharged sheets. Therefore, an overall size of the finishing tray becomes larger. Moreover, the sheet needs to move a distance equivalent to at least the size of the sheet to be discharged from the finishing tray, thereby resulting in a larger apparatus and decreasing finishing efficiency.

An object of the present invention is to provide a sheet finishing apparatus that is compact and efficient, and that accurately aligns the sheets regardless of a position of the discharge reference or the size of the sheets that are discharged, and also to provide an image forming apparatus equipped with such a sheet finishing apparatus.

SUMMARY OF THE INVENTION

To attain the aforementioned objectives, the invention provides the following configurations.

According to the first aspect of the present invention, a sheet finishing apparatus is provided with discharge means for discharging sheets; support means disposed below the discharge means; storage means disposed below the support means; aligning means disposed near the support means and having a reference member as a reference for aligning the sheets and alignment rotating members rotating while contacting the sheets on the support means for moving the sheets to the reference member; shift means for shifting the discharge means to move the sheets to a position where the sheets can contact the alignment rotating members; finishing means for finishing the sheets aligned by the discharge means, the shift means and the aligning means in a state that the sheets straddle between the support means and the storage means; and transport means for transporting the sheets finished by the finishing means to the storage means.

In the sheet finishing apparatus according to the second aspect of the present invention, the support means is disposed between the storage means and the reference member in a shifting direction of the shift means.

In a sheet finishing apparatus according to the third aspect of the present invention, the support means is formed in a shape so that the support means contacts an upstream portion of the sheet in a discharge direction of the discharge means before the support means contacts a downstream portion of the sheet when the sheet is moved by the shift means.

According to the fourth aspect of the present invention, the sheet finishing apparatus further includes guide means for guiding the sheets moved by the shift means to a position where a leading edge of the sheets in a moving direction contact the alignment rotating members.

In the sheet finishing apparatus according to the fifth aspect of the present invention, the transport means acts on a sheet bundle to transport the sheets to the storage means at a step between the support means and the storage means.

According to the sixth aspect of the present invention, a sheet finishing apparatus is provided with discharge means for discharging sheets; support means arranged below the discharge means; storage means arranged below the support means; shift means for shifting the discharge means to move a side of the sheet to the support means; a step between the support means and the storage means in a direction that the shift means shifts the discharge means; aligning means arranged near the support means and having a reference member as a reference for aligning the sheets and alignment members for aligning the sheets by moving the sheets discharged by the discharge means to the reference members; finishing means for finishing the sheets aligned by the discharge means, the shift means and the aligning means in a state that the sheets straddle between the support means and the storage means; and transport means for transporting the sheets finished by the finishing means to the storage means.

According to the seventh aspect of the present invention, an image forming apparatus is equipped with one of the sheet finishing apparatuses in the first to the sixth aspect.

DETAILED DESCRIPTION OF PREFERRED EMBODIMENTS

The following describes preferred embodiments in detail according to the present invention with reference to the drawings provided.

A. Mounting Structure and Transport System (FIG. 1)

Figure 1:
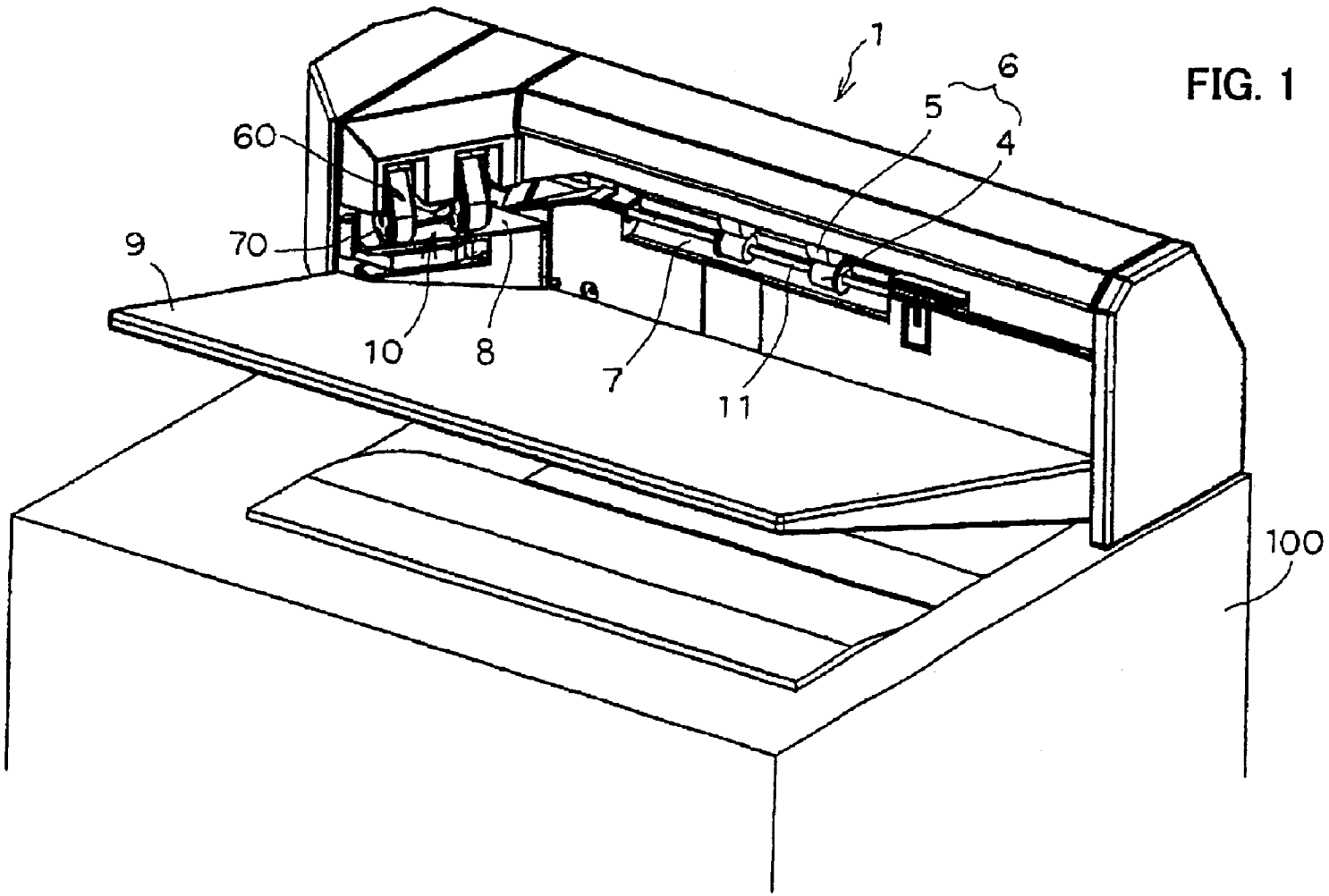
FIG. 1 is an external view of a sheet finishing apparatus using a sheet discharge apparatus according to the present invention.

FIG. 1 shows one embodiment of the image forming apparatus provided with the sheet finishing apparatus employing the sheet discharge apparatus according to the present invention. In this embodiment, the sheet finishing apparatus 1 according to the present invention is structured to be detachably assembled to the top of the image forming apparatus 100 composed of a page printer. More specifically, to connect the sheet finishing apparatus 1 and the image forming apparatus 100, a lock arm 1*a* (FIG. 2) is protrudingly established on the lower side of the sheet finishing apparatus 1, the lock arm mating with a holding portion (not shown in the drawings) inside of the image forming apparatus 100 to mount the sheet finishing apparatus 1 on the top of the image forming apparatus 100. Note that although in this embodiment, the image forming apparatus 100 is composed of a page printer, it is also perfectly acceptable to apply the sheet finishing apparatus according to the present invention to a copier as well.

Figure 2:
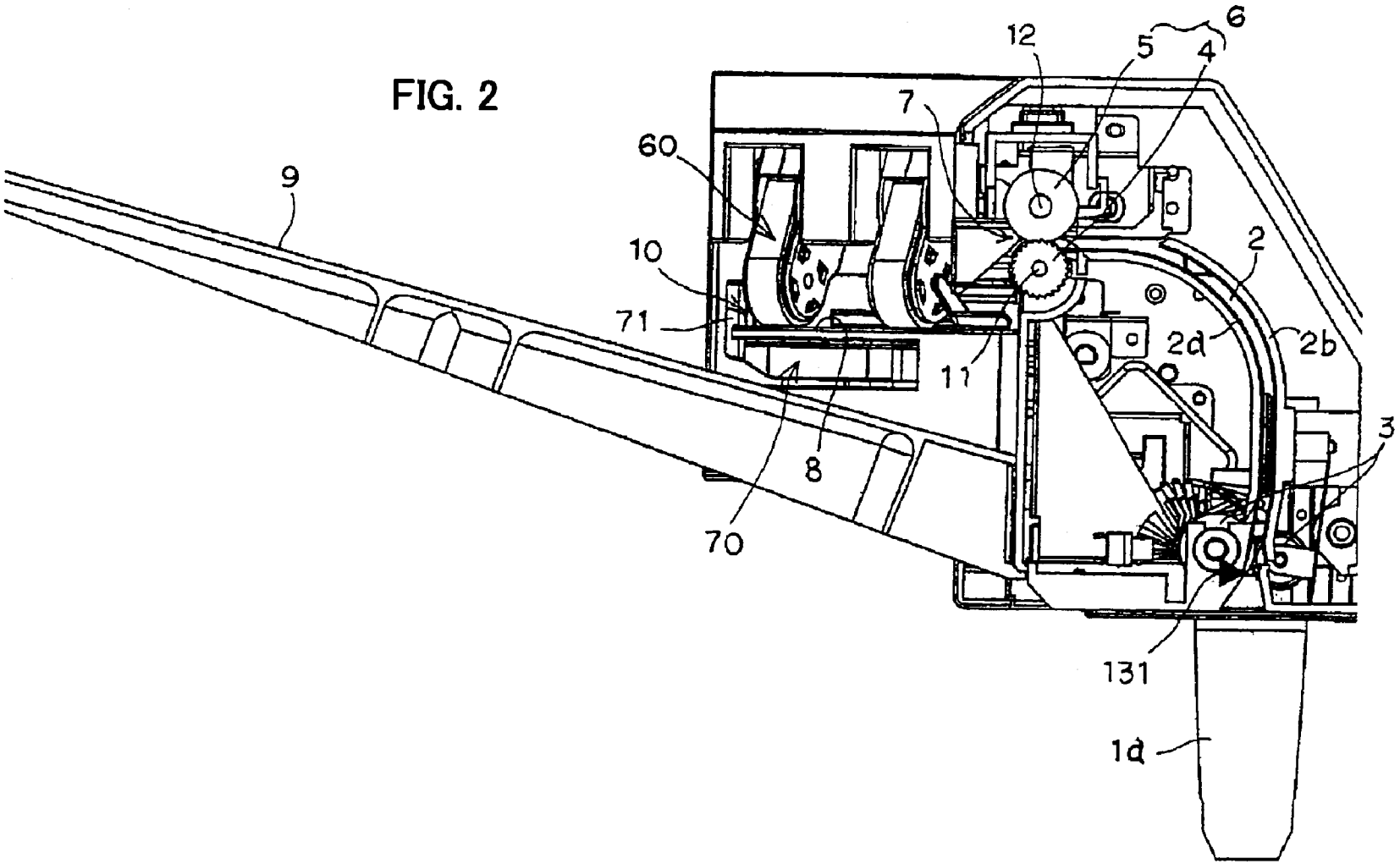
FIG. 2 is a sectional view showing the sheet finishing apparatus separated vertically at a paper path portion according to the present invention.

FIG. 2 shows the configuration of the transport system to receive, then discharge printed or copied sheets from the image forming apparatus 100. Sheets discharged toward the top from the discharge portion, not shown in the drawings, on the image forming apparatus 100 are sent to the paper path (sheet transport path) 2 formed by the upper guide 2*a* and the lower guide 2*b* inside of the sheet finishing apparatus 1. This paper path 2 extends substantially vertically to the back of the sheet finishing apparatus 1 and bends to the front. To the lower edge, the inlet the paired transport rollers 3 are disposed. In other words, the aforementioned copy sheets are fed into the paper path 2 by the paired transport rollers 3 disposed at the lower edge inlet of the paper path 2, and further downstream into the sheet finishing apparatus and are discharged from the discharge outlet 7.

B. Sheet Discharge Means 6

In FIG. 1, to the discharge outlet 7 on the sheet finishing apparatus 1 are arranged the paired tray discharge rollers 4 and 5 composed of the discharge roller 4 which is a follower roller and the tray discharge roller 5 which is a drive roller as the sheet discharge means 6.

Also, established in a position below and downstream of the paired tray discharge rollers 4 and 5 in the direction of sheet transport is disposed the fixed stacking portion 8 (the first tray) as the configuring element of the support means (the sheet single corner portion support means) 10 that supports one corner of sheets discharged by the aforementioned discharge means 6 in the upstream side in the discharge direction. Also, in the shaft direction of each support shafts 11 and 12 for the tray discharge rollers 4 and 5, the fixed stacking portion (the first tray) 8 is disposed more on the stapler (finishing means) 23 or the positioning plate 22 side than the storage portion (the second tray) 9. Expressed differently, the fixed stacking portion (the first tray) 8 is disposed between the storage portion (the second tray) 9 and the positioning plate 22, creating a level difference between the fixed stacking portion (the first tray) 8 and the storage portion (the second tray) 9 partway on each of the support shafts 11 and 12 shaft direction. In this embodiment, the fixed stacking portion 8 is configured to support one corner of the sheet's trailing edge side.

Figure 28:
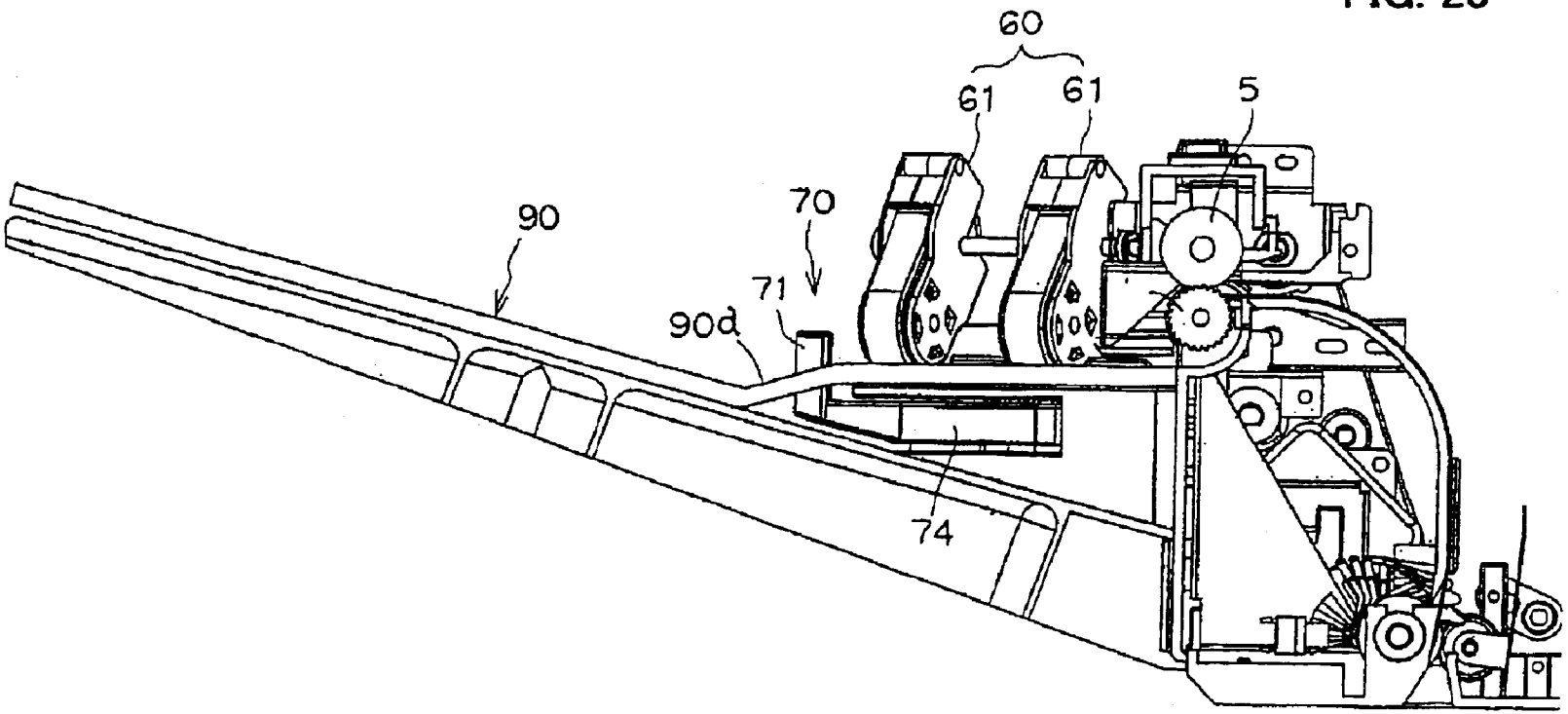
FIG. 28 is a partial sectional view showing a positional relationship among the fixed stacking portion (the first tray), the storage tray (the second tray), and a vertical direction of the sheet bundle in the sheet finishing apparatus according to the present invention.
Figure 29:
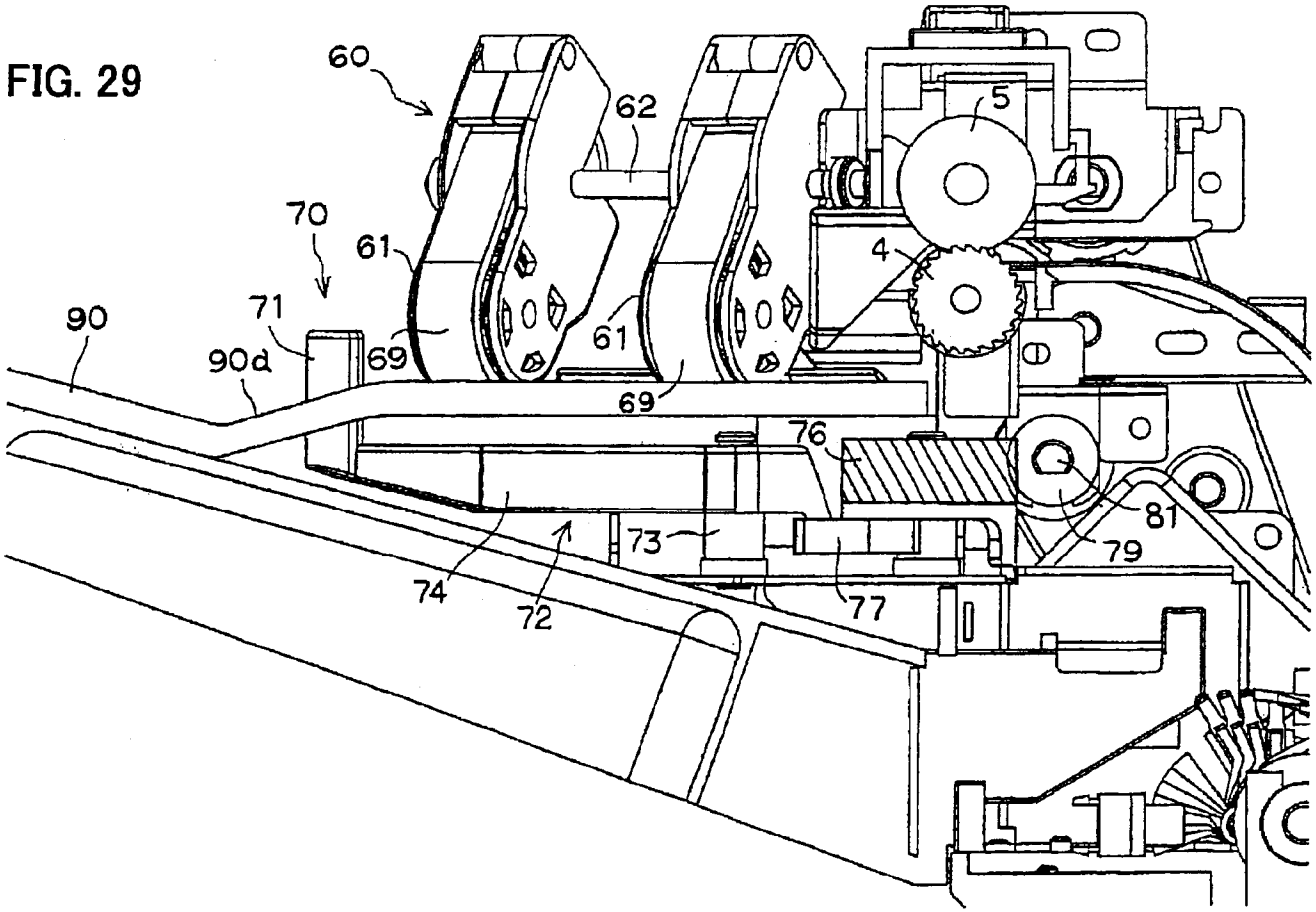
FIG. 29 is a partial sectional side view showing sheet bundle discharge means (sheet moving means) in the sheet finishing apparatus according to the present invention.

Also, further below the fixed stacking portion 8 is disposed the storage tray 9 (the second tray) as the sheet storage means, having a size large enough to receive the maximum sized sheets discharged. Also, sheets are discharged by the paired tray discharge rollers 4 and 5 from the discharge outlet 7 to the fixed stacking portion 8 and the top of the stacking surface on the storage tray 9 and are stacked as shown in FIG. 28 and FIG. 29.

To enable a configuration for the paired tray discharge rollers 4 and 5 on the sheet discharge means 6 to rotate, near the discharge outlet 7 inside of the sheet finishing apparatus 1 are rotatingly arranged the two supporting shafts 11 and 12 that extend in parallel vertically, the aforementioned paired tray discharge rollers 4 and 5 being mounted in an appropriate plurality (in this case, a pair of two) midway on the each of the supporting shaft 11 and the supporting shaft 12.

Figure 5:
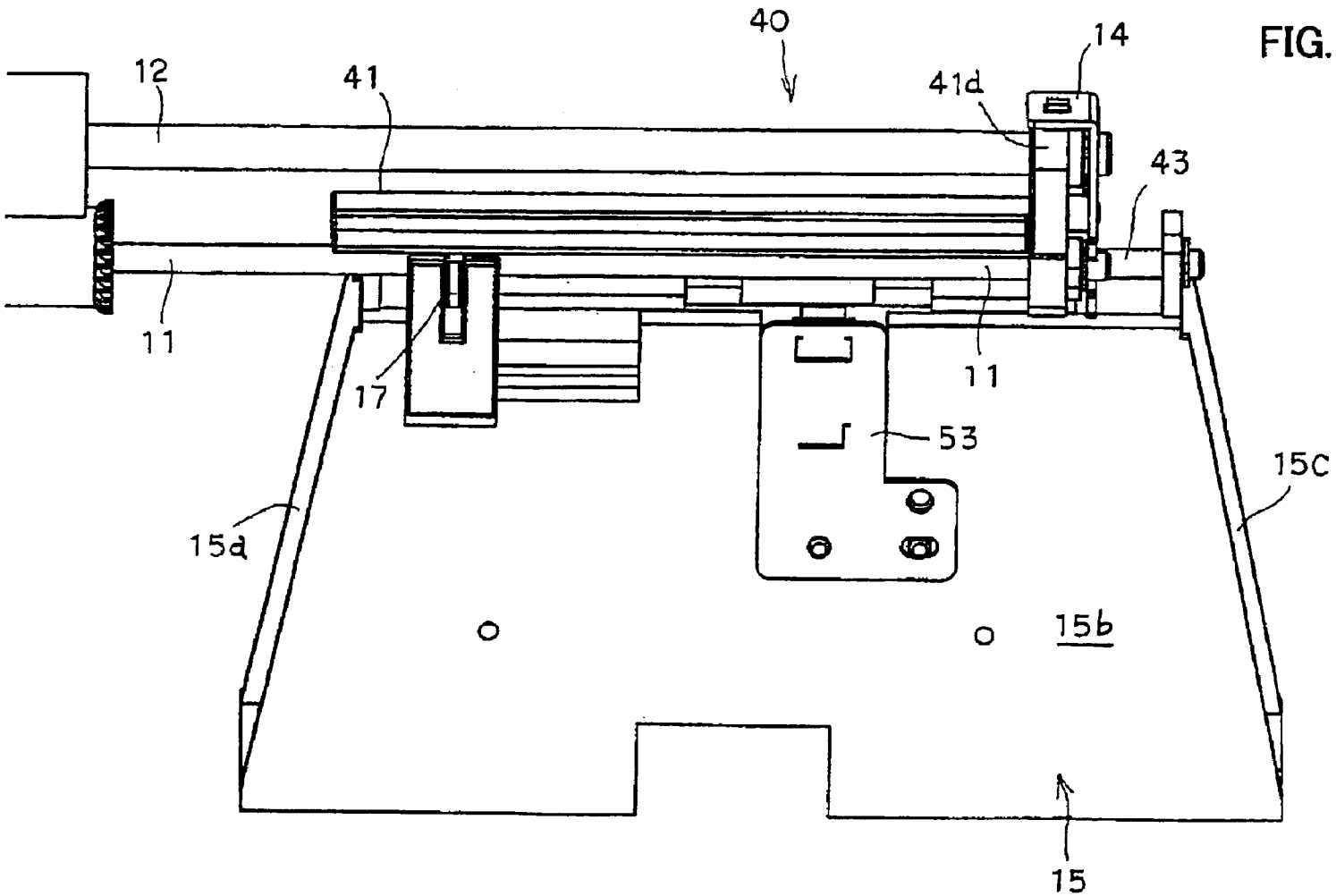
FIG. 5 is an expanded view showing a stand frame that supports a right edge of a support shaft of the sheet finishing apparatus shown in FIG. 4.
Figure 6:
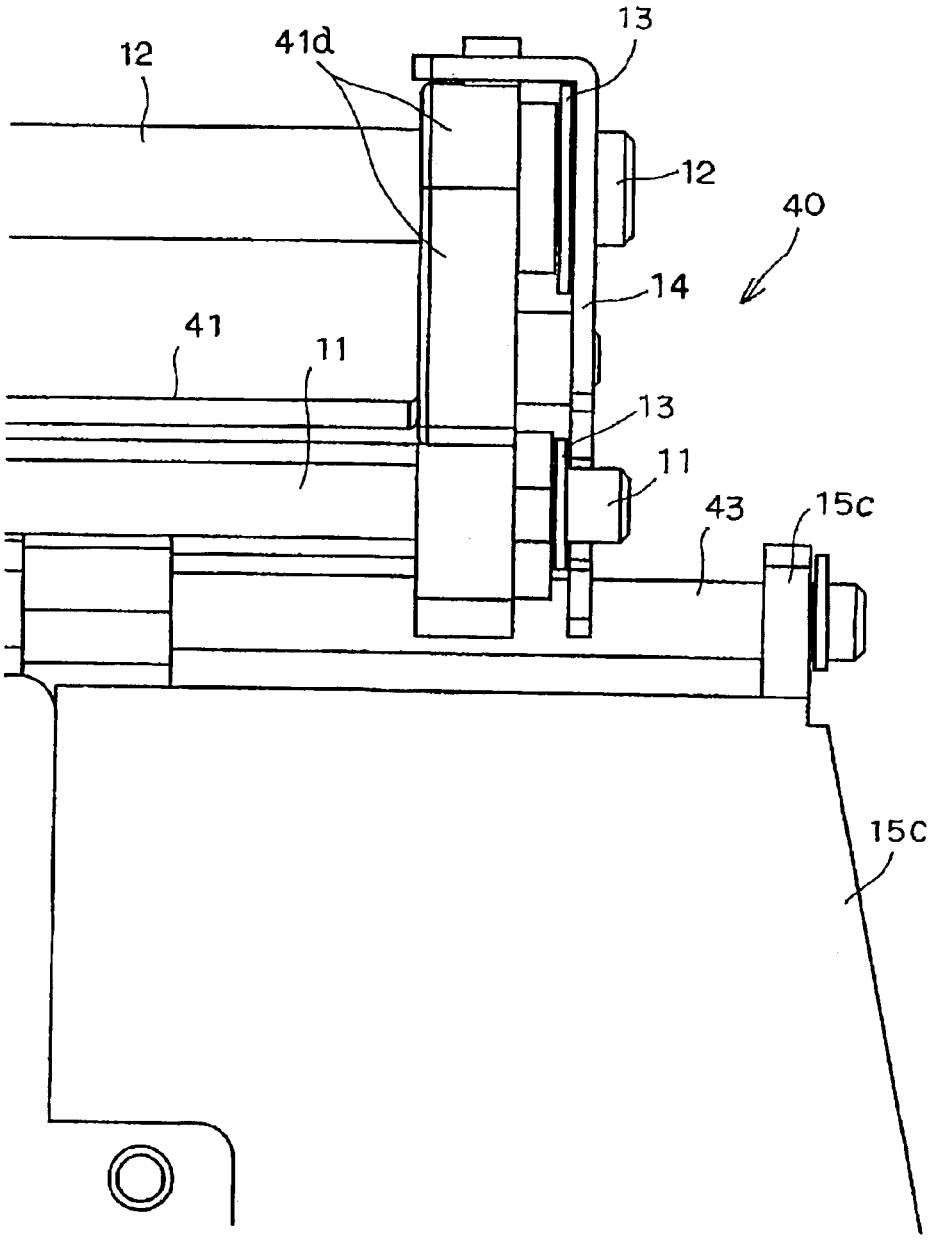
FIG. 6 is a further expanded view showing a portion of the sheet finishing apparatus shown in FIG. 5.

As is clearly shown in FIG. 5 and FIG. 6, the leading ends (on the right side of the FIG. 3) of the two supporting shafts 11 and 12 are inserted into the ear portion 41*a* protrudingly established on the outer edge of the upper surface on the sliding joint plate 41 which is a configuring element of the sheet preparatory (pre) alignment moving means (shift means) 40 dually used with the sheet shift means of the sorting means (jog means).

More specifically, to the leading edges of each of the support shafts of 11 and 12 beyond their penetration of the ear portion 41*a* of the sliding joint plate 41 is disposed the E ring 13. The removal preventing member 14 used commonly on both support shafts 11 and 12 is disposed on the outer ends in the shaft line direction of both the support shafts 11 and 12. The actions of the E ring 13 and the commonly used removal preventing member 41*a* disposed on the outer ends are unitized so that the shafts do not come out in the shaft direction.

Also, of the two supporting shafts 11 and 12, unitized as described above, the leading end of the lower supporting shaft 11 is rotatingly and in the shaft direction, movingly supported by a resilient vertically movable U-shaped first bearing member 17 on the upper portion of the U-shaped stand frame 15 established on one side in the sheet width direction of the base frame 1*c* (FIG. 7) in the sheet finishing apparatus 1.

Figure 10:
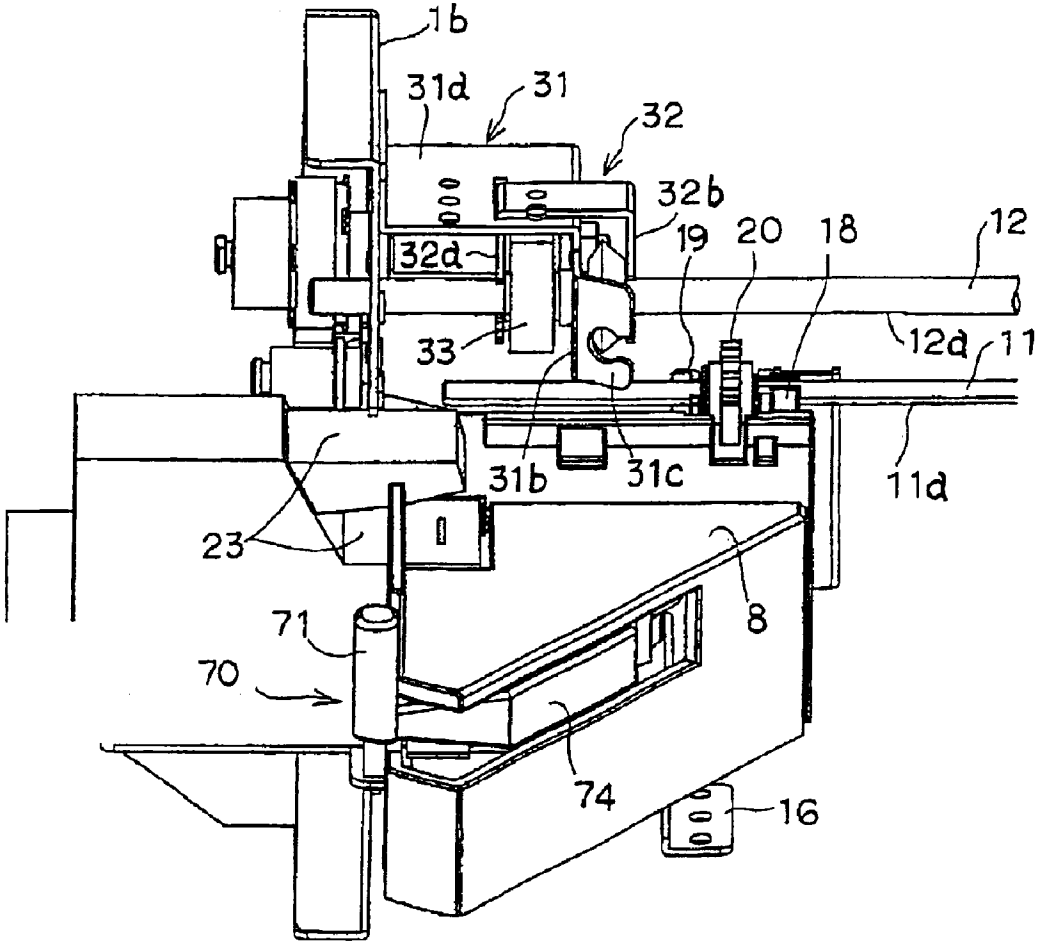
FIG. 10 is an expanded view showing a structure that supports a left edge of the support shaft of the sheet finishing apparatus shown in FIG. 4.
Figure 11:
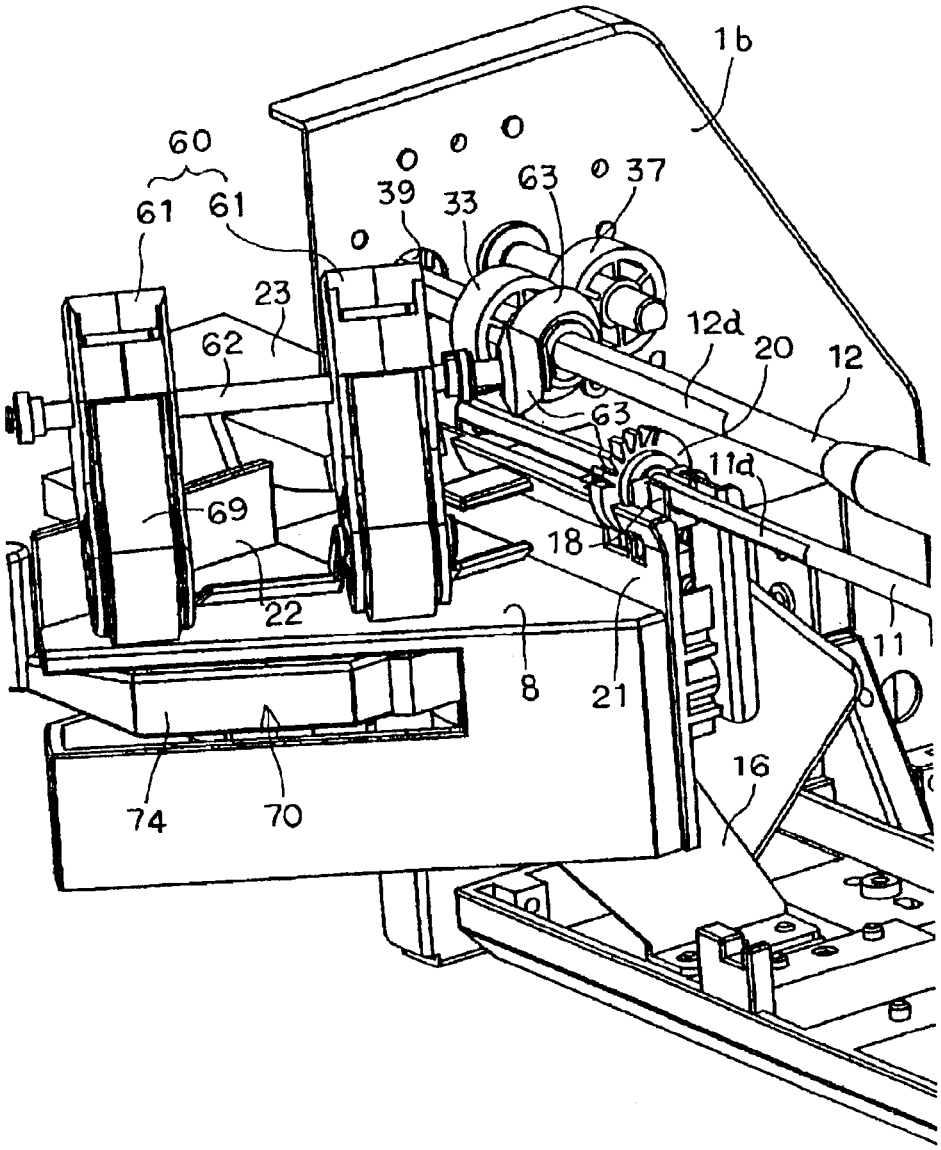
FIG. 11 is an expanded view showing a left edge side of the support shaft of the sheet finishing apparatus shown in FIG. 4.

On the other hand, with regard to the reference side (the left side of FIG. 3) of the aforementioned two support shafts 11 and 12, the shafts are rotatingly and slidingly supported in the shaft direction. More specifically, in FIG. 10 and FIG. 11, the reference side of the supporting shaft 11 of the two support shafts 11 and 12, is rotatingly and in the shaft direction, movingly supported by a resilient vertically movable U-shaped second bearing member 18 on the first support member 16 that is mounted to the side frame 1*b* of the sheet finishing apparatus 1. In this embodiment, as shown in FIG. 10 and FIG. 11, the reference side of the shaft 11 is formed as an angled shape 11*a* having a sectional D shape, the angled shape 11*a*. This angled shape 11*a* is supported by the U-shaped second bearing member 18, resiliently supported for vertical movement with regard to the first support member 16, and is rotatingly and in the shaft direction, movingly supported.

Also, to this squared shape 11*a* on the supporting shaft 11 the discharge paddle 20 made of a resilient material (rubber, in this case) comprising a plurality of teeth in the circumference direction is mated to allow the free sliding on the squared shape 11*a* in the shaft direction. To fix the absolute position of this discharge paddle 20 in the shaft direction, to the supporting shaft 11 the first slide regulating member 19 is mounted at a position slightly separated from the aforementioned second bearing member 18, the discharge paddle 20 is disposed between the aforementioned second bearing member 18 and the first slide regulating member 19 so the supporting shaft 11 moves relative to the discharge paddle 20 but the discharge paddle 20 position is not changed. Also, the supporting shaft 11 is configured to advance and retract in the shaft direction penetrating the first slide regulating member 19 shaft hole and the notched opening portion 38 established in the side frame 1*b* while leaving the discharge paddle 20, the movement thereof in the shaft direction regulated by the first slide regulating member 19, between the first slide regulating member 19 and the second bearing member 18. Note that the aforementioned sectional D shaped squared shape 11*a* formed on the reference side of the supporting shaft 11 slidingly penetrates in the shaft direction not only the discharge paddle 20, but the first slide regulating member 19 as well.

In other words, from both sides of the discharge paddle 20, the supporting shaft 11 is formed in a D shape for at least for the distance for the support shaft to advance and retract, the shaft hole in the discharge paddle 20 also is formed into a D shape. By configuring the advancing and retracting portion passing through the shaft hole in the discharge paddle 20 in the supporting shaft 11 to be non-circular shape including an oval, the rotation of the supporting shaft 11 can be transmitted to the discharge paddle 20 positioned between the second bearing member 18 and the first slide regulating member 19 even when the supporting shaft 12 and the supporting shaft 11 are advanced or retracted (sliding in the shaft direction). Therefore, while the paired tray discharge rollers 4 and 5 are advancing and retracting in the shaft direction along with the supporting shafts 11 and 12, and sheets are being discharged, the discharge paddle 20 exists at a determined position between the first slide regulating member 19 and the second bearing member 18. In other words, by rotating without moving in the shaft direction, the discharge paddle 20 is configured to discharge sheets.

Furthermore, the reference side of the upper supporting shaft 12 also is movingly supported in the shaft direction with regard to the second supporting member 31 mounted on the side frame 1*b*. In other words, as shown in FIG. 10, to the inner wall of the side frame 1*b* are disposed the upper surface wall 31*a* that extends slightly inside from the side frame 1*b* and the second supporting member 31 that comprises the vertical downward bent wall 31*b* that continues downward therefrom. Further, the upside-down U-shaped second slide regulating member 32 that comprises the leg portion 32*a* and the leg portion 32*b* is disposed with its one leg portion 32*a* penetrating vertically downward the aforementioned second supporting member 31 upper surface wall 31*a*. Also, between the leg portion 32*a* on the second slide regulating member 32 and the vertical downward wall 31*b* on the second supporting member 31, the interlock gear 33 is disposed on the supporting shaft 12, the aforementioned interlock gear 33 allows a relative sliding of the shaft direction with regard to the supporting shaft 12 penetrating therethrough, but is supported not to allow relative rotation.

In this embodiment, as is shown in FIG. 10 and FIG. 11, the reference side of the supporting shaft 12 is formed as the squared shape 12*a* having a sectional D shape, the cooperative action of the squared shape 12*a* and the bearing portion of the second supporting member 31 allows the rotation of the reference side of the supporting shaft 12 by the interlock gear 33 and shift in the shaft direction.

The slide support structure described above allows the supporting shafts 11 and 12 to rotate and to shift together accompanying the shift of the slide joint plate 41 in the shaft direction, the leading ends thereof joined together by the slide joint plate 41.

Figure 12:
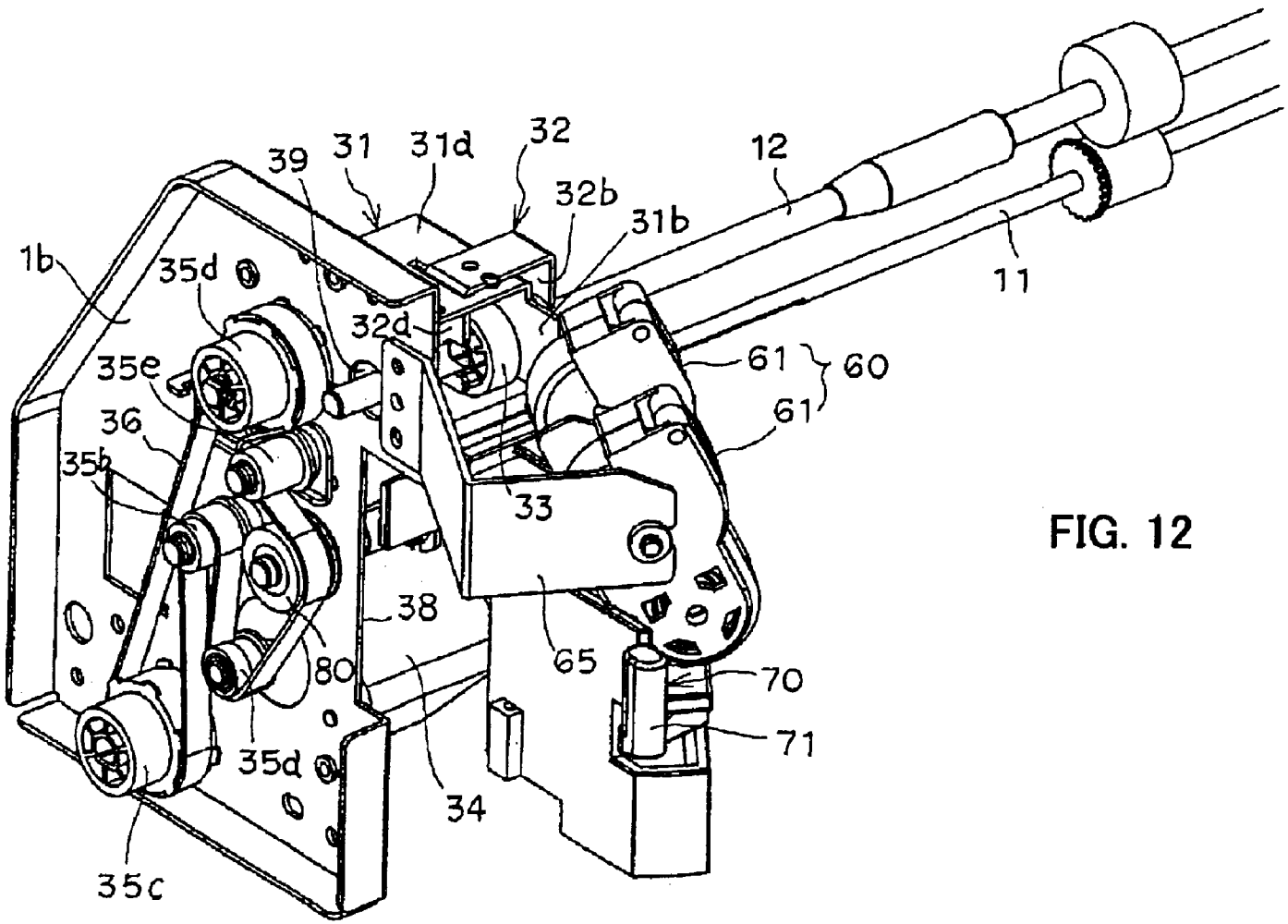
FIG. 12 is a perspective view showing a drive mechanism of the support shaft of the sheet finishing apparatus shown in FIG. 4.

As shown in FIG. 12, to the side frame 1*b* are disposed the transport motor 34 that rotatingly drives the aforementioned supporting shaft 12 and that applies transport force to the sheets and the drive transmission mechanism. Specifically, the output from the transport motor 34 is transmitted from the motor pulley 35*a* mounted on that output shaft to the intermediate pulley 35*b*, the transport roller pulley 35*c* and the follower pulley 35*d* via the timing belt 36 and the drive transmission mechanism is configured so that transmits to the interlock pulley 37 disposed on the same shaft as the follower pulley 35*d*. The interlock gear 33 disposed on the aforementioned supporting shaft 12 mates with the interlock gear 37 that is the output side of the drive transmission mechanism. Thus, the drive from the transport motor 34 is received by the interlock gear 33 and rotates the supporting shaft 12, accompanying that, the follower side supporting shaft 11 also rotates.

Specifically, the tray discharge roller 5 is the drive roller rotated by the transport motor 34 via the aforementioned drive transmission mechanism. The other, the tray discharge roller 4, is a follower roller in contact with the tray discharge roller 5 and rotates by the rotation of the tray discharge roller 5. Also, the transport motor 34 and the drive transmission mechanism 35, as described below, are used for the sheet bundle discharge means 70 to move the sheet bundle to the storage means 9. As can be clearly seen in FIG. 18 and in FIG. 19, these transport motor 34 and drive transmission mechanism 35 are established with at least a portion thereof protruding into the space opposingly established to the fixed stacking portion (the first tray) 8 and sandwiching the positioning plate 22 and side frame 1*b*. The space functions as the shift tolerance portion to allow the support shafts 11 and 12 to protrude by the pre-alignment movement means (shift means) which is describe below.

Figure 13:
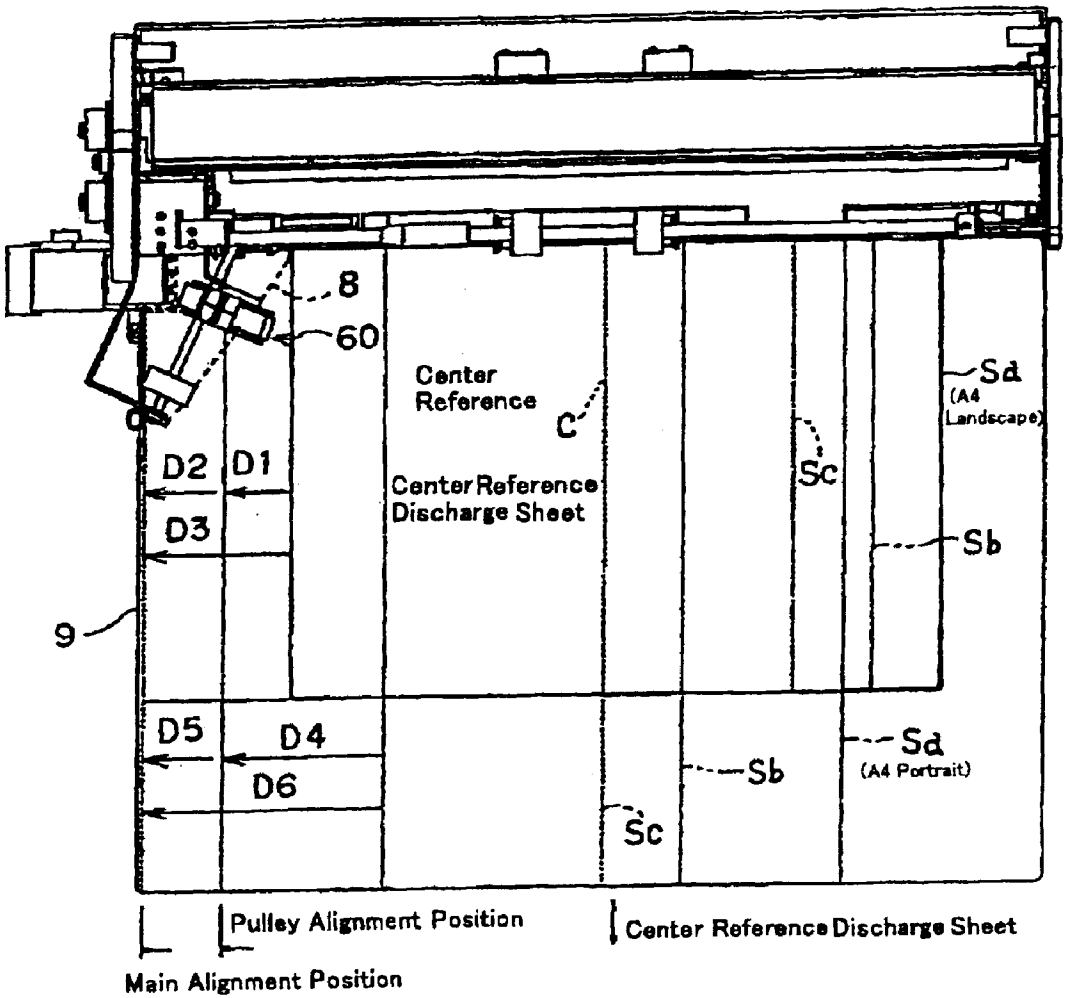
FIG. 13 is a drawing showing a relationship among a position of a sheet discharged with a center reference from the sheet finishing apparatus according to the present invention, a preparatory (pre) alignment position and a alignment position.
Figure 14:
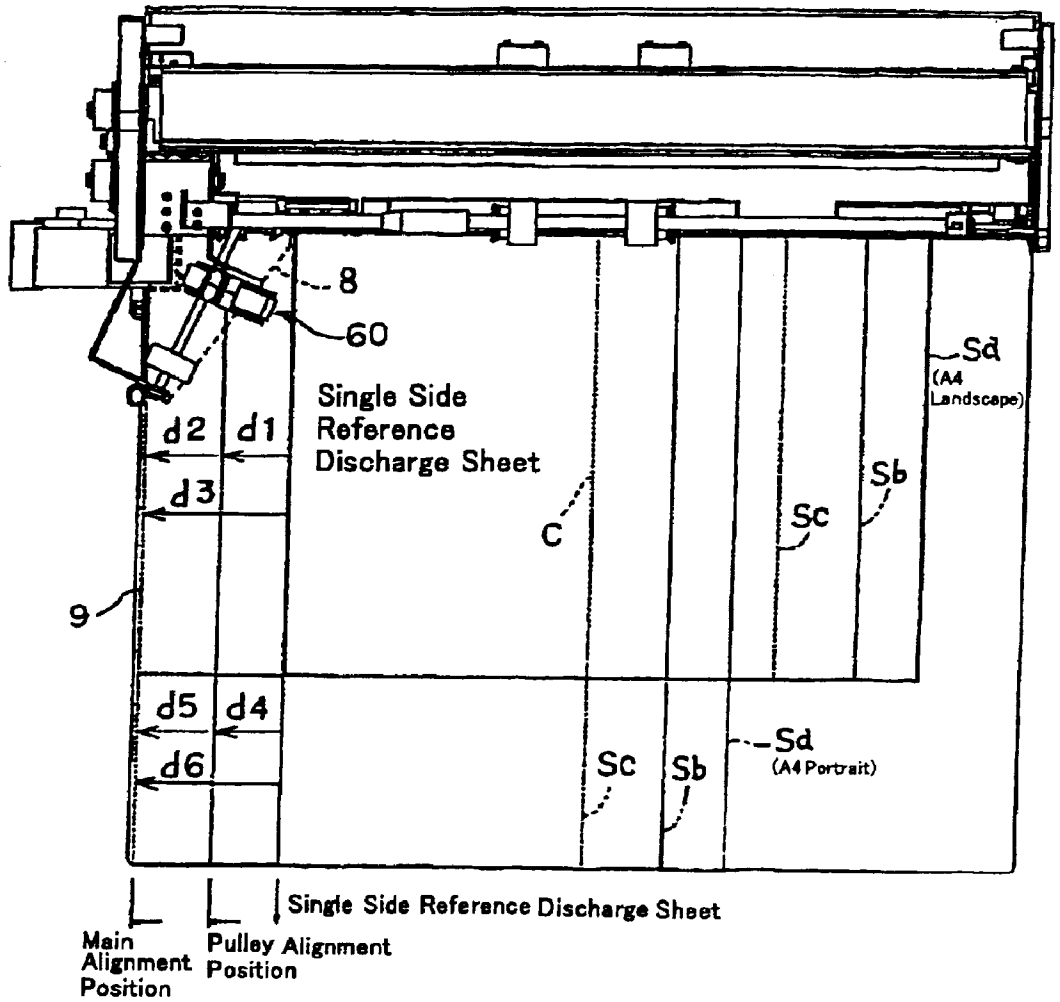
FIG. 14 is a drawing showing a relationships among a position of a sheet discharged with a side reference from the sheet finishing apparatus according to the present invention, a preparatory (pre) alignment position and a alignment position.
Figure 47:
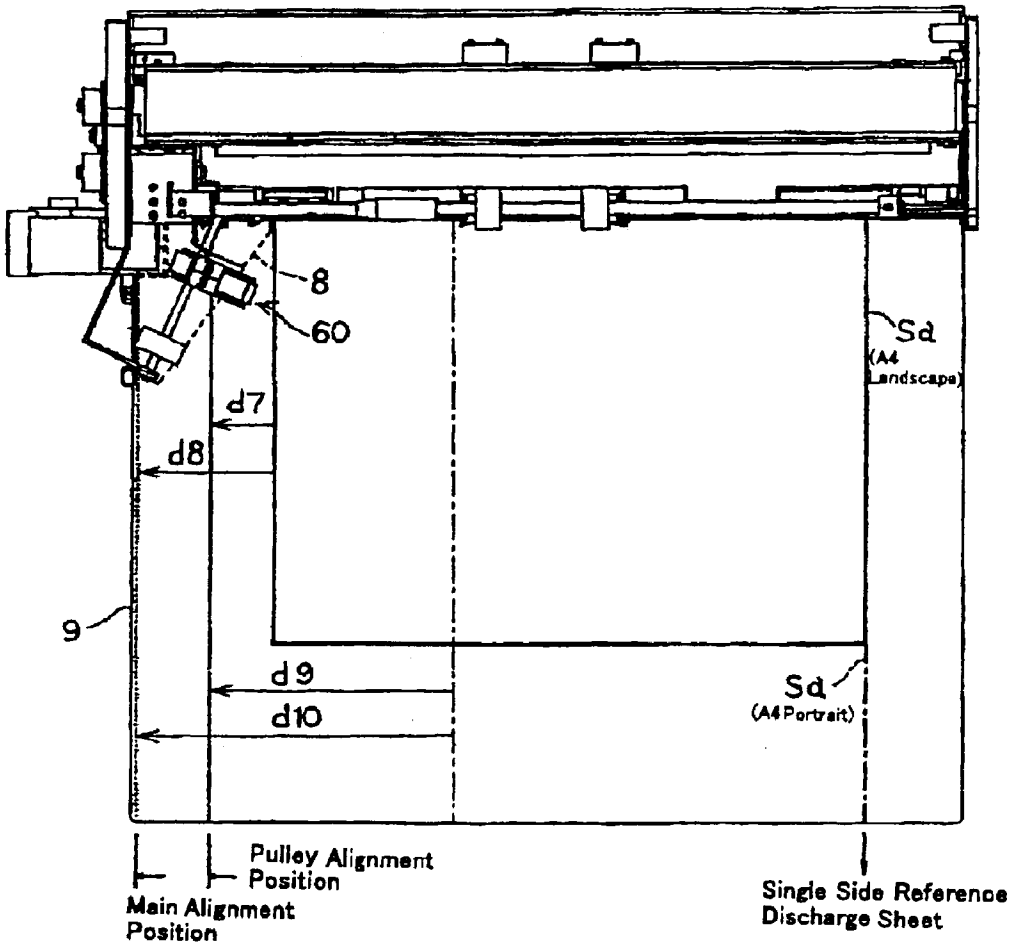
FIG. 47 is a drawing showing a relationship of a position of the sheet discharged with a side reference from the sheet finishing apparatus according to the present invention, the preparatory (pre) alignment position and the alignment position.
Figure 48:
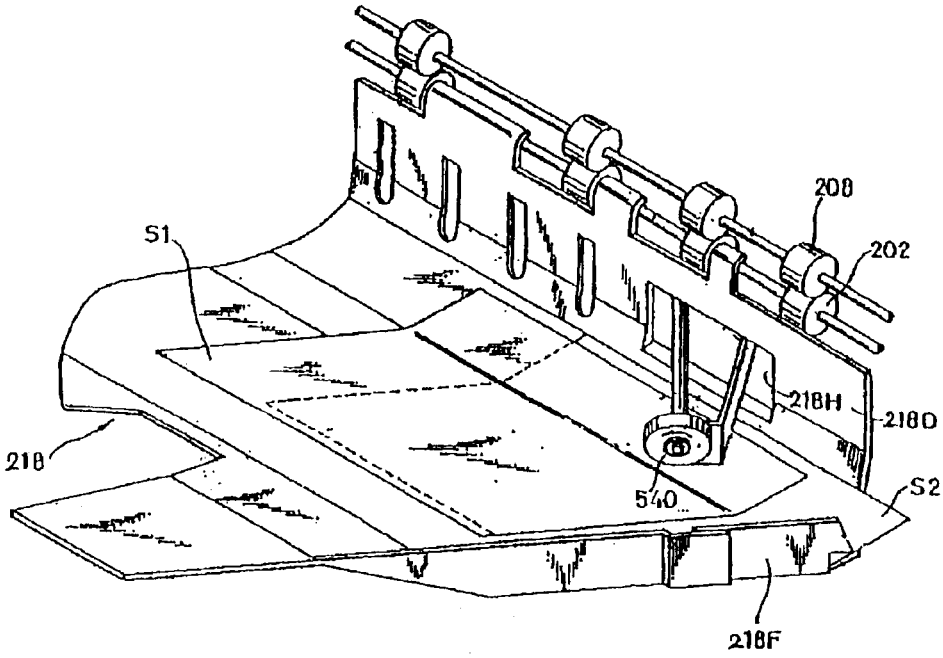
FIG. 48 is a view showing a structure of a conventional sheet finishing apparatus.

C. Alignment Reference Position and Finishing Means (FIG. 13, FIG. 14 and FIG. 47)

Figure 15:
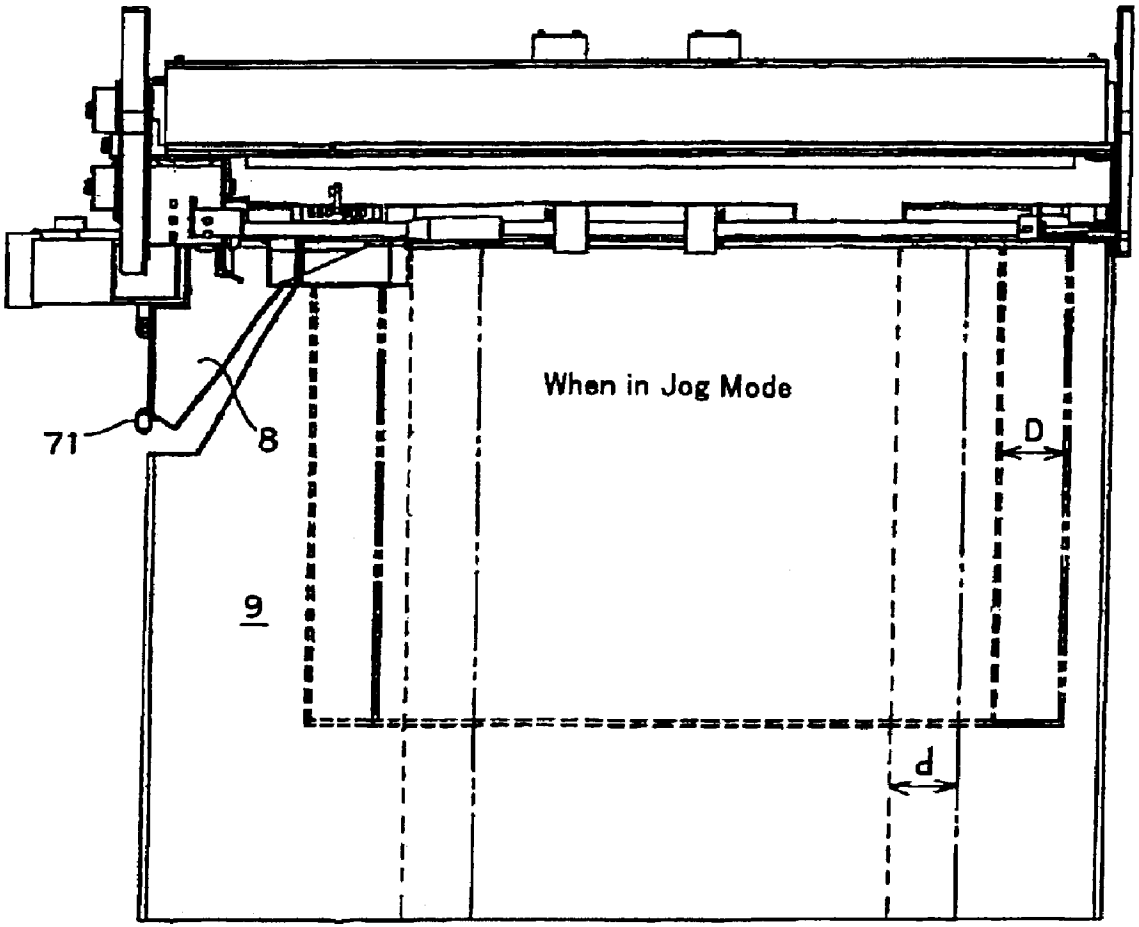
FIG. 15 is a drawing showing a sheet discharge position when a jog mode is operated on the sheet finishing apparatus according to the present invention.

In the sheet discharge means 6 of the aforementioned configuration, the sheets are nipped by the rotating paired tray discharge rollers 4 and 5 and are fed from the discharge outlet 7 with the applied transport force and are discharged to the fixed stacking portion 8 (the first tray) and to the storage tray 9 (the second tray). FIG. 13 shows sheets discharged with a center reference, FIG. 14 shows sheets discharged with a rear side reference. FIG. 47 shows sheets discharged with the front side reference. Also, FIG. 15 shows the sheets being discharged when in the jog mode, which is described below. In the jog mode, while shifting each of the sheet bundles alternately a distance of D5, which is the offset amount, they are sequentially stacked when discharged, thereby offsetting each of the sheet bundles that are stacked, vertically.

Figure 26:
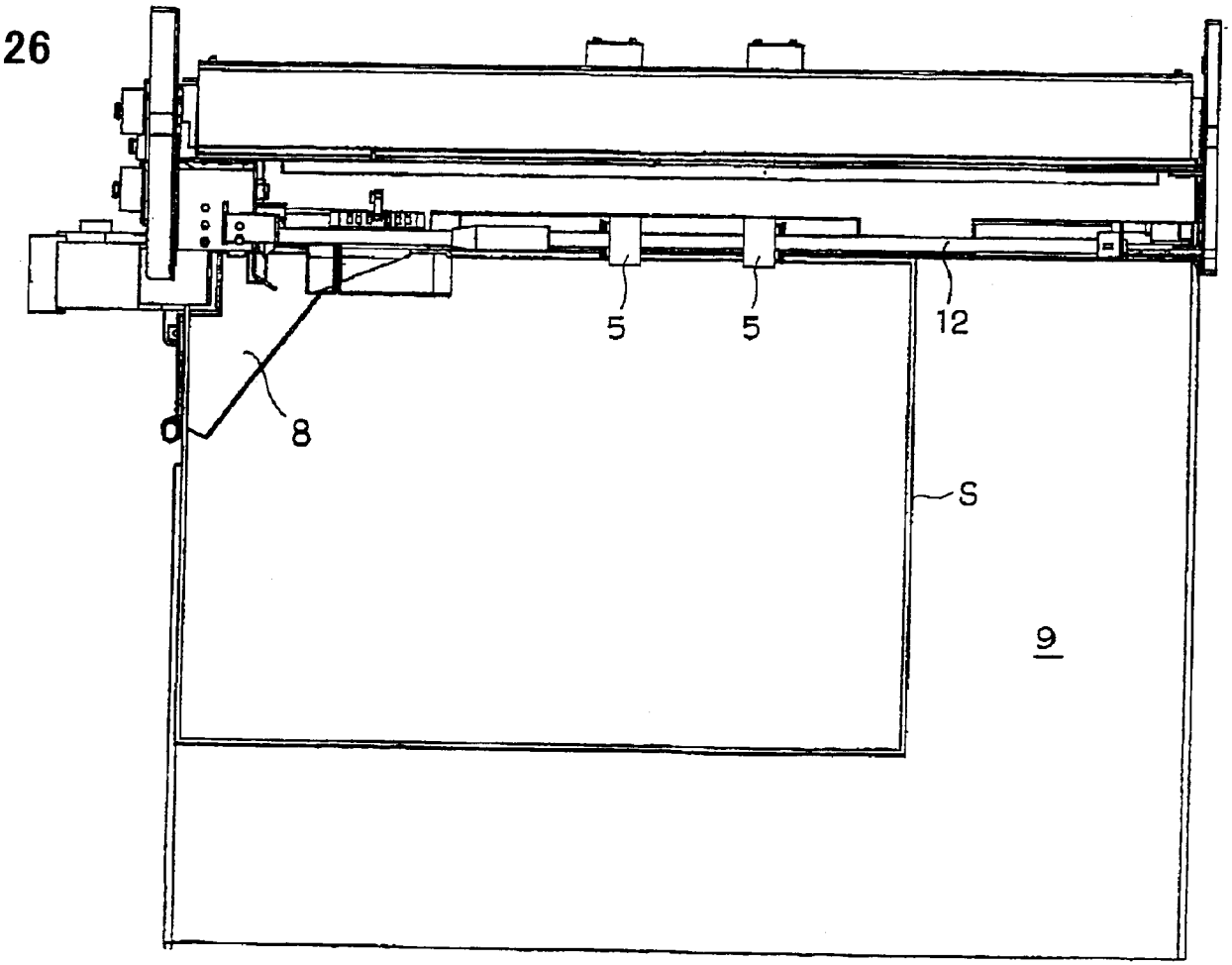
FIG. 26 is a drawing showing a relationship of a fixed stacking portion (the first tray), a storage tray (the second tray), a size and shape of the sheet in the sheet finishing apparatus according to the present invention.

According to each of these discharge embodiments, the sheet slides along with the paired discharge rollers 4 and 5, but the paired discharge rollers 4 and 5 are arranged above the fixed stacking portion (the first tray) 8 and the storage portion (the second tray) 9 so with the level difference with the fixed stacking portion (the first tray) 8 and the storage portion (the second tray) 9, the sheet abuts the level difference itself angled in the vertical direction and does not easily get caught on this level. As described below, the fixed stacking portion (the first tray) is formed so that the upstream portion of the sheet in the discharge direction being slid by the paired tray discharge rollers 4 and 5, touches the level difference portion earlier on the fixed stacking portion (the first tray) 8 and the storage portion (the second tray) 9. As shown in FIG. 26 as a detailed example, the fixed stacking portion (the first tray) 8 is formed into a substantial triangular shape, when looking from above. Specifically, the level difference portion of the fixed stacking portion (the first tray) 8 and the storage portion (the second tray) 9 is structured obliquely to one side of the sheet discharged by the paired tray discharge rollers 4 and 5. Through this, then, a side of the sheet being slid by the paired tray discharge rollers 4 and 5 touches the level difference portion on the fixed stacking portion (the first tray) 8 and the storage portion (the second tray) 9 relatively obliquely in the sheet discharge direction and does not get caught on the level. In this way, because the sheet is discharged while being slid by the paired tray discharge rollers 4 and 5 that are arranged above the fixed stacking portion (the first tray) 8 and the storage portion (the second tray) 9, if there is a level difference between the fixed stacking portion (the first tray) 8 and the storage portion (the second tray) 9, the sheet does not get jammed on the level and it can be transferred accurately to the nipping position on the belt unit 61 on the fixed stacking portion (the first tray) 8. The sheet being slidingly moved by the paired tray discharge rollers 4 and 5 is securely guided with the leading edge of the sliding movement direction to the pre-alignment position by the guide member 15 as shown in FIG. 2, in other words to the nipping position of the belt unit 61.

The storage tray 9 (the second tray) as the sheet storage means is established to support three corners, excluding the sheet corner portion supported by the sheet single corner portion support means when finishing sheets by the stapler (finishing means) 23, which is described later. However, it is also perfectly acceptable for a size that supports one of the upstream corners of the three corners and a part of the back surface of the sheets. In this example, the storage tray 9 (the second tray) is long. That size has a dimension capable of storing the vertically long size of full sized sheets such as A3 or B4 (in this case, the length of A3 size).

The fixed stacking portion 8 (the first tray) as the aforementioned sheet single corner portion support means is formed so that the edge of the upper surface that supports sheets on the fixed stacking portion 8 (the first tray) is on the side of the single corner of the sheets from the diagonal line drawn between the two corners neighboring the single corner of the sheets when discharging the smallest size of sheet handled using the sheet discharge means 6. Here, the fixed stacking portion 8 (the first tray) as the aforementioned sheet single corner portion support means, is arranged above the single corner portion (the upper left corner in FIG. 13) upstream of the sheet discharge direction of the storage tray 9, to be a portion of the sheet storage surface for the storage tray 9 when looking from above.

Figure 27:
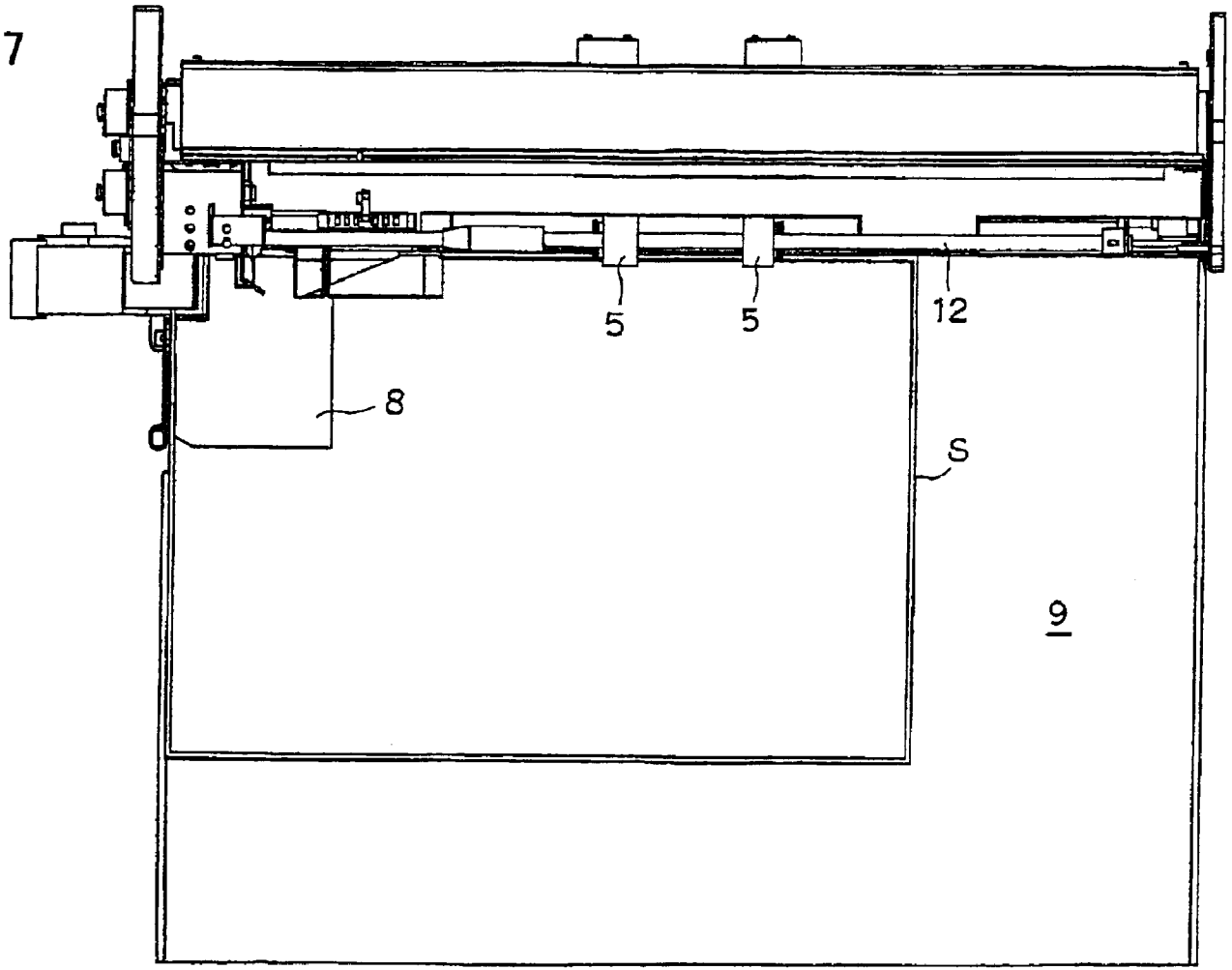
FIG. 27 is a drawing showing a modified example of the fixed stacking portion (the first tray) in FIG. 26 having a rectangular shape in the sheet finishing apparatus according to the present invention.

In this embodiment, the shape of the fixed stacking portion 8 (the first tray) is a substantial triangle inclined at the single corner portion upstream of the sheet discharge direction on the storage tray 9 when looking from above. Also, it is perfectly acceptable to form any polygonal or circular shape in place of the triangular shape. Also, vertical position between the level difference portion of the fixed stacking portion (the first tray) 8 and the storage portion (the second tray) 9 and the paired tray discharge rollers 4 and 5 is quite separated, so if there is no danger of the sheet getting caught on this level portion, it is acceptable for it to be an oblong shape, as shown in FIG. 27.

Figure 3:
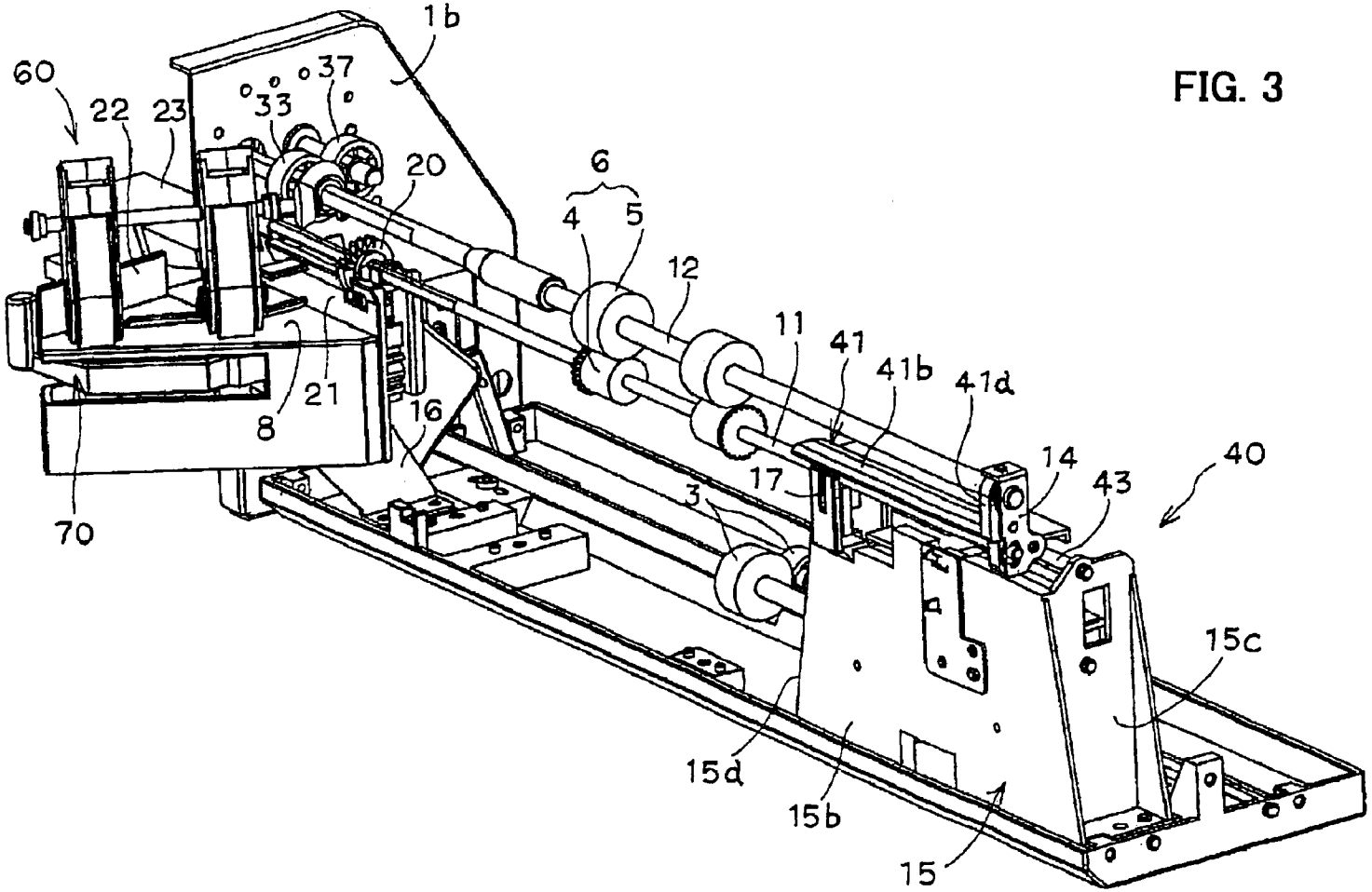
FIG. 3 is a perspective view of the sheet finishing apparatus with a cover and storage tray removed according to the present invention.
Figure 4:
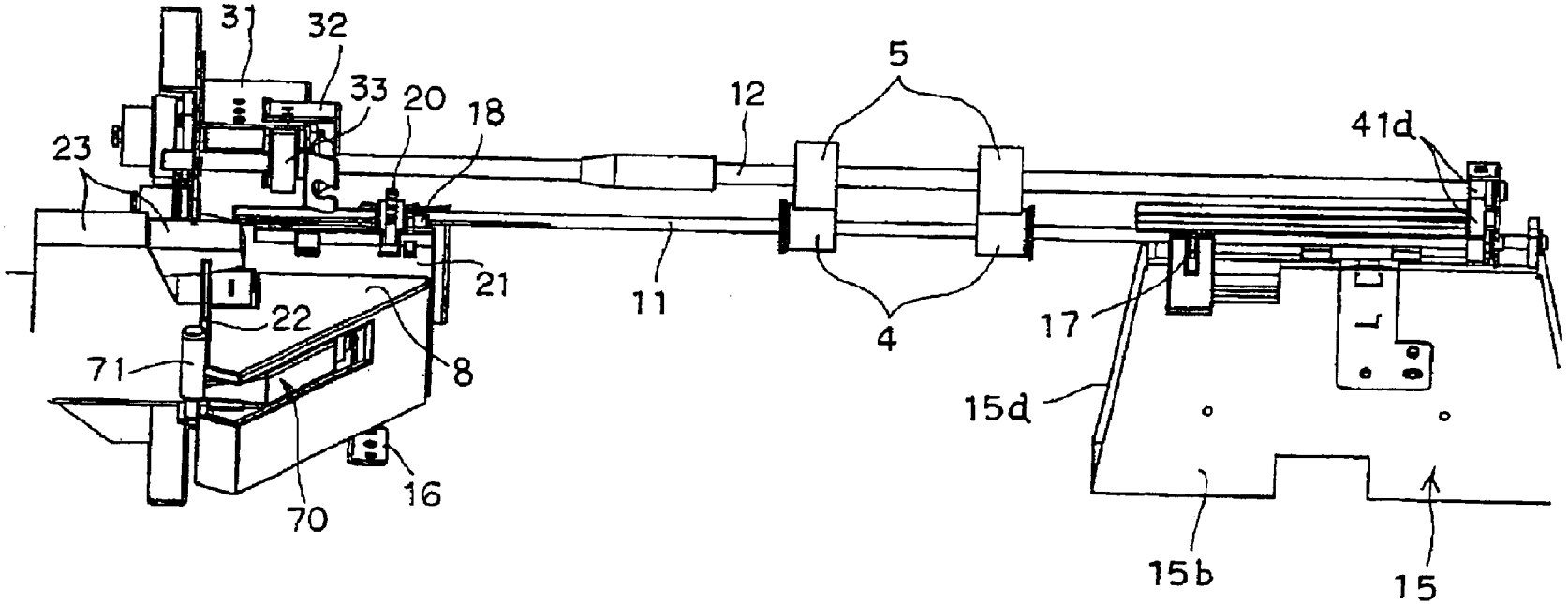
FIG. 4 is a perspective view seen from above showing the sheet finishing apparatus shown in FIG. 3 with a base frame removed.

As shown in FIG. 3 and FIG. 4, upstream of the fixed stacking portion 8 is arranged the abutting plate 21 as one of the positioning reference means (alignment reference member) to align at least one side of the sheets discharged by the discharge means 6, configuring the discharge direction reference surface that applies the discharge direction alignment reference position when aligning sheets.

On one side of the fixed stacking portion 8 is arranged the positioning plate 22 composed of the abutting reference (width direction alignment reference position) in the direction traversing the sheet discharge direction (hereinafter referred to as the width direction), as one of the position alignment reference means (alignment reference member) to align at least one side of the sheets discharged by the discharge means 6.

The finishing position is regulated by the abutting plate 21 (the discharge direction alignment reference position) and the positioning plate 22 (the width direction alignment reference position).

The stapler 23 as the finishing means piercingly drives staples into and binds sheet bundles aligned by being pushed against the finishing position of the aforementioned fixed stacking portion 8 (the first tray). As can be clearly seen in FIG. 18 and in FIG. 19, the stapler 23 is with at least a portion protruding in the space 200 established on a side opposing the aforementioned fixed stacking portion (the first tray) 8 sandwiching the positioning plate 22 and side frame 1*b*. The space functions as the shift tolerance portion to allow the support shafts 11 and 12 to protrude by the pre-alignment movement means (shift means) which is describe below.

D. The Pre-Alignment Movement Means (Shift Means) 40

When discharging sheets with the aforementioned side reference and center reference, for example when starting discharging an A4 size sheet to the storage portion (the second tray) 9 rather than the fixed stacking portion (the first tray) 8, if it is discharged as it is, the level difference between the fixed stacking portion (the first tray) 8 and the storage portion (the second tray) 9 gets in the way, so alignment of the sheet at the alignment position on the fixed stacking portion (the first tray) 8 is not possible. In either the center discharge reference or the side discharge reference, as the size of the sheet gets smaller, the discharge starts with the storage portion (the second tray) 9 side. However, in this embodiment, by shifting the sheet only the distances of D1, D4, d1 and d4 to the width direction alignment reference position side using the dually used pre alignment movement means (side alignment means) 40 and the jog means, which is described below, the sheet overcomes the level difference in the fixed stacking portion (the first tray) 8 and the storage portion (the second tray) 9 to be moved to the determined pre-alignment position for binding by the aforementioned stapler 23. Also, when in the jog mode, sheets are horizontally fed (traverse movement) only the amount of D and d in FIG. 15 for sorting.

For that purpose, the preparatory (pre) alignment movement means 40 assumes the aforementioned sliding structure wherein the supporting shafts 11 and 12 on the paired tray discharge rollers 4 and 5 retract in the shaft direction. Furthermore, the structure is equipped with the sliding joint plate 41 and its sliding drive portion 45 to shift together with the supporting shafts 11 and 12 in the shaft direction. The sliding joint plate 41 and the sliding drive portion 45 that are linked and shift together on the support shafts 11 and 12 in the shaft line direction are established on a side opposing the stapler 23, the transport motor 34 and drive transmission mechanism 35 sandwiching the positioning plate 22 and the side frame 1*b* so that there is an even distribution of the weight balance of the drive portion concentrated on one side or the lack of space.

Figure 7:
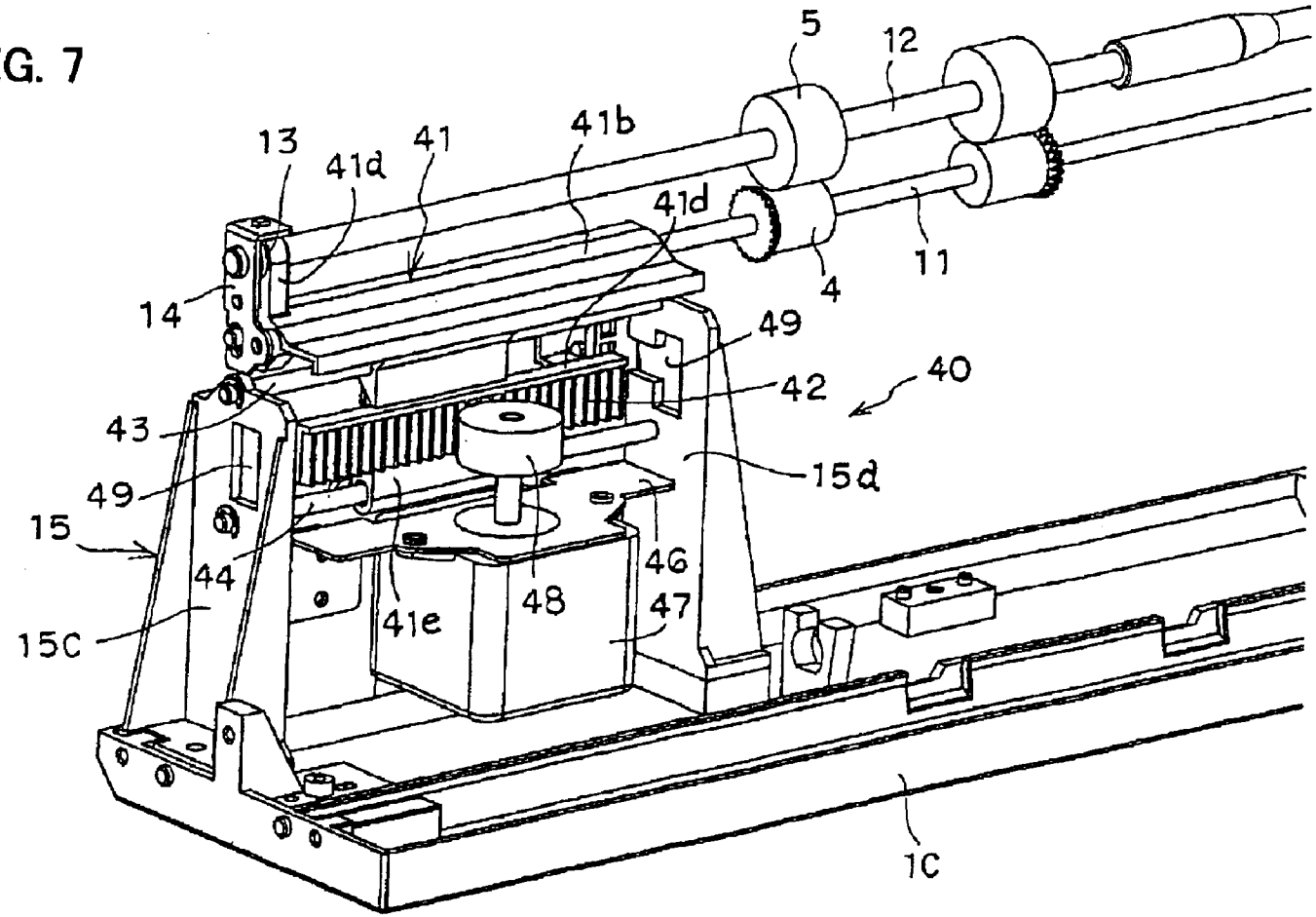
FIG. 7 is a perspective view seen from inside the apparatus showing sheet shift means (commonly used as preparatory (pre) alignment moving means and sorting means) built into the stand frame shown in FIG. 5.
Figure 9:
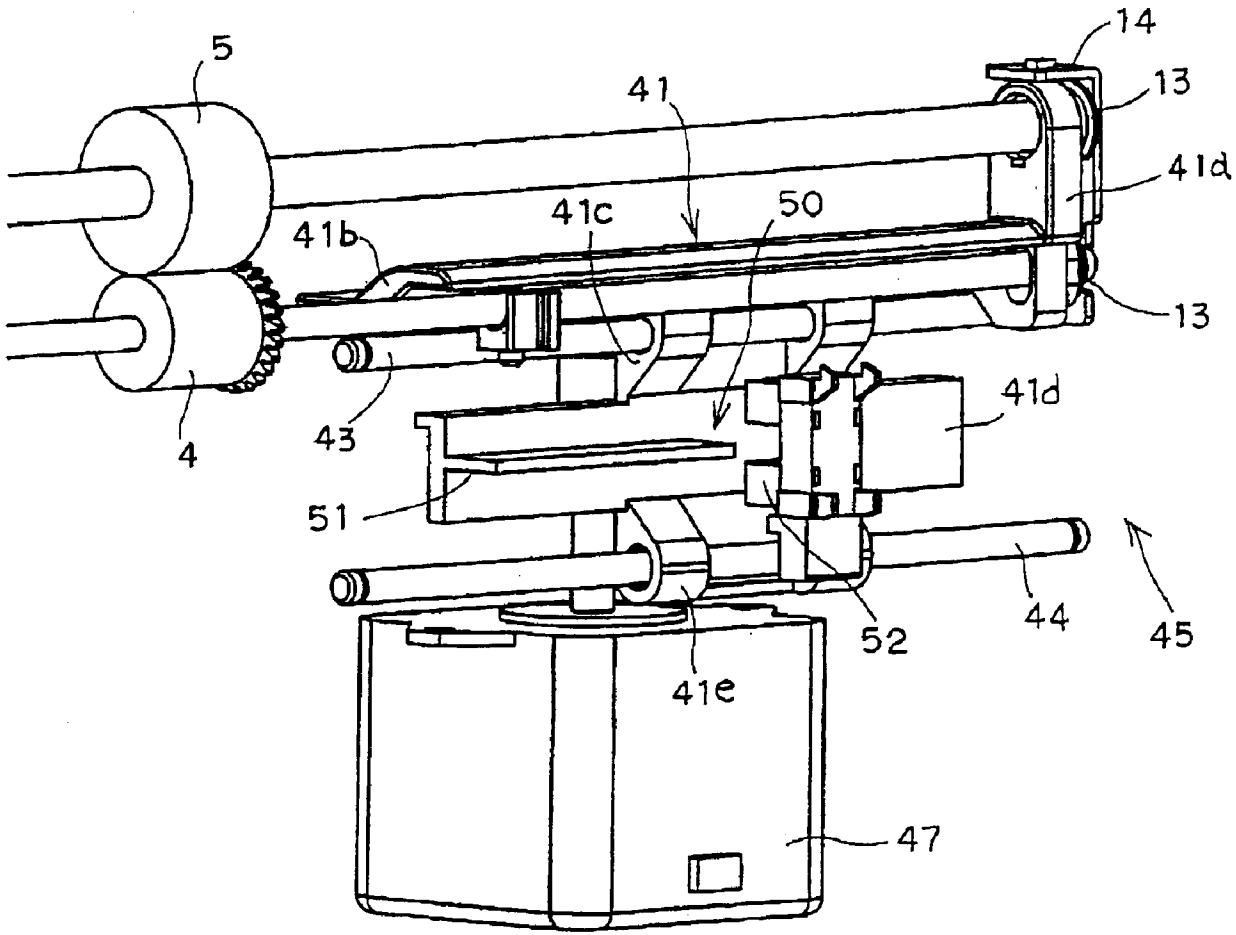
FIG. 9 is a perspective view showing a structure of the HP detection sensor.

As has already been described, the sliding joint plate 41, as shown in FIG. 7 and in FIG. 9 which is one configuring element of the preparatory (pre) alignment movement means 40 is equipped with the head portion 41*b* forming a guide surface for the sheets, the ear portion 41*a* protrudingly established on the upper surface thereof, the neck portion 41*c* vertically downward in the lower surface of the head portion 41*b*, the torso portion 41*d* that continues widthwise and one leg portion 41*e* formed to approximately the same thickness as the neck portion. Also, the neck portion 41*d* and the leg portion 41*e* are movingly supported in the shaft direction by the two upper and lower guide rods 43 and 44 suspended in the horizontal direction between the side walls 15*a* and 15*c* on the U-shaped stand frame 15.

The supporting shafts 11 and 12 are rotatingly supported, the leading ends thereof inserted into the ear portion 41*a* on the sliding joint plate 41 and are configured to slide together in the shaft direction, being unitized by the sliding joint plate 41. In this embodiment, the space established therein with the stapler 23, the transport motor 34 and drive transmission mechanism 35, specifically, the space opposingly established to the fixed stacking portion (the first tray) 8 sandwiching the positioning plate 22 and the side frame 1*b* functions as a shift tolerance portion to allow the protrusions of the support shafts 11 and 12 when the support shafts 11 and 12 are shifted by the slide drive portion 45. Thus, by utilizing the space that is essential to the installation of the stapler 23, the transport motor 34 and the drive transmission mechanism 35 the support shafts 11 and 12 protrude and the apparatus can be made more compact.

Next, the explanation shall focus on the structure of the sliding drive portion 45.

To configure the sliding drive portion 45, the rack 42 is established to the along the supporting shaft 11 direction torso portion 41*d* on the aforementioned sliding joint plate 41. Also, as a slide support frame, to the inner wall of the stand frame 15 is established the slide motor 47, via the mounting plate 46, the pinion gear 48 mounted to the output shaft of the slide motor 47 mates with the aforementioned rack 42.

The aforementioned configuration of the sliding drive portion 45 transmits drive to the sliding joint plate 41 along the guide rods 43 and 44 by rotating while the pinion gear 48 mates with the rack 42 on the sliding joint plate 41, according to the forward and reverse drive of the slide motor 47 controlled by a control means which is described below and in the end, advances and retracts the supporting shafts 11 and 12 linked to the sliding joint plate 41 and the paired tray discharge rollers 4 and 5 which are mounted on each of the supporting shafts.

In different view, the sliding drive portion 45 is composed of the slide motor 47 which is equipped with the sliding joint plate 41 that rotatingly links the supporting shafts 11 and 12, the guide rods 43 and 44 that retractably supports the sliding joint plate 41 in the shaft direction, the stand frame 15 that mountingly supports the guide rods 43 and 44 mounted to the base frame 1*c* and the pinion gear 48 rotatingly mounted on the shaft of the sliding drive portion 45. Furthermore, the sliding joint plate 41 configuration is equipped with the linking portion (the ear portion 41*a*) the supporting portions (neck portion 41*c* and leg portion 41*e*) that comprises the shaft hole for the penetration of the guide rods 43 and 44 and the rack 42 that mates with the pinion gear 48 mounted on the rotating shaft of the slide motor 47.

To the side walls 15*a* and 15*c* on the stand frame 15, which acts as the slide supporting frame is formed the slide opening portion 49 for the rack 42 to enter to the outside of the side walls 15*a* and 15*c* on the stand frame 15 when the pinion gear 48 advances and retracts the sliding joint plate 41.

Figure 8:
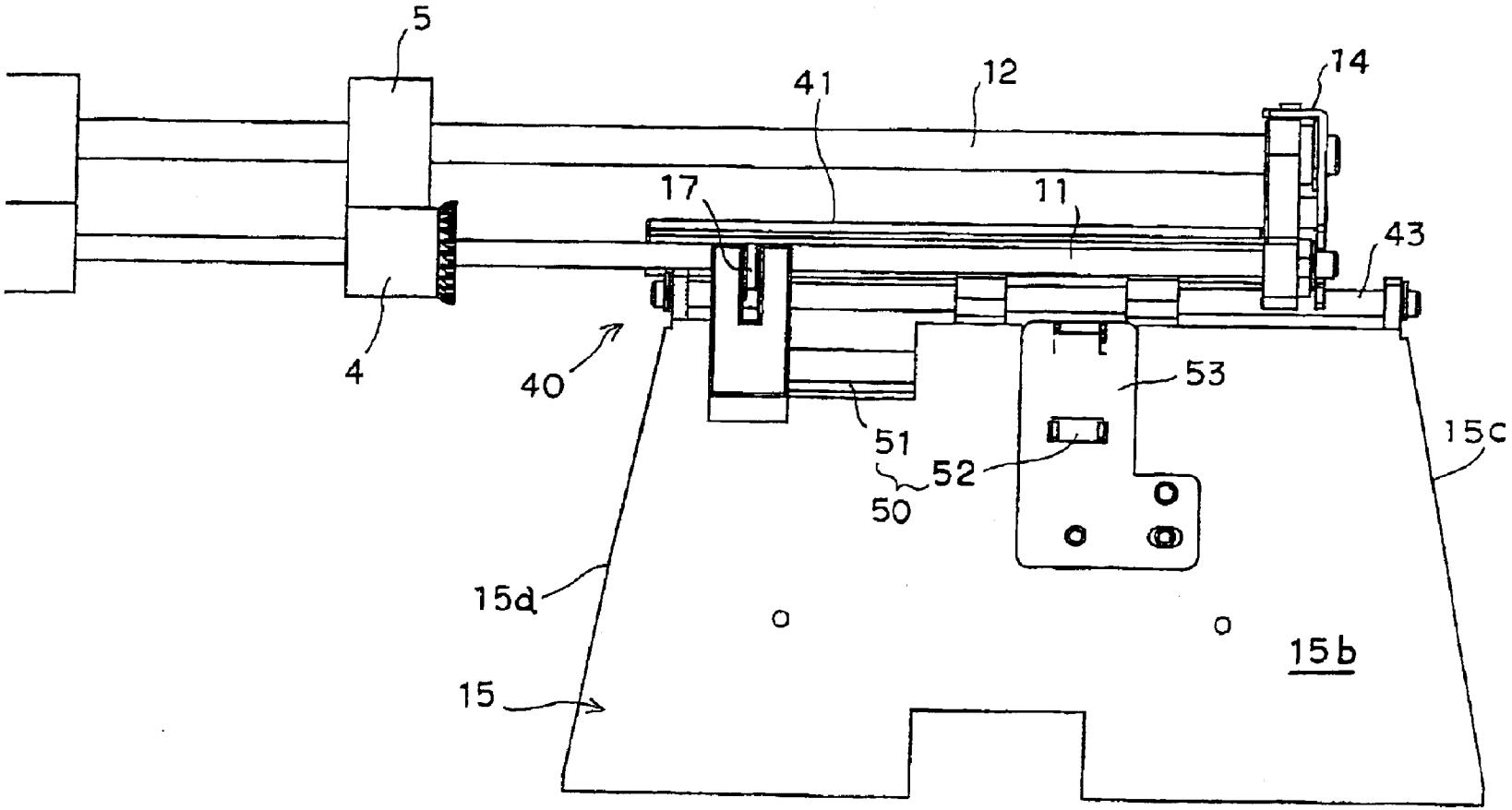
FIG. 8 is a drawing showing a position of a HP detection sensor disposed in the stand frame of the sheet finishing apparatus.

Further, to the backside of the torso portion 41*d* on the sliding joint plate 41 is established the position detection protrusion 51 that extends with a plate shape in the horizontal direction, as shown in FIG. 9. This position detection protrusion 51 also functions to prevent warping by the bending of the sliding joint plate 41. Also, as shown in FIG. 8 and FIG. 9, to the front wall 15*b* on the stand frame 15, the interrupter 52 (paired optical elements for emitting and receiving) composing the transmissive type optical sensor that cooperate with the position detection protrusion 51 are mounted via the auxiliary plate 53. Also, the transmissive type optical sensor configured by the position detection protrusion 51 and the interrupter 52 (paired optical elements for emitting and receiving) function as the HP detection sensor 50 that detect the home position (HP) of the sliding joint plate 41, namely the supporting shafts 11 and 12 and turn ON when the position detection protrusion 51 interrupts the light of the interrupter 52 (paired optical elements for emitting and receiving).

In conventional apparatuses, after the paired discharge rollers have nipped the sheet, and have stopped the transport of the sheet, the sheet is discharged after shifting or sliding the discharge rollers. However, with this sheet finishing apparatus 1, according to the aforementioned configuration, even while the supporting shafts 11 and 12 are advancing or retracting in the shaft direction, it is possible to transmit drive from the transport motor 34 being sent via the linking gear 33 to the supporting shaft 12. That is to say that the advancing and retracting in the shaft direction of the tray discharge roller 5 mounted to the supporting shaft 12 and the tray discharge roller 4 mounted supporting shaft 11 and the transport of the sheet by the paired tray discharge rollers 4 and 5 occur simultaneously.

Through this configuration, the alignment process and the sorting process times can be shortened.

The supporting shaft 11 linked to the supporting shaft 12 by the sliding joint plate 41 is configured to advance and retract in the shaft direction by the sliding drive portion 45 (FIG. 9) which is described later, penetrating the first slide regulating member 19 shaft hole and the notched opening portion 38 established in the side frame 1*b* while leaving the discharge paddle 20, the movement thereof in the shaft direction regulated by the first slide regulating member 19, between the first slide regulating member 19 and the second bearing member 18.

According to this structure, the tray discharge roller 4, which is mounted on the supporting shaft 11 advances and retracts in the shaft direction along with the tray discharge roller 5 that is the drive roller mounted to the supporting shaft 12 and simultaneous to the advancing and retracting, the tray discharge roller 4 nips and transports the sheet along with the tray discharge roller 5.

Furthermore, from both sides of the discharge paddle 20, the supporting shaft 11 is formed in a D shape for at least for the distance for the support shaft to advance and retract, the shaft hole in the discharge paddle 20 also formed into a D shape. By arranging this type of structure, it is possible to transmit the rotation of the supporting shaft 11 to the discharge paddle 20 positioned between the first slide regulating member 19 and the second bearing member 18 by the sliding drive portion 45 while the supporting shaft 11 is advancing and retracting in cooperation with the supporting shaft 12. The sheets are discharged while the paired tray discharge rollers 4 and 5 advance and retract in the shaft direction along with the supporting shafts 11 and 12, the discharge paddle 20 acts to discharge sheets to a determined position between the first slide regulating member 19 and the second bearing member 18.

E. The Alignment Means (Pulling Means) 60

The sheet finishing apparatus 1 comprises the alignment means 60 for aligning sheets by securely pulling them to a finishing position on the fixed stacking portion 8. The following shall describe the configuration of the alignment means 60 using FIG. 16 to FIG. 19.

Figure 16:
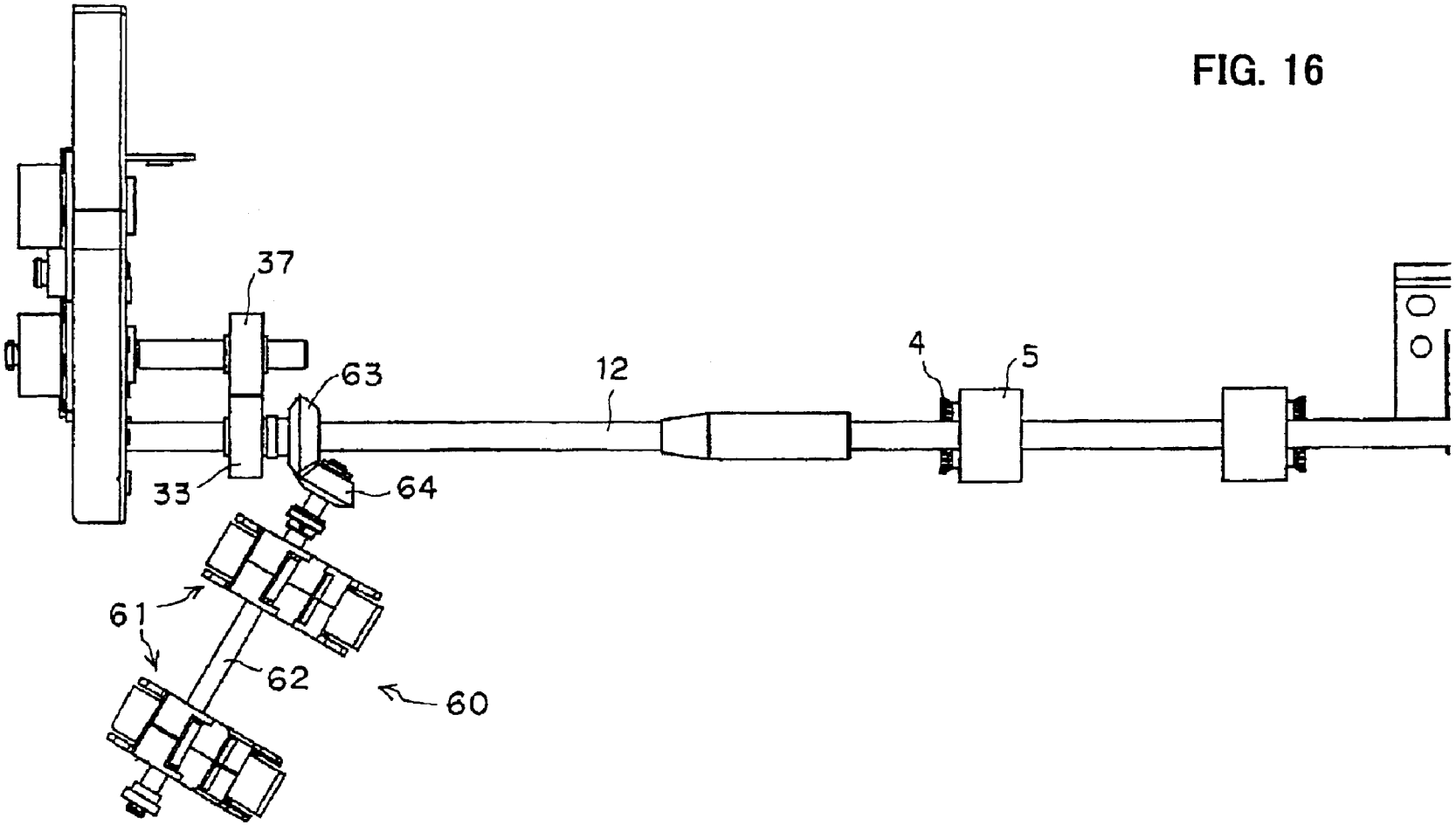
FIG. 16 is a plan view showing a drive power transmission system for rotating a support shaft of belt units added to the sheet finishing apparatus according to the present invention as alignment means.
Figure 17:
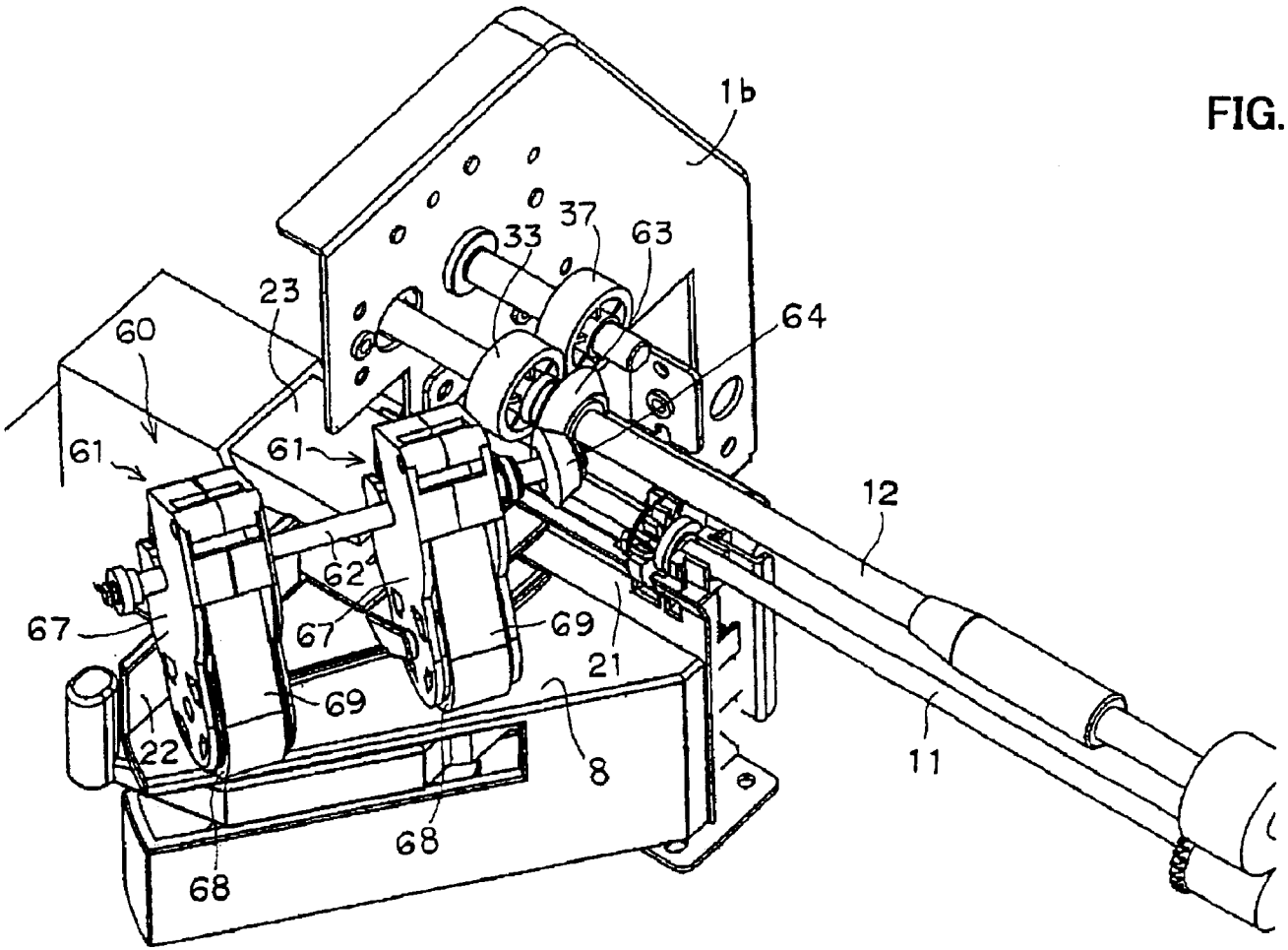
FIG. 17 is a perspective view showing the belt units portion added to the sheet finishing apparatus according to the present invention as the alignment means.

As shown in FIG. 16 and FIG. 17, the alignment means 60 is composed of the belt unit 61 that sweeps sheets to pull them to the finishing position. According to this embodiment, two units are mounted in serial to the supporting shaft 62 thereto is applied the rotational drive force from the aforementioned supporting shaft 12 on the upper side. These two belt units 61 and 61 operate together by the forward rotation of the supporting shaft 62 and rotate touching the discharged sheet while urgingly moving sheets to one side toward the preparatory (pre) alignment position (nipping position) or the width direction alignment reference position (positioning plate 22) by the paired tray discharge rollers 4 and 5 along the shaft line direction of the supporting shaft 11 and supporting shaft 12. This sheet is also moved in the direction of the positioning plate 22 by moving along the supporting shaft 11 and supporting shaft 12 to accurately align the sheet at a finishing position determined by both the abutting plate 21 (the discharge direction alignment reference position) and the positioning plate 22 (the width direction alignment reference position).

Here, in this specification, the "preparatory (pre) alignment position is the nipping position of the belt unit 61 and more accurately, it is the furthermost inner position of the nipping position where sheets can be touched and nipped by the belt unit 61.

As has already been described with FIG. 12, the upper supporting shaft 12 is the drive shaft rotated by the transport motor 34 via the linking gear 33 mated thereto and the drive transmission mechanism (35*a* to 35*d* and 37). Furthermore, the movement to the shaft direction of the supporting shaft 12 of the linking gear 33 mated to the supporting shaft 12 is regulated by the leg portion 32*a* on the second slide regulating member 32 and the downward wall 31*b* on the second supporting member 31 (see FIG. 10).

Figure 18:
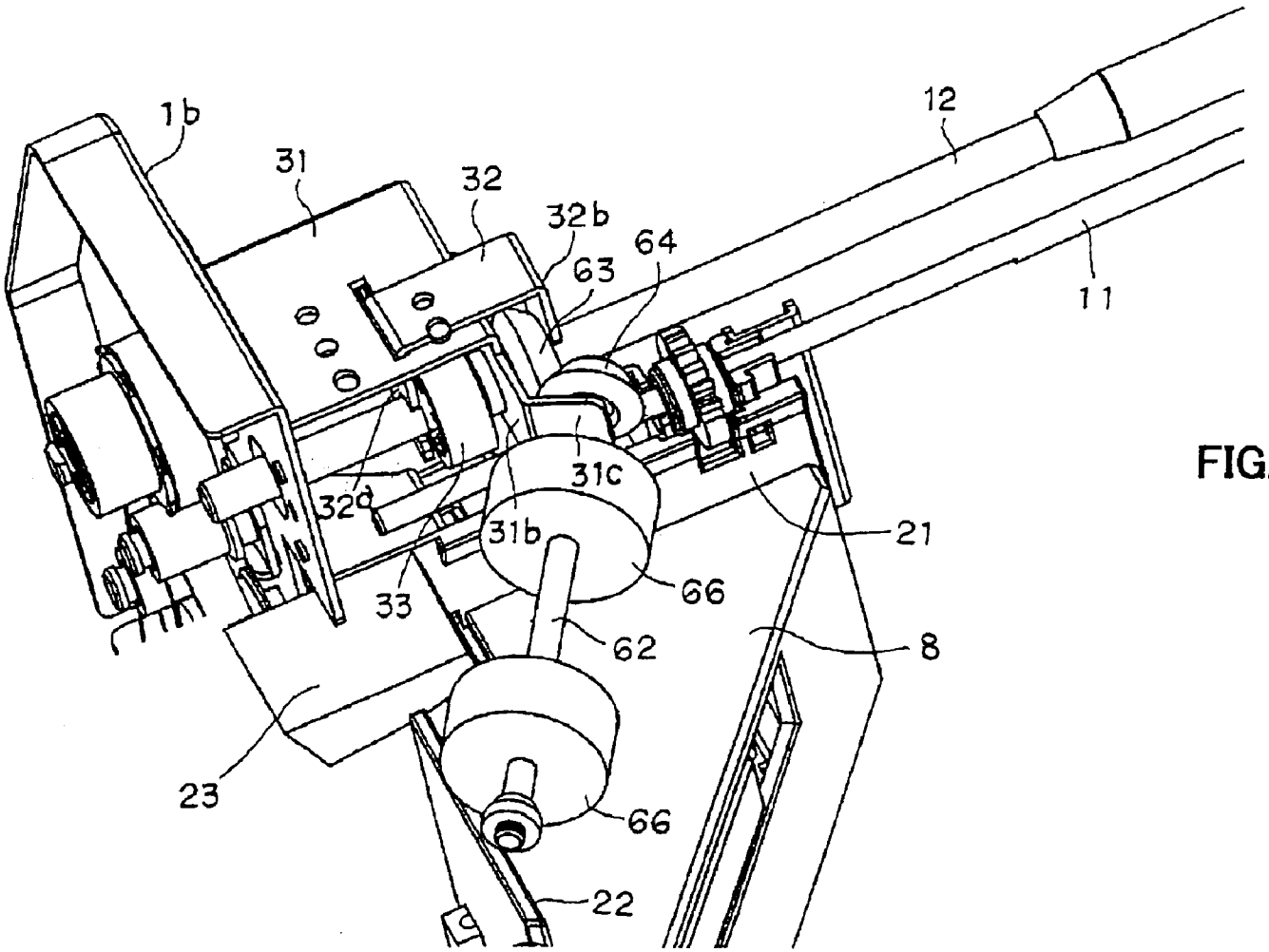
FIG. 18 is a perspective view showing the belt units in FIG. 17 in a state that follower support pulleys and alignment belts are removed and only drive pulleys are shown.
Figure 19:
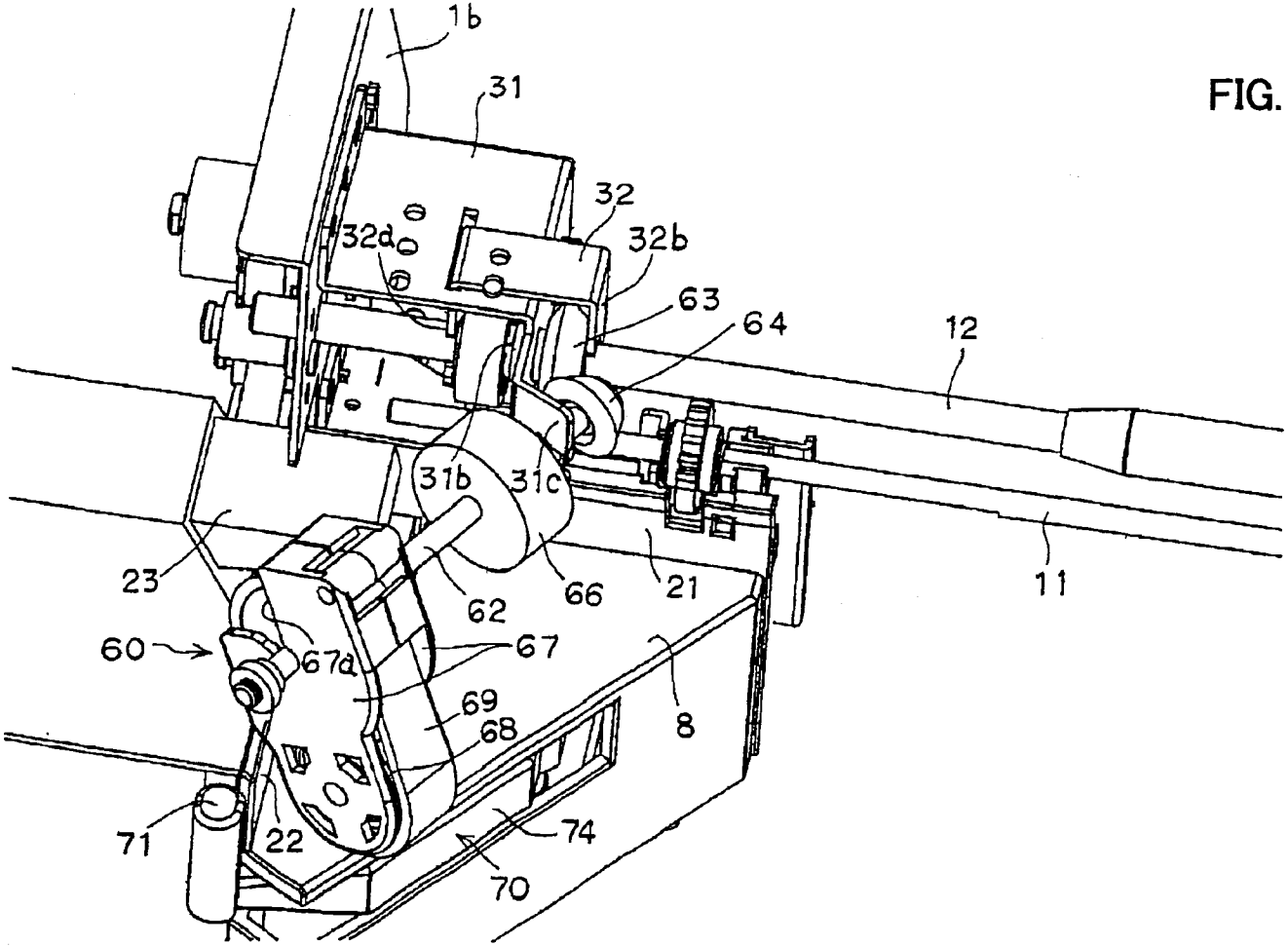
FIG. 19 is a perspective view showing one of a pair of the belt units in FIG. 17 in a state that only drive pulley is shown.

To attain drive force for the belt units 61 from the supporting shaft 12, in other words, to transmit the rotational drive force from the supporting shaft 12 to the supporting shaft 62, as shown in FIG. 16 and in FIG. 17, to the inside in the shaft direction from the linking gear 33 on the supporting shaft 12 is disposed the first beveled gear 63. The first beveled gear 63, as shown in FIG. 18 and in FIG. 19, is positioned between the downward wall 31*b* on the second supporting member 31 and the leg portion 32*b* on the second slide regulating member 32, the downward wall 31*b* on the second supporting member 31 and the leg portion 32*b* on the second slide regulating member 32 regulating its shift in the supporting shaft 12 shaft direction.

To that regard, the supporting shaft 12 penetrates a plurality of members and is retractably mounted in the shaft direction. In other words, the supporting shaft 12 is retractably disposed in the shaft direction, penetrating the linking gear 33 shaft hole, the shaft holes for the leg portions 32*a* and 32*b* in the second slide regulating member 32 and the shaft hole in the vertical downward wall 31*b* on the second supporting member 31 and the opening portion 39 established in the side frame 1*b*. Furthermore, the supporting shaft 12 can slide in the shaft direction with the linking gear 33 the movement thereof in the shaft direction regulated by the second slide regulating member 32 leg portion 32*a* and the second supporting member 31 vertical downward wall 31*b* therebetween, by the slide drive portion 45, and can slide in the shaft direction with the first beveled gear 63 the movement thereof in the shaft direction regulated by the second supporting member 31 vertical downward wall 31*b* and the second slide regulating member 32 leg portion 32*b*.

Note that from both sides of the linking gear 33 and the first beveled gear 63 the supporting shaft 12 is formed in a D shape for at least for the distance for the support shaft to advance and retract, the interlock gear 33, the discharge paddle 20 and the first beveled gear 63 also formed into a D shape.

On the other hand, to rotatingly support one end of the supporting shaft 62 on the belt units 61, as shown in FIG. 12, the L shaped mounting plate 65 is mounted to the side frame 1*b*, and thereto one end of the supporting shaft 62 is rotatingly supported while the support arm portion 31*c* is established extending from the vertical downward wall 31*b* on the second supporting member 31 to above the fixed stacking portion 8 (the first tray), thereto the other end of the supporting shaft 62 is rotatingly supported.

To the end of the support arm portion 31*c* on the supporting shaft 62, the second beveled gear 64 is mounted. The shift to the shaft direction of the second beveled gear 64 is regulated at a determined position in the shaft direction of the supporting shaft 12 and mates with the first beveled gear 63 that is established. This structure receives the drive from the transport motor 34 to rotate the supporting shaft 62.

One of the two belt units 61 and 61 that compose the alignment means is disposed in a position near the discharge outlet of the supporting shaft 62, the other is disposed at the supporting shaft 62, in a position far from the discharge outlet 7. Both of the belt units 61 and 61 have the same configuration, so an explanation of one will be duly representative.

The belt units 61 are composed of the drive pulley 66 (FIG. 18) mounted to the supporting shaft 62 and rotates along with the supporting shaft 62, the support plate 67 (FIG. 17) the arranged on both side, the trailing end mounted to the supporting shaft 62, the follower supporting pulley 68 (FIG. 19) positioned at the fixed stacking portion 8 side with a determined gap with the drive pulley 66 by being rotatingly supported on the leading end of the support plate 67 and the alignment belt 69 (FIG. 19) trained between the drive pulley 66 and the follower support pulley 68.

The support plate 67, as shown in FIG. 19, comprises the notch 67*a* for mating the trailing end thereof to the supporting shaft 62, the back portion of the notch portion 67*a* detachably mounted to the supporting shaft 62 with a constant gripping force. Therefore, the support plate 67 revolves as a unit with the supporting shaft 62 with the constant frictional force, and is configured to slidingly rotate around the supporting shaft 62 when an external force enough to overcome that constant frictional force is applied.

The supporting shaft 12 receives the drive of the transport motor 34 (FIG. 12) and when the tray discharge roller 5 rotates in the direction to discharge the sheet S, the supporting shaft 62 is rotatingly driven from the supporting shaft 12, to rotate the alignment belt 69 on the belt units 61 to sweep the sheet. The direction of rotation is where the alignment belt 69 intersects the positioning plate 22 and the abutting plate 21, in other words, the rotation in the direction to transport the sheet toward the stapler 23, which is the finishing position. To express this differently, the belt units 61 are arranged in the direction to transport the sheet S toward the stapler 23, which is the finishing position. The support arm portion 31*c* and the support plate 67 position the supporting shaft 62 so that the belt units 61 and 61 urge sheets discharged by the paired tray discharge rollers 4 and 5 to the abutting plate 21 and the positioning plate 22 on the fixed stacking portion 8, for alignment.

The length from the supporting shaft 62 on the belt unit 61 is determined so that it is longer than the distance from the supporting shaft 62 to the top surface of the fixed stacking portion 8 (the first tray). Therefore, when the belt units 61 are revolving operated unitized with the supporting shaft 62 by frictional force, the leading end of the belt units 61 touch the upper surface of the fixed stacking portion 8 (the first tray) from above at an angle and are unable to revolve in any other way. The support plate 67 on the belt units 61 overcome the frictional force and slip with regard to supporting shaft 62 thereby maintaining the idling position shown in FIG. 19.

In the belt units 61 at the idling position, the position where the alignment belt 69 touches the sheet is the preparatory (pre) alignment position (nipping position), described above. As described with FIG. 13 and FIG. 14, when in the operating mode comprising preparatory (pre) alignment, the sheet is preparatory (pre) aligned to the preparatory (pre) alignment position the distance of D1 or d1 (the distance of D4 or d4), and moved to the finishing position the distance of D2 or d2 (D5 or d5) by the belt units 61 to touch the sheet to the abutting plate 21 and the position plate 22 to be aligned. Or, the sheet is moved directly to the finishing position the distance of D3 or d3 (D6 or d6) passing through the preparatory (pre) alignment position, to touch the abutting plate 21 and the position plate 22 to be aligned.

However, the alignment means (pulling means) 60 operates constantly hanging downward at an angle toward the sheet from the supporting shaft 62 while the supporting shaft 12 is rotating in forward so it acts as a load that applies a resistance force to the discharging sheets. For that reason, the effect of reverse transport (pulling in) by the alignment belts 69 push the sheet back, causing the sheet to be arranged obliquely, if the edges of the sheet are not completely discharged toward the fixed stacking portion 8. To eliminate this problem, to the support shaft 11 is established the discharge paddle 20. In other words, the discharge paddle 20 is disposed at a position corresponding to the fixed stacking portion 8 above the supporting shaft 11 and between the first slide regulating member 19 and the second bearing member 18 mounted to the support member 16, the discharge paddle 20 touches the sheet portion corresponding to fixed stacking portion 8 while rotating to apply an additional discharging force to the aforementioned sheet portion (to forcibly push it out).

F. Control Means

The following shall describe the control means.

Figure 20:
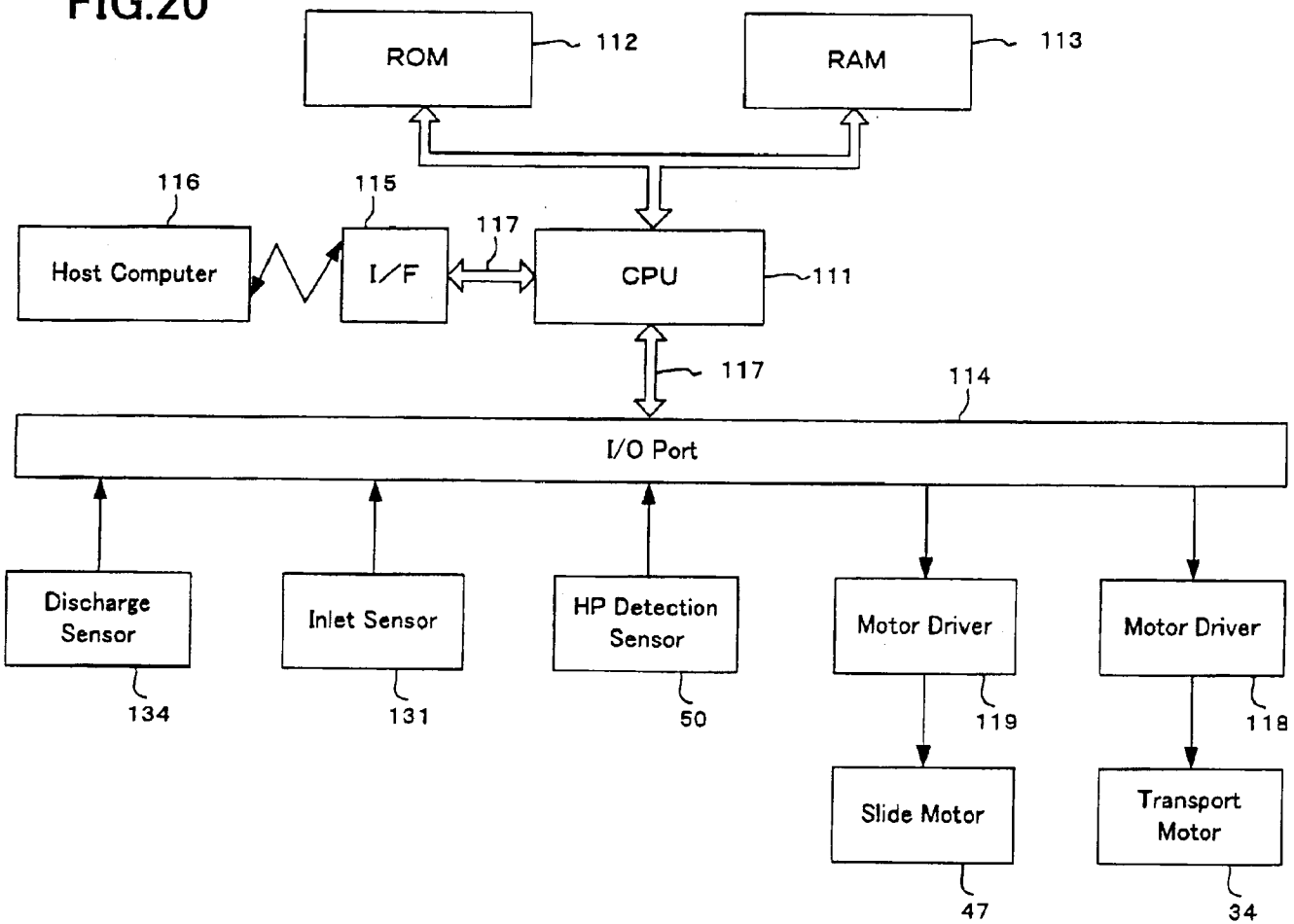
FIG. 20 is a drawing showing a configuration of a control apparatus of the sheet finishing apparatus according to the present invention.

(a) Control Apparatus (FIG. 20)

FIG. 20 is a block diagram showing the circuit configuration of the sheet finishing apparatus according to this embodiment. 111 is the micro-computer CPU (central processing unit) composing this control unit, 112 is the ROM (read only memory) storing the program data that the CPU 111 uses to control each part, 113 is the RAM (random access memory) disposed with memory for the CPU 111 to use to process data, 114 I/O port, and 115 is the interface (I/F) for the host computer 116 on the image forming apparatus main unit 100 to connect externally using a communications line.

The aforementioned CPU 111, ROM 112, RAM 113, I/O port 114 and interface 115 are electrically connected via a bus line 117.

To the aforementioned I/O port 114 are connected the HP detection sensor 50 that detects the home position of the supporting shafts 11 and 12 on the paired tray discharge rollers 4 and 5, the inlet sensor 131 (FIG. 2) established at the paper path 2 inlet that is the transport path and the discharge sensor 134 established on the discharge outlet 7 on the paper path 2. The discharge sensor 134 is a supplementary disposed sensor and can be omitted.

The inlet sensor 131 and the discharge sensor 134 are composed of the light source arranged sandwiching the sheet transport path and the transmissive type light sensor composed from the light receptor elements, turning ON when the sheet passes therethrough and interrupts the light. In other words, the sheet S passes through the paper path 2 between the upper guide 2*a* and the lower guide 2*b* in the processing apparatus 1 and is discharged, the detection sensors composed of the light source arranged to sandwich the paper path 2 and the light receptor elements determine whether or not the sheet S has passed therethrough, for each sheet, to perform detection for passing sheets and for retained sheets. Also, it is detected whether or not the sheet S has been discharged or not by the detection sensor composed of the light source arranged sandwiching the sheet discharge outlet 7 downstream of the paired tray discharge rollers 4 and 5 and the light receptor elements.

Still further, to the I/O port 114, are connected the motor driver 118 on the transport motor 34 that rotatingly drives the supporting shafts 11 and 12 on the paired tray discharge rollers 4 and 5 according to the data from the host computer 116, and the motor driver 119 on the slide motor 47 that moves the supporting shafts 11 and 12 on the paired tray discharge rollers 4 and 5 in the shaft direction according to the data from the host computer 116.

The aforementioned transport motor 34 and slide motor 47 are configured, for example, by stepping motors. The CPU 111 controls drive by supplying the determined pulse motor control signals to the motors 34 and 47.

The output from the inlet sensor 131, the discharge sensor 134 and the HP detection sensor 50 are applied to the finisher apparatus micro-computer CPU 111. Also, information from operating means composed of the start key, the sorting sheet count setting keys, the total recording count setting keys and the tenkeys from the image forming apparatus main unit 100 are input to the finisher apparatus micro-computer CPU 111.

Figure 21:
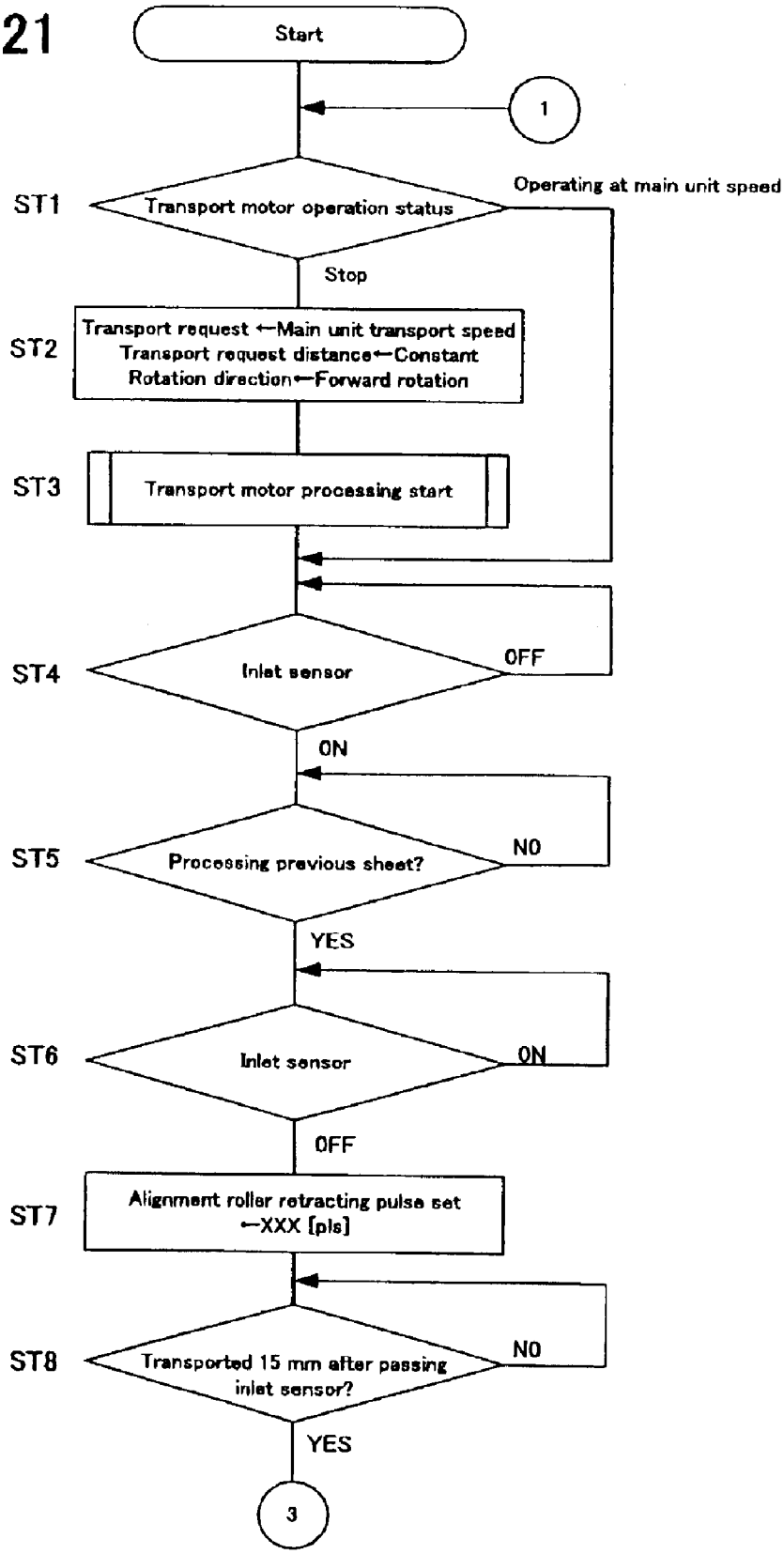
FIG. 21 is a drawing showing a part of a control flow for performing preparatory (pre) alignment, alignment and a sheet finishing process in the sheet finishing apparatus according to the present invention.
Figure 22:
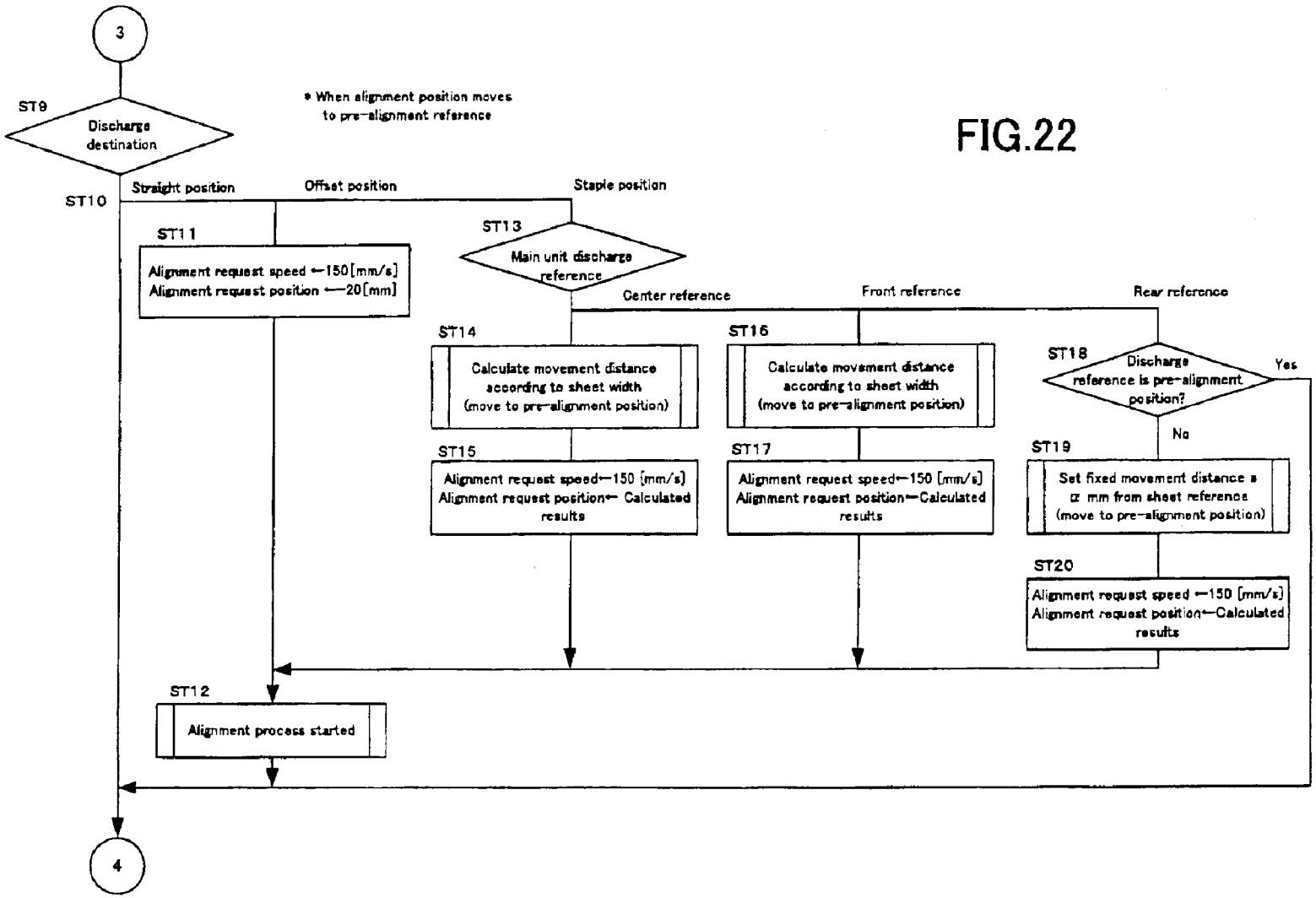
FIG. 22 is a drawing showing a part of the control flow continued from FIG. 21 for performing the preparatory (pre) alignment, alignment and the sheet finishing process in the sheet finishing apparatus according to the present invention.
Figure 23:
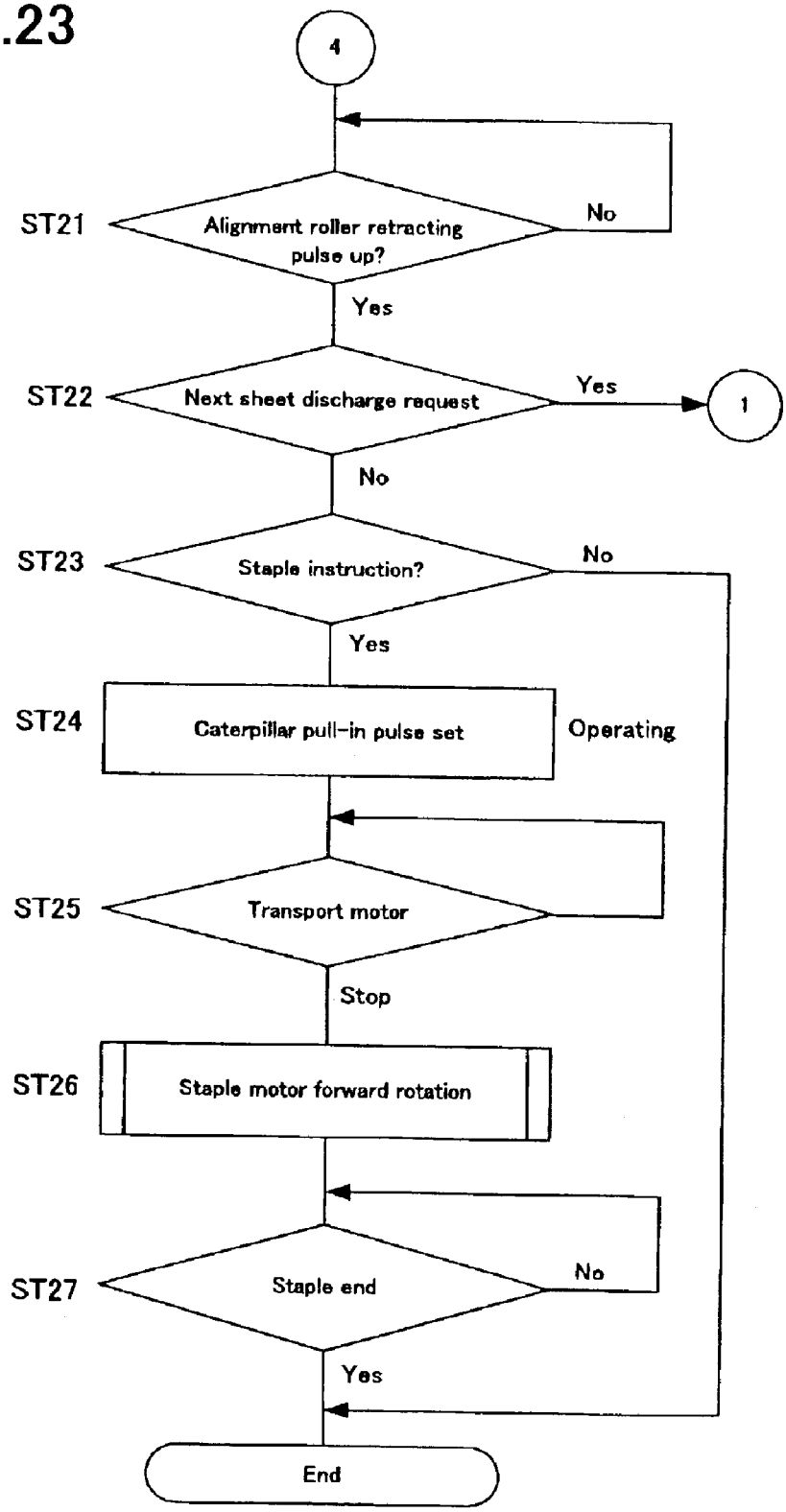
FIG. 23 is a drawing showing a part of the control flow continued from FIG. 22 for performing the preparatory (pre) alignment, alignment and the sheet finishing process in the sheet finishing apparatus according to the present invention.

(b) Control Apparatus (FIG. 21 to FIG. 23)

The aforementioned CPU 111 controls the pulley alignment and the sheet finishing apparatus shown in FIG. 21 to FIG. 23 based on a program.

In other words, at step ST1 in FIG. 21, it checks if the transport motor 34 is running, and starts it up in the forward rotating direction if stopped (step ST2 and ST3). It waits until a sheet arrives at the inlet sensor 131 (step ST4).

Next, because a prior sheet (a previous sheet) may exist in the paper path 2, it determines a sheets presence (if a previous sheet is being processed) (step ST5). It is possible to determine by monitoring the output of the aforementioned discharge sensor 134, but here the format that counts the transport time for sheets or the number of pulses for sheets after passing the inlet sensor 131 is employed.

Continuing on, it waits until the trailing edge of a sheet exits the inlet sensor 131 (step ST6). This is to prevent accidents by shifting the support shaft 11 and the support shaft 12 in the shaft direction and sliding the sheet regardless of whether or not the trailing edge of the sheet is nipped by the paired transport rollers 3.

If the trailing edge of the sheet has exited the inlet sensor 131, it sets "alignment roller retracting pulses" which are the number of pulse required for the sheet to exit the paired tray discharge rollers 4 and 5 (step ST7). It waits until 15 mm are transported after passing through the inlet sensor 131 (step ST8). This absorbs chattering caused by the bounding of sheets.

Next, in FIG. 22, based on the data and the instructions from the image forming apparatus main unit 100, it checks the discharge destination and determines that it is one of the following: The discharge destination is either in a "straight position," an "offset positioned (jog position)," or a "staple position."

If the discharge destination is a "straight position," nothing happens and the flow shown in FIG. 22 is exited (step ST10).

If the discharge destination is the "offset position (jog position)", it determines the position offset 20 mm to the right (−20 mm) with the required alignment speed of 150 mm/s and from the HP as the required alignment printing position to ensure the determined offset movement amount or the jog movement amount (step ST63) and begins the alignment process by moving to that position (step ST64).

If the discharge destination is the "staple position," it checks whether the sheet is being discharged to either the "center reference," the "front reference (side reference discharge)," or the "rear reference (side reference discharge)" from the image forming apparatus main unit 100, based on the data and instructions received from the image forming apparatus main unit 100 (step ST13). The distance of the shift (required alignment position) from each discharge reference to the preparatory (pre) alignment position is calculated, that shift distance and the required alignment speed (step ST14 to ST20) are determined and the alignment process to move to that position is started (step ST12).

In other words, for the "center reference," the distance of movement to the preparatory (pre) alignment position is calculated according to the width of the sheets (for example, D1 and D4 shown in FIG. 13), the results are set as the required alignment position, and it determines 150/s as the required alignment speed (step ST15) and begins the alignment process to move to that position (step ST12).

Also, for the "front reference (side reference discharge)," if discharging with the right edge of the tray as the reference, namely that shown in FIG. 47, the distance of shift to the preparatory (pre) alignment position is calculated (step S16) according to the width of the sheets (for example, d7 and d9 shown in FIG. 47), the results are set as the required alignment position, and it determines 150/s as the required alignment speed (step ST17) and begins the alignment process to shift to that position (step ST12).

Next, for the "rear reference (side reference discharge) (step ST18), if discharging with the left side of the tray, namely that shown in FIG. 47, the fixed distance of shift (distance $\alpha$) of the supporting shafts 11 and 12 on this finisher apparatus for the sheet is already known, so the constant distance of shift $\alpha$ mm from the discharge reference (for example d1 and d4 shown in FIG. 14) is set as the required alignment position (step ST19), and it determines 50 mm/s as the required alignment position and required alignment speed (step ST20) and begins the alignment process to shift to that position (step ST12). However, if the discharge position itself matches that of the preparatory (pre) alignment position, preparatory (pre) alignment is not required, so it shifts to alignment processing as it is (step ST12).

In the alignment process, sheets are actually shifted only the aforementioned calculated distance, and the alignment process starts by sending them to the preparatory (pre) processing position (step ST12). Through this, sheets are transported and discharged by the rotation of the paired tray discharge rollers 4 and 5, and shift thereof in the shaft direction is executed by the aforementioned alignment process, which pushes sheets to the nipping position of the belt units 61 which are the preparatory (pre) alignment position.

Also, in FIG. 23, "alignment roller retracting pulse" set at the aforementioned step ST11 is calculated up, and if it is verified that the paired tray discharge rollers 4 and 5 have exited (step ST21), it checks if there is a discharge request for the next sheet, namely is there a sheet that must be discharged (step ST22). If there is a discharge request for a next sheet, it returns to step ST1, stacks the sheets that are discharged next and aligns them.

The determined number of sheets are stacked and at step ST22, if it is determined that there is no request for the discharge of a next sheet, it verifies if there is a staple instruction (step ST23). If there is no staple instruction, processing ends (step ST23).

If there is a staple instruction when determining at step ST23, it performs this alignment (pulling to the finishing position) using the caterpillar (belt units 61 and 61) as the alignment means (pulling means) 60 by setting the pulling pulse count, in other words, the necessary pulse count to pull the sheets from the preparatory (pre) alignment position (the nipping position) to the finishing position (step ST24).

Then, it waits for the transport motor 34 and the slide motor 47 to stop (step ST25) and forward rotates the staple motor (not shown in the drawings) to execute the finishing process (step ST26). At the finishing process, the stapler 23, which is the finishing means, operates to staple the sheet bundle. Then, the staple operation ends (step ST27).

When the stapling operation ends, the series of operations from discharge to preparatory (pre) alignment, to alignment and finishing (stapling) is completed.

Figure 24:
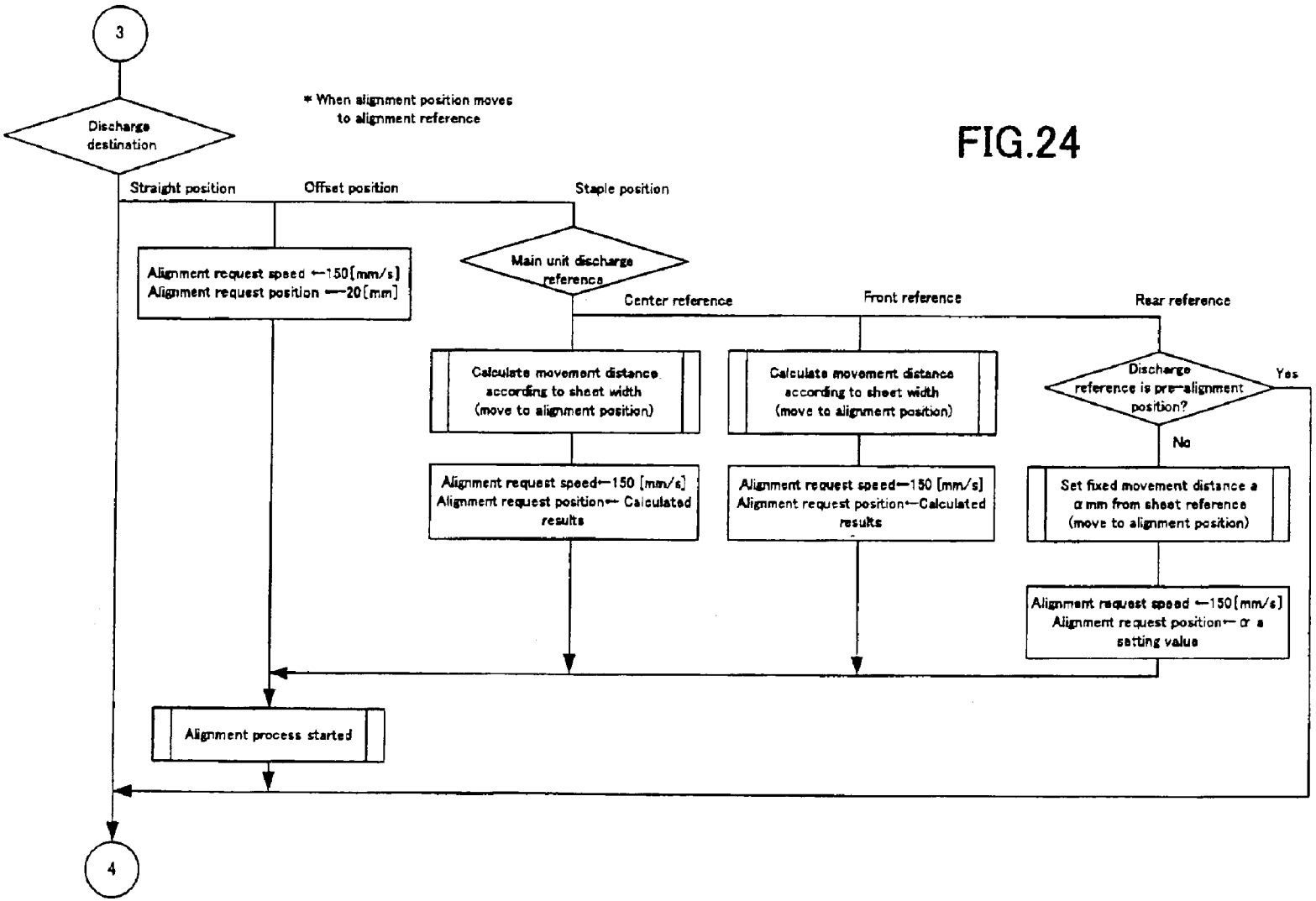
FIG. 24 is a drawing corresponding to FIG. 22 showing a portion of a control flow for performing the alignment and the sheet finishing process (without the preparatory (pre) alignment) as another example of the control in the sheet finishing apparatus according to the present invention.
Figure 25:
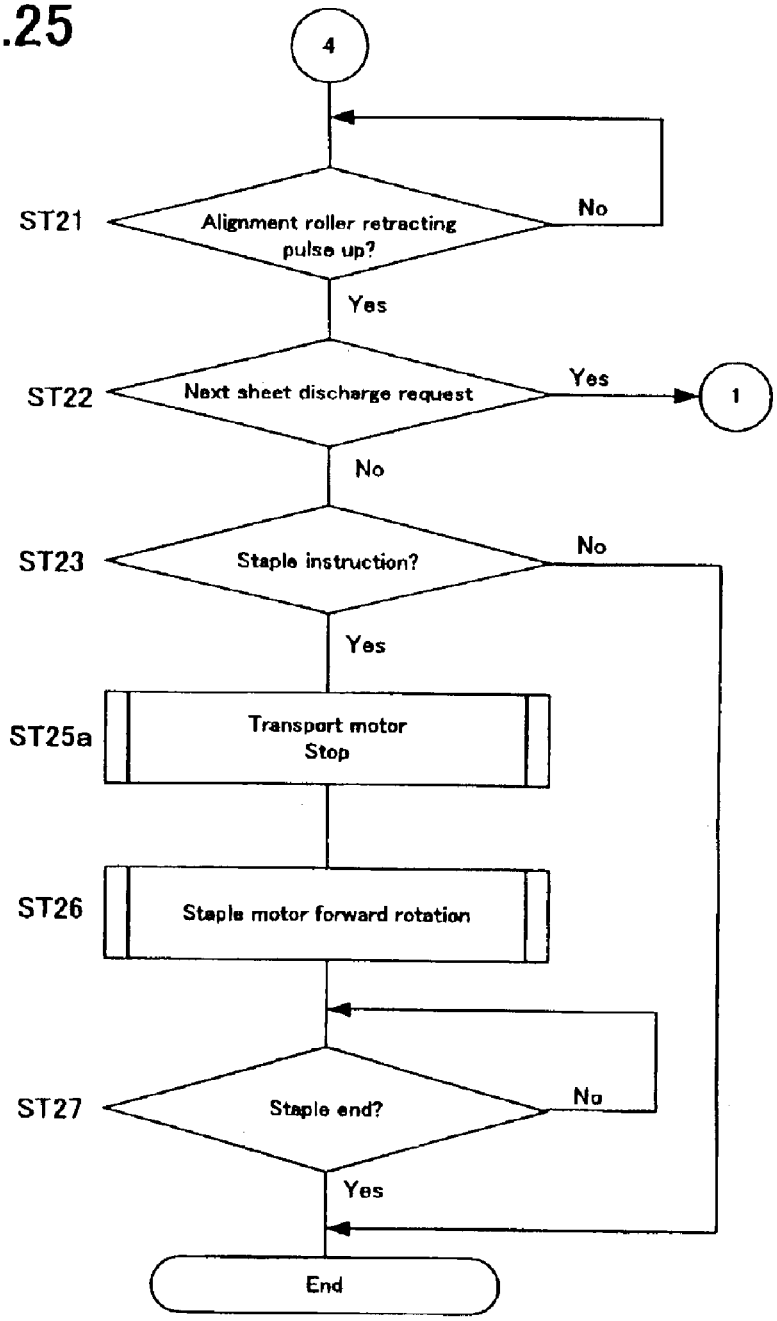
FIG. 25 is a drawing showing a part of the control flow continued from FIG. 24 for operating the alignment and the sheet finishing process (without the preparatory (pre) alignment) as the example of the control in the sheet finishing apparatus according to the present invention.

(c) Modified Example of Control (FIG. 24 to FIG. 25)

In FIG. 24 to FIG. 25, the example of control that does not have this alignment means 60 is shown. In other words, sheets are moved to the finishing means all at once without the pulley alignment to the preparatory (pulley) alignment position, more accurately, these FIGs. show the control to shift sheets to the width direction alignment reference position (positioning plate 22).

The following points for FIG. 24 differ from the aforementioned FIG. 22. Specifically, in the aforementioned FIG. 22, at step ST14 and step ST16, the distance of shift (D1 and D4 in FIG. 13 and d1 and d4 in FIG. 14) to the preparatory (pulley) alignment position is calculated and the required alignment position is set according to the operation results. However, at step ST14*a* and step ST16*a* in FIG. 24, the distance of shift (D6 in FIG. 13 and d6 in FIG. 14) to the width direction alignment reference position is calculated and the required alignment position is set according to the operation results.

The following points for FIG. 25 differ from the aforementioned FIG. 23. Specifically, in the aforementioned FIG. 23, at step ST24 and step ST25, it sets the caterpillar pulling pulse and waits for the transport motor to stop. However, at step ST25*a* in FIG. 25, because this alignment means (pulling means) 60 does not exist, the transport motor is stopped.

G. Sheet Bundle Discharge Means 70 (FIG. 29 to FIG. 31)

As described above, the sheets pass through the preparatory (pre) alignment (preparatory) pre) alignment movement means 40) and this alignment (belt units 61) and are aligned sequentially at the finishing position and are stacked. When that is a sheet bundle having a determined number of sheets, the stapling operation is performed on a single corner by the stapler 23 which is the finishing means. The sheet bundle 90, as shown in FIG. 28, is stacked from the fixed stacking portion 8 (the first tray) to the storage tray 9 (the second tray) therebelow. Because there is a space for stacking and storing sheets between the fixed stacking portion 8 (the first tray) and the storage tray 9 (the second tray) therebelow, in other words, because there is a level, the sheet bundle 90 has the bending portion 90*a* configured by the level bent along that level.

Figure 30:
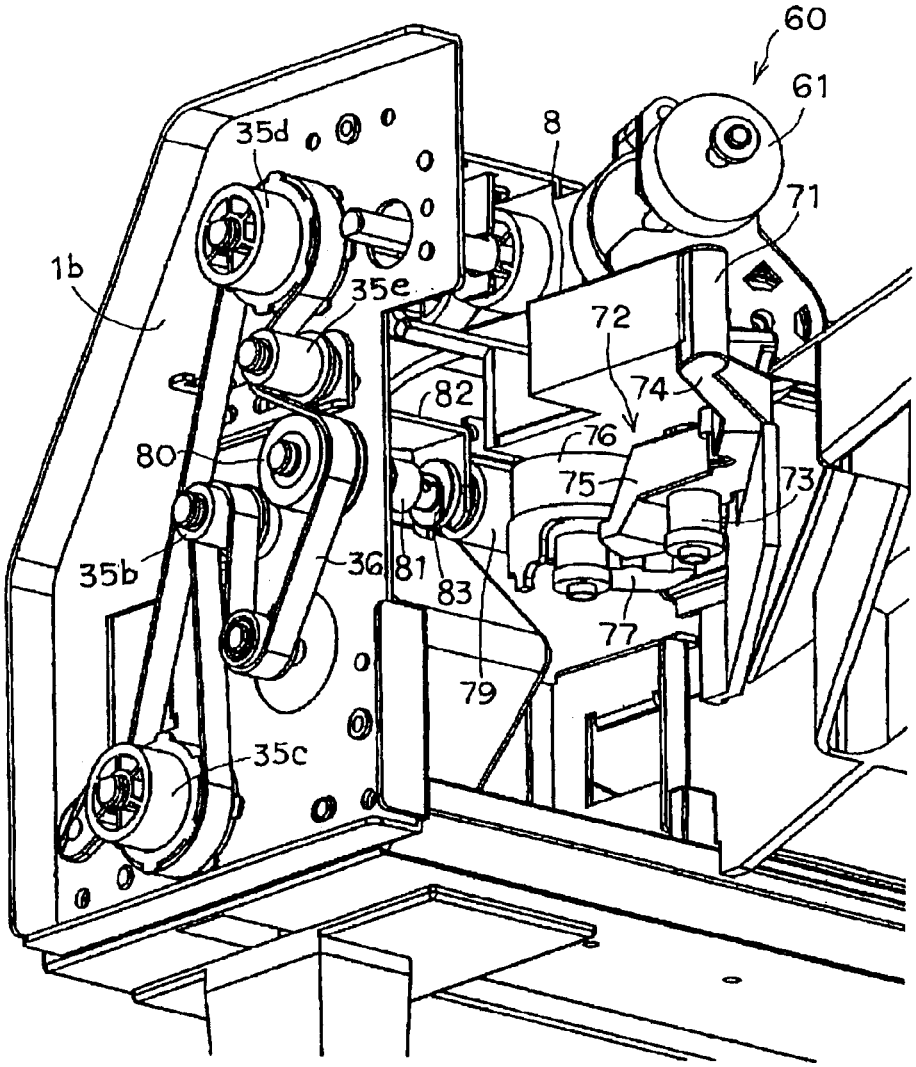
FIG. 30 is a perspective view seen from below showing a structure of the sheet bundle discharge means (sheet moving means) in the sheet finishing apparatus according to the present invention.
Figure 31:
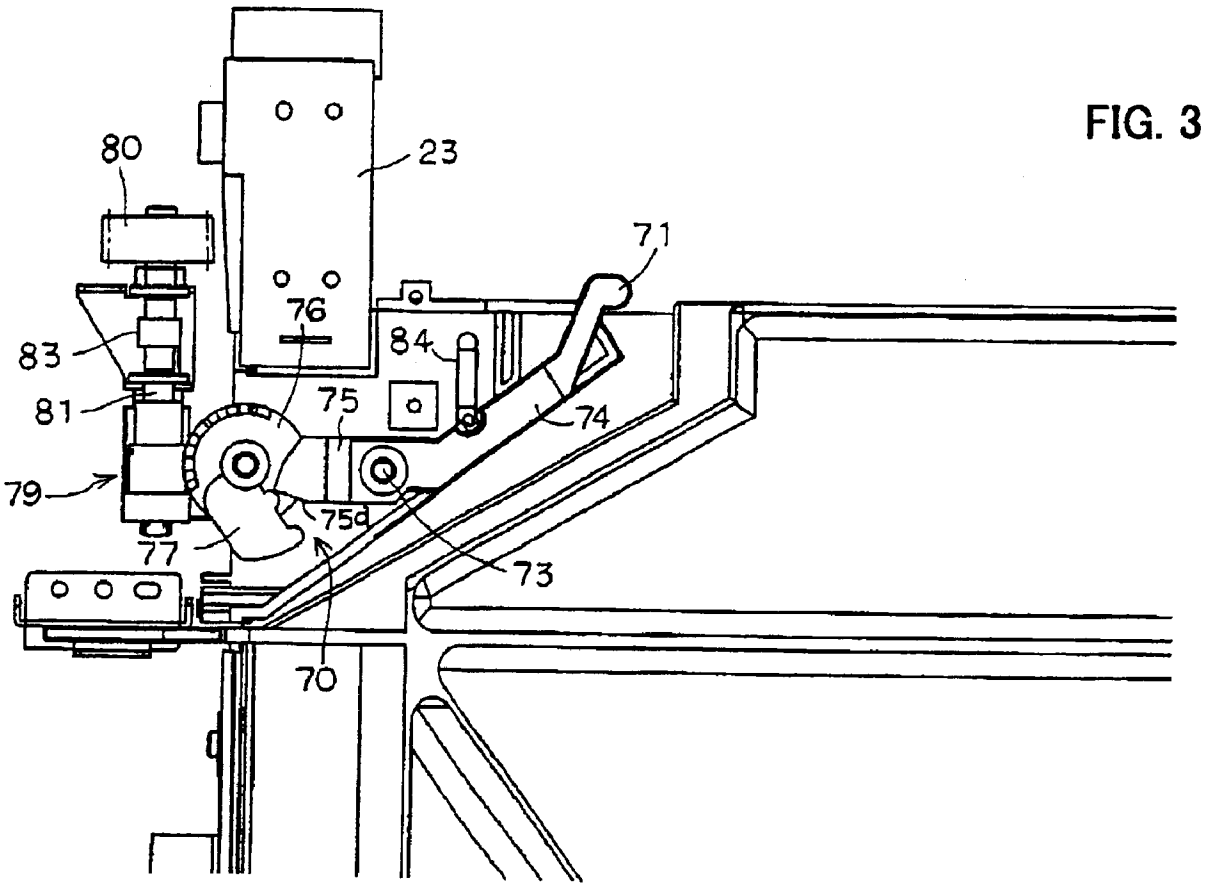
FIG. 31 is a rear view seen from below showing the structure of the sheet bundle discharge means (sheet moving means) in the sheet finishing apparatus according to the present invention.

The sheet bundle discharge means 70 shown in FIG. 29 to FIG. 31 pushes the sheet bundle 90 in this state in the direction traversing the sheet transport direction, from the side and is the means for discharging it to a region outside of the fixed stacking portion 8 (the first tray). The sheet bundle discharge means 70, in this embodiment, is composed of the pushing member 71 that abuts the curved portion 90*a* of the sheet bundle 90 in a direction traversing the direction of transport to move the sheet bundle from the fixed stacking portion 8 (the first tray) to the storage tray 9 (the second tray) therebelow, and the revolution drive mechanism 72 (drive means) that revolves that member. In this way the sheet bundle discharge means 70 acts on the firm sheet bundle 90 bend portion 90*a* to enable the drive to be securely transmitted to the sheet bundle 90 and preventing the sheet bundle from experiencing a mis-discharge.

Arranged to configure the revolution drive mechanism 72 is the rotating lever 74 that rotates around the rotating center 73 in the gap between the fixed stacking portion 8 (the first tray) and the storage tray 9 (the second tray) therebelow, as shown in FIG. 29. To the leading edge of the rotating lever 74 is disposed the aforementioned pushing member 71, extending up and down forming a pushing bar. This rotating lever 74 is equipped with the contact arm 75 formed with the contact portion 75*a* on the leading end thereof (FIG. 31), extending obliquely downward in the opposite side from the rotating center shaft 73.

To rotatingly drive the aforementioned rotating lever 74, to the circumference of the shaft 78 is rotatingly mounted near the contact portion 75*a*, the worm-wheel 76 having a cam equipped with the cam 77 to act on the contact portion 75*a*. When the cammed worm-wheel 76 reciprocally rotates around the shaft 78, which is described below, the cam 77 touches the aforementioned contact portion 75*a* and revolves it a determined amount. Also, the worm gear 79 that mates with the cammed worm wheel 76 is established on the side opposite to the side where the aforementioned rotating lever 74 exists. This worm gear 79 is established on the shaft 81 which is established on the single direction clutched pulley 80, the single direction clutched pulley 80 mounted to form the gear train composing the rotating drive mechanism for the aforementioned support shaft 11 and support shaft 12.

Specifically, as shown in FIG. 30, the shaft 81 on the single direction clutched pulley 80 is rotatingly mounted to the side frame 1*b* and the support plate 82 and the intermediate pulley 35*e* is rotatingly mounted to the side frame 1*b*. Also, the output from the transport motor 34 is transmitted from the motor pulley 35*a* mounted on that output shaft to the intermediate pulley 35*b*, the transport roller pulley 35*c* and the follower pulley 35*d* via the timing belt 36 and the drive transmission mechanism is configured that transmits to the single direction clutched pulley 80 via intermediate pulley 35*e*. To the shaft 81 that is the output side of the single direction clutched pulley 80 the aforementioned worm gear 79 is mated and through the action of the single direction clutch, the single direction clutch shuts off when the transport motor 34 is rotated in forward causing the single direction clutched pulley 80 to idle. The other way, when the transport motor 34 is rotated in reverse, the single direction clutch turns on transmitting rotational drive force to the shaft 81 to rotate the worm gear 79.

Figure 32A:
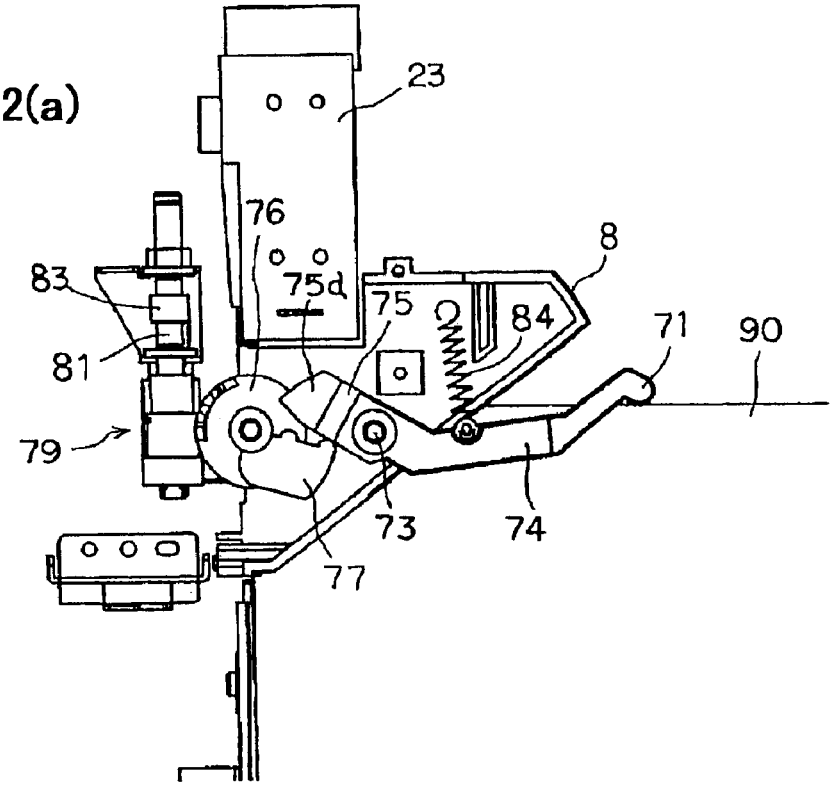
FIGS. 32(*a*), 32(*b*) are rear views showing an operation of the sheet bundle discharge means (sheet moving means) in the sheet finishing apparatus according to the present invention, wherein FIG. 32(*a*) shows a state in the middle of the discharge operation and FIG. 32(*b*) shows a state immediately after the discharge operation is completed.
Figure 32B:
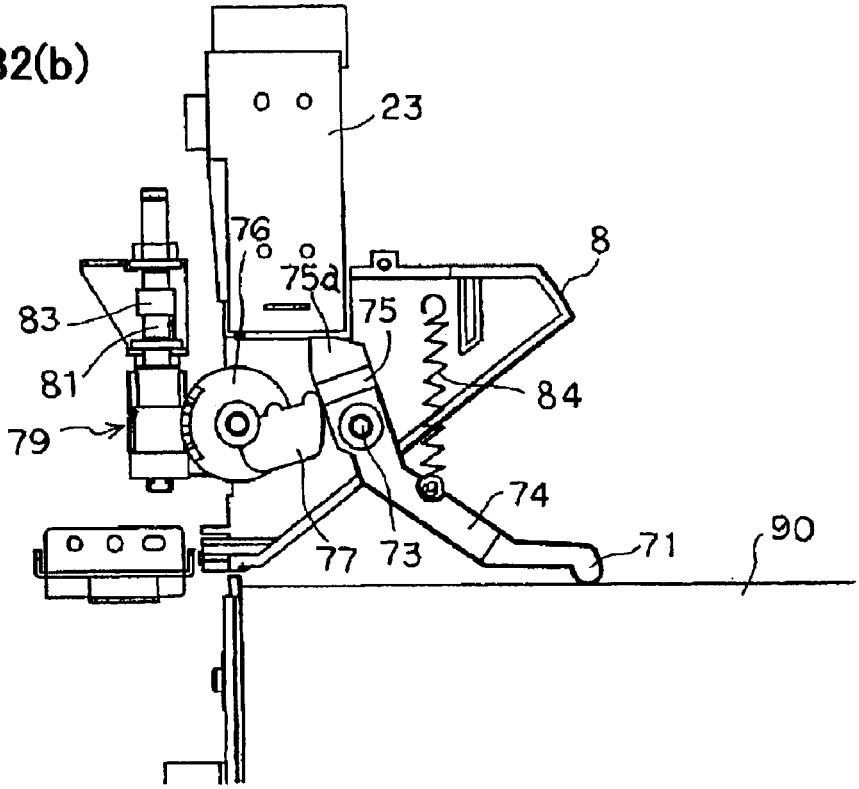

When the worm gear 79 rotates, the cammed worm wheel 76 mated thereto rotates. The cam 77 in the state shown in FIG. 31, unitized thereto the worm wheel, touches and presses the contact portion 75*a* on the contact arm 75 to rotate the rotating lever 74 around the rotating center shaft 73 as depicted in FIGS. 32(*a*) and 32(*b*). This revolves the pushing member 71 around the rotating center shaft 73 as depicted in FIGS. 32(*a*) and 32(*b*) to push the sheet bundle 90 to outside of the region of the fixed stacking portion 8 (the first tray).

Figure 33C:
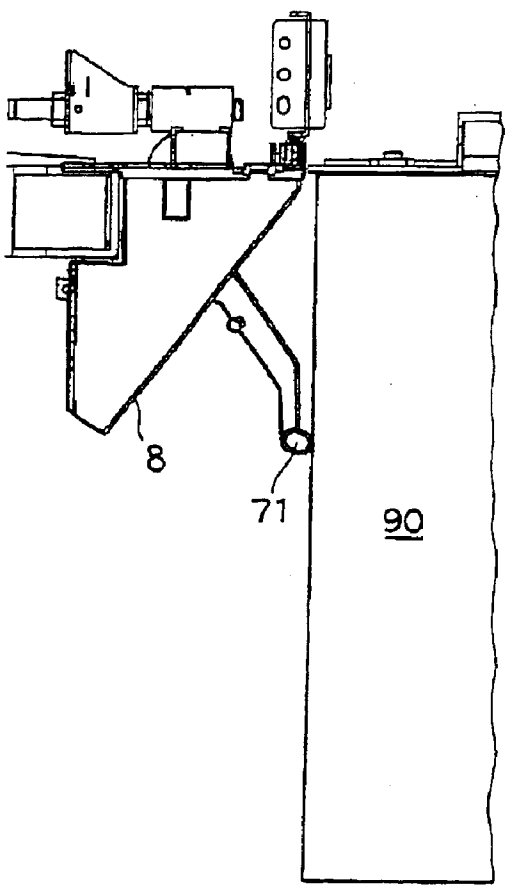
FIGS. 33(*a*)–33(*c*) are plan views showing an operation of the sheet bundle discharge means (sheet moving means) in the sheet finishing apparatus according to the present invention, wherein FIG. 33(*a*) shows a state prior to the discharge operation, FIG. 33(*b*) shows a state in the middle of the discharge operation, and FIG. 33(*c*) shows a state immediately after the discharge operation is completed.
Figure 33B:
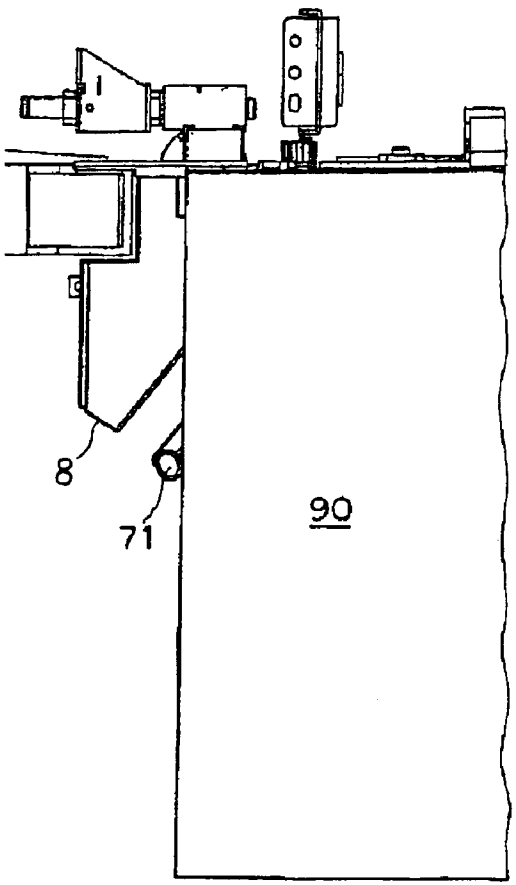
Figure 33A:
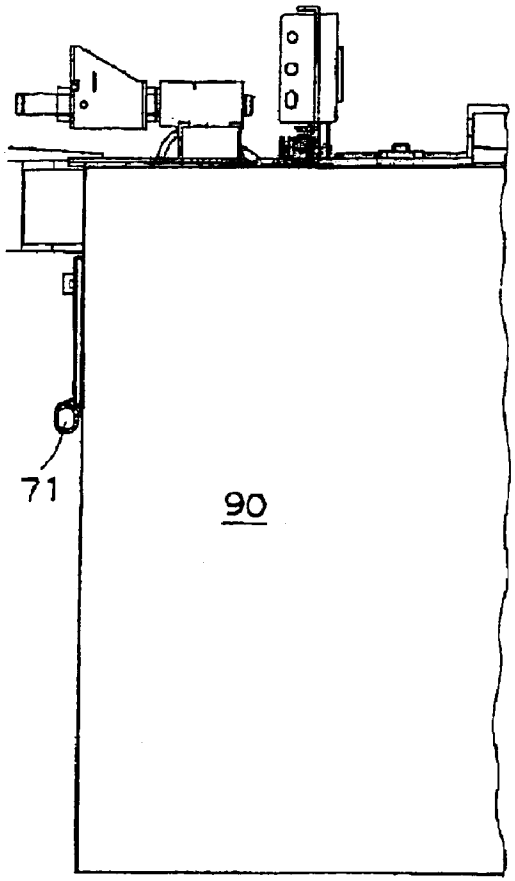

The sheet bundle 90, as shown in FIG. 33(*a*) to FIG. 33(*c*), is discharged from the fixed stacking portion 8 (the first tray) to the top of the storage tray 9 (the second tray).

When the sheet bundle 90 reaches the position shown in FIG. 32(*b*) pushed out of the region of the fixed stacking portion 8 (the first tray), the direction of rotation of the transport motor 34 switches from reverse rotation to forward rotation, the shaft 81 becomes free and the recovery spring 83 mounted to the shaft 81 returns the cammed worm wheel 76 to the state depicted in FIG. 31. The rotating lever 74 also returns to the state depicted in FIG. 31 by the action of the recovery spring 84.

The mechanism (revolving drive mechanism 72) to revolving drive the pushing bar 72 is configured by the aforementioned elements 74 to 84.

H. Finishing and Sheet Bundle Discharge Control (FIG. 34 to FIG. 38)

(a) Control Apparatus (FIG. 20)

The configuration of the control apparatus is the same as that described using FIG. 20.

(b) Control (FIG. 21, FIG. 34 to FIG. 36)

Figure 34:
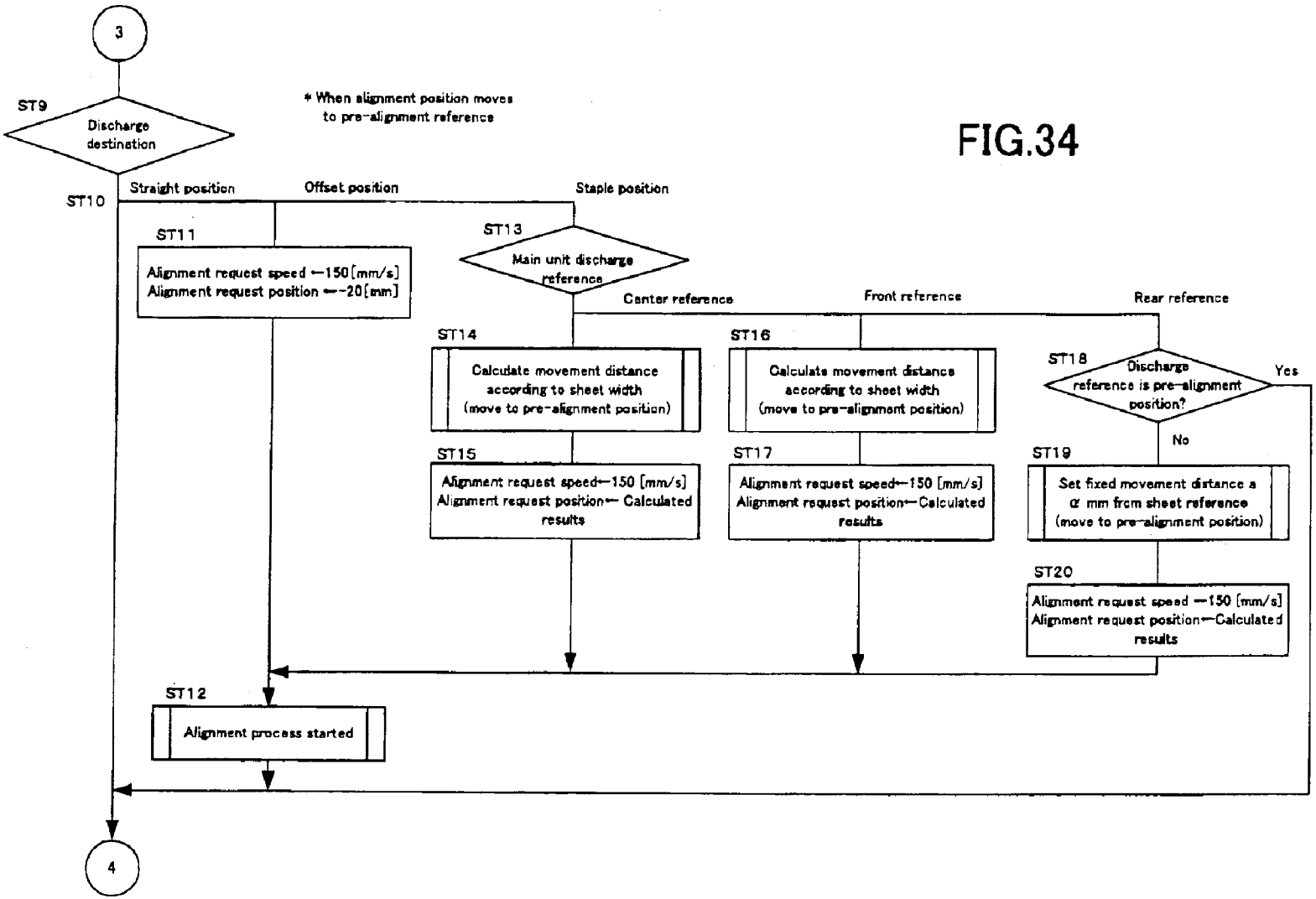
FIG. 34 is a drawing continued from FIG. 21 showing a part of the control flow for operating the preparatory (pre) alignment, alignment, sheet finishing and sheet bundle discharge process in the sheet finishing apparatus according to the present invention.
Figure 35:
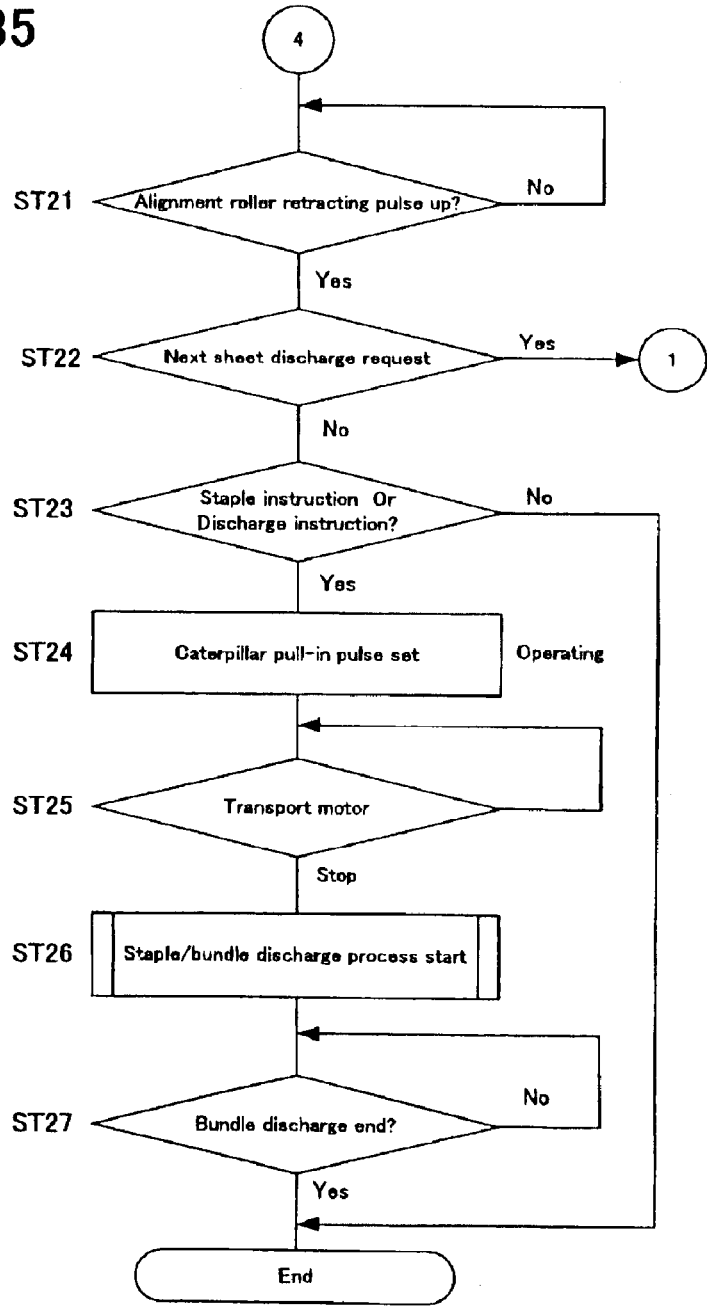
FIG. 35 is a drawing continued from FIG. 34 showing a part of the control flow for operating the preparatory (pre) alignment, alignment, sheet finishing and sheet bundle discharge process in the sheet finishing apparatus according to the present invention.
Figure 36:
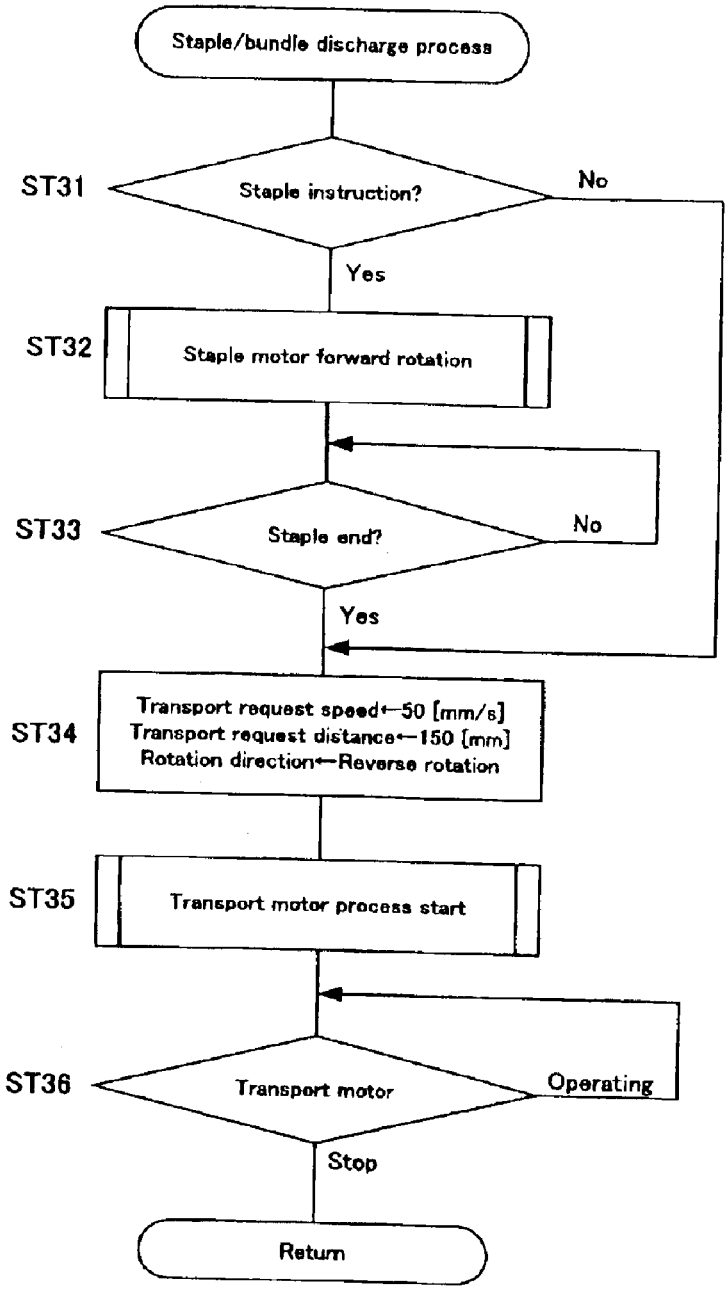
FIG. 36 is a drawing showing the control flow for performing the stapling and sheet bundle discharge operations defined in FIG. 35 according to the present invention.

The aforementioned CPU 111 controls the pulley alignment, the sheet finishing apparatus and the sheet bundle discharge process shown in FIG. 34 to FIG. 36 based on a program.

In other words, at step ST1 in FIG. 21, it checks if the transport motor 34 is running, and starts it up in the forward rotating direction if stopped (step ST2 and ST3). It waits until a sheet arrives at the inlet sensor 131 (step ST4).

Next, because a prior sheet (a previous sheet) may exist in the paper path 2, it determines a sheets presence (if a previous sheet is being processed) (step ST5). It is possible to determine by monitoring the output of the aforementioned discharge sensor 134, but here the format that counts the transport time for sheets or the number of pulses for sheets after passing the inlet sensor 131 is employed.

Continuing on, it waits until the trailing edge of a sheet exits the inlet sensor 131 (step ST6). This is to prevent accidents by moving the support shaft 11 and the support shaft 12 in the shaft direction and sliding the sheet regardless of whether or not the trailing edge of the sheet is nipped by the paired transport rollers 3.

If the trailing edge of the sheet has exited the inlet sensor 131, it sets "alignment roller retracting pulses" which are the number of pulse required for the sheet to exit the paired tray discharge rollers 4 and 5 (step ST7). It waits until 15 mm are transported after passing through the inlet sensor 131 (step ST8). This absorbs chattering caused by the bounding of sheets.

Next, in FIG. 34, based on the data and the instructions from the image forming apparatus main unit 100, it checks the discharge destination and determines that it is one of the following: The discharge destination is either in a "straight position," an "offset positioned (jog position)," or a "staple position."

If the discharge destination is a "straight position," nothing happens and the flow shown in FIG. 22 is exited (step ST10).

If the discharge destination is the "offset positioned (jog position)," it determines the position offset 20 mm to the right (−20 mm) with the required alignment speed of 150 mm/s and from the HP as the required alignment printing position to ensure the determined offset movement amount or the jog movement amount (step ST11) and begins the alignment process by moving to that position (step ST12).

If the discharge destination is the "staple position," it checks whether the sheet is being discharged to either the "center reference," the "front reference (side reference discharge)," or the "rear reference (side reference discharge)" from the image forming apparatus main unit 100, based on the data and instructions received from the image forming apparatus main unit 100 (step ST13). The distance of movement (required alignment position) from each discharge reference to the preparatory (pre) alignment position is calculated, that distance and the required alignment speed (step ST14 to ST20) are determined and the alignment process to move to that position is started (step ST12).

In other words, for the "center reference," the distance of movement to the preparatory (pre) alignment position is calculated according to the width of the sheets (for example, D1 and D4 shown in FIG. 13), the results are set as the required alignment position, and it determines 150/s as the required alignment speed (step ST15) and begins the alignment process to move to that position (step ST12).

In other words, for the "front reference (side reference discharge)," the distance of movement to the preparatory (pre) alignment position is calculated according to the width of the sheets (for example, d7 and d9 shown in FIG. 47), the results are set as the required alignment position, and it determines 150/s as the required alignment speed (step ST17) and begins the alignment process to move to that position (step ST12).

Next, for the "rear reference (side reference discharge) (step ST18), if discharging with the left side of the tray, namely that shown in FIG. 14, the distance of movement (distance $\alpha$) of the supporting shafts 11 and 12 on this finisher apparatus for the sheet is already known, so the constant distance of movement $\alpha$ mm from the discharge reference (for example d1 and d4 shown in FIG. 14) is set as the required alignment position (step ST19), and it determines 50 mm/s as the required alignment position and required alignment speed (step ST20) and begins the alignment process to move to that position (step ST12).

In the alignment process, sheets are actually moved only the aforementioned calculated distance, and the alignment process starts by sending them to the preparatory (pre) processing position (step ST12). Through this, sheets are transported and discharged by the rotation of the paired tray discharge rollers 4 and 5, and movement thereof in the shaft direction is executed by the aforementioned alignment process, which pushes sheets to the nipping position of the belt units 61 which are the preparatory (pre) alignment position.

Also, in FIG. 35, "alignment roller retracting pulse" set at the aforementioned step ST11 is calculated up, and if it is verified that the paired tray discharge rollers 4 and 5 have exited (step ST21), it checks if there is a discharge request for the next sheet, namely is there a sheet that must be discharged (step ST22). If there is a discharge request for a next sheet, it returns to step ST1, stacks the sheets that are discharged next and aligns them.

The determined number of sheets are stacked and at step ST22, if it is determined that there is no request for the discharge of a next sheet, it verifies if there is a staple instruction or a sheet bundle discharge instruction (step ST23). If there is no staple instruction or sheet bundle discharge instruction, processing ends (step ST23).

If there is a staple instruction or a sheet bundle discharge instruction, when determining at step ST23, it performs this alignment (pulling to the finishing position) using the caterpillar (belt units 61 and 61) as the alignment means (pulling means) 60 by setting the pulling pulse count, in other words, the necessary pulse count to pull the sheets from the preparatory (pre) alignment position (the nipping position) to the finishing position (step ST24).

Then, it waits for the transport motor 34 and the slide motor 47 to stop (step ST25) and starts the "staple/bundle discharge process" routine.

FIG. 36 shows the flow for the staple/sheet bundle discharge processing. Then, it waits for the transport motor 34 and the slide motor 47 to stop (step ST25) and forward rotates the staple motor (not shown in the drawings) to execute the finishing process (step ST26). At the finishing process, the stapler 23, which is the finishing means, staples the sheet bundle and stapling is completed (step ST33).

If there is no instruction to staple (step ST31), steps ST32 to ST33 are no processed and it proceeds to the next sheet bundle discharging process (steps ST34 to ST36).

At step ST34, the direction of rotation of the transport motor 34 that had until then been forward, switches to reverse rotation, and the transport motor 34 is started set at 50 mm/s for the transport request speed, and to 140 mm as the transport supply distance.

Because the transport motor 34 is rotated in reverse, the one-way clutched pulley 80 on the aforementioned sheet bundle discharge means 70 turns on and the rotational force of the transport motor 34 is transmitted, the worm gear 79 rotates the cammed worm wheel 76, unitized thereto the cam 77 presses the contact portion 75*a* on the contact arm 75 to rotate the rotating lever 74 around the circumference of the rotating center shaft 73. This revolves the pushing member 71 around the rotating center shaft 73 as depicted in FIG. 33(*a*) to 33(*c*) to push the sheet bundle 90 to outside of the region of the fixed stacking portion 8 (the first tray). The sheet bundle 90 is discharged from the fixed stacking portion 8 (the first tray) to the top of the storage tray 9 (the second tray).

When the sheet bundle discharge operation ends, the series of operations from discharge to preparatory (pre) alignment, to alignment, finishing (stapling) and sheet bundle discharge is completed.

Figure 37:
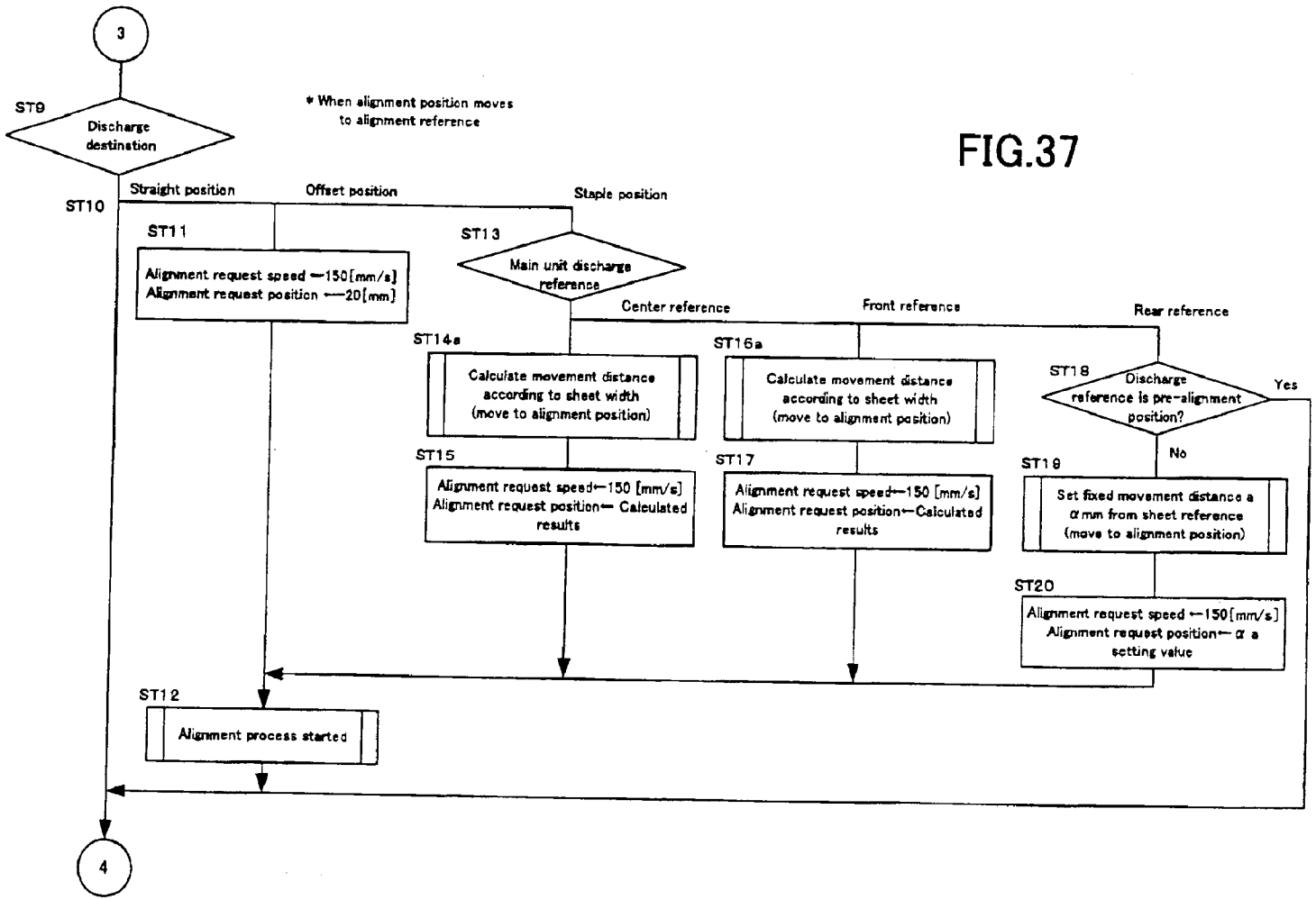
FIG. 37 is a drawing corresponding to FIG. 34 showing a portion of the control flow for operating the alignment, the sheet finishing process and the sheet bundle discharge (without the preparatory (pre) alignment) as another example of the control in the sheet finishing apparatus according to the present invention.
Figure 38:
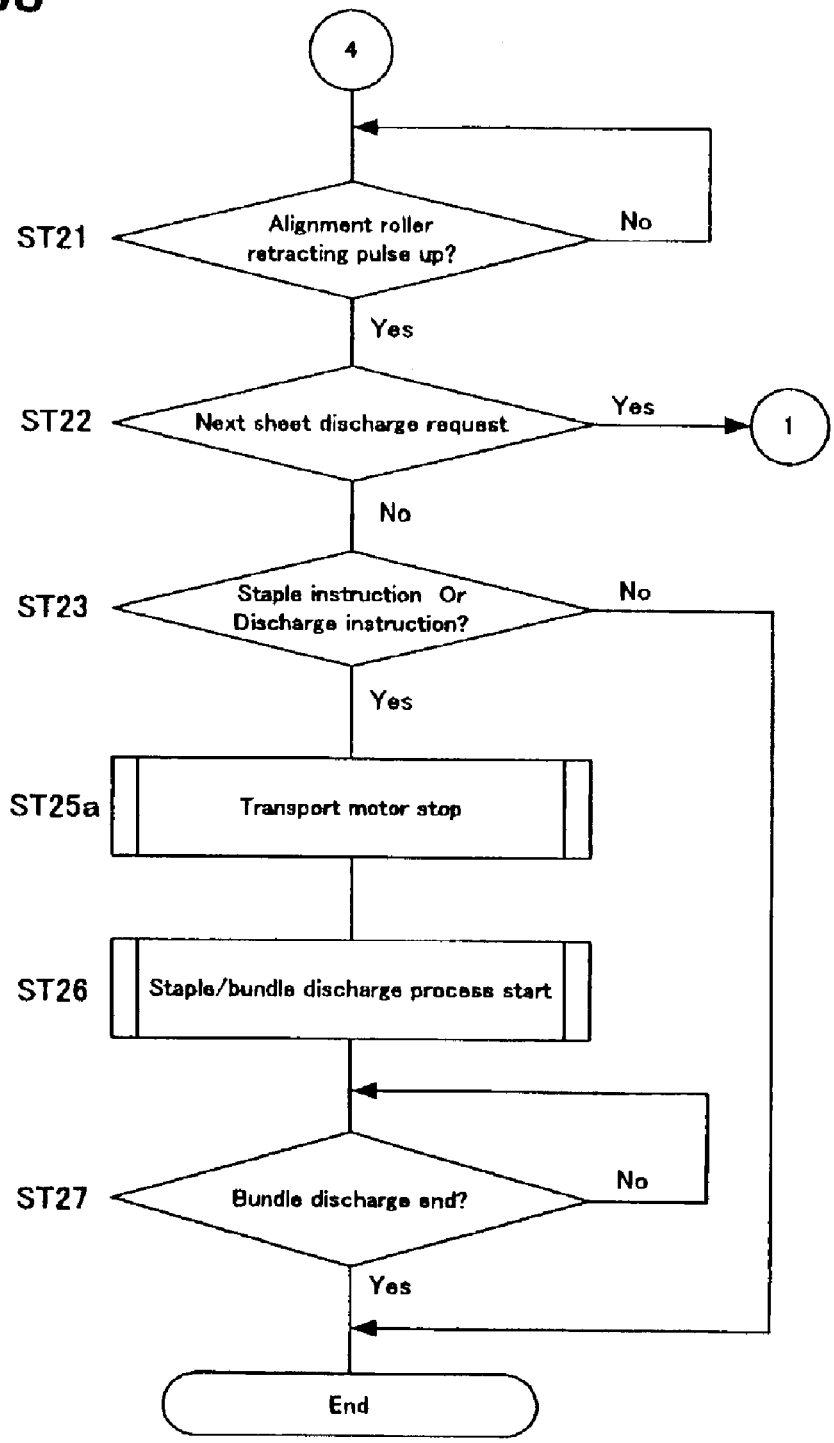
FIG. 38 is a drawing continued from FIG. 37 showing a portion of the control flow for operating the alignment, the sheet finishing process and the sheet bundle discharge (without the preparatory (pre) alignment) as another example of the control in the sheet finishing apparatus according to the present invention.

(c) Modified Example of Control (FIG. 37 to FIG. 38)

In FIG. 37 to FIG. 38, the example of control that does not have this alignment means 60 is shown. In other words, sheets are moved to the finishing means all at once without the prealignment to the preparatory (pre) alignment position, more accurately, these FIGs. show the control to move sheets to the width direction alignment reference position (positioning plate 22).

The following points for FIG. 37 differ from the aforementioned FIG. 34. Specifically, in the aforementioned FIG. 34, at step ST14 and step ST16, the distance of movement (D1 and D4 in FIG. 13 and d1 and d4 in FIG. 14) to the preparatory (pre) alignment position is calculated and the required alignment position is set according to the operation results. However, at step ST14*a* and step ST16*a* in FIG. 37, the distance of movement (D6 in FIG. 13 and d6 in FIG. 14) to the width direction alignment reference position is calculated and the required alignment position is set according to the operation results.

The following points for FIG. 38 differ from the aforementioned FIG. 35. Specifically, in the aforementioned FIG. 35, at step ST24 and step ST25, it sets the caterpillar pulling pulse and waits for the transport motor to stop. However, at step ST25*a* in FIG. 38, because this alignment means (pulling means) 60 does not exist, the transport motor is stopped.

I. Modified Example of Control (FIG. 39 to FIG. 44)

Below is described an example control that is different to the one described above.

(a) Control Apparatus (FIG. 20)

In other words, the sheet S passed through the upper guide 2*a* and the lower guide 2*b* in the processing apparatus 1 and discharged, is detected by the inlet sensor 131 (optical sensor) composed of the light source and the light receptor elements arranged to sandwich the upper guide 2*a* and the lower guide 2*b* determines whether or not the sheet S has passed therethrough, for each sheet, to perform detection for passing sheets and for retained sheets.

Also, it is detected whether or not the sheet S has been discharged or not by the detection sensor 134 composed of the light source arranged sandwiching the sheet discharge outlet 7 downstream of the paired tray discharge rollers 4 and 5 and the light receptor elements.

The outputs from the inlet sensor 131 and the discharge sensor 134 are applied to the micro-computer in the sheet finishing apparatus 1 equipped with a CPU 111 and ROM 112 and RAM 113, as shown in FIG. 20. Also, information from operating means composed of the start key, the sorting sheet count setting keys, the total recording count setting keys and the tenkeys from the image forming apparatus main unit 100 are input to the finisher apparatus 1 micro-computer CPU 111.

To the micro-computer computer output port is connected the motor driver 119 that supplies electrical power to the slide motor 47.

The micro-computer calculates the number of outputs from the discharge sensor 134 and when the sorting count matches that of the output count and the sheet S, it can switch the positions of the paired tray discharge rollers 4 and 5.

Also equipped is an error detection means that detects whether or not the finishing using the stapler 23, which is the finishing means, has ended normally. In the event that the error detection means detects an error in the finishing means, a control means is equipped to prohibit the operation of the sheet shift means used also as the aforementioned preparatory (pre) alignment moving means 40 based on instructions from the image forming apparatus or on its own judgment.

The control apparatus in the sheet finishing apparatus 1 according to this example comprises along with the "normal discharge mode" that discharges sheets discharged from the image forming apparatus main unit 100 as they are to the storage tray 9, the "finishing mode" and the "sorting discharge mode" as its operating modes.

(b) Normal Discharge Mode

This mode is for the sheets S having been recorded thereupon with images and do not require sorting or finishing. In this mode, the programs described below are not executed and the sheet S is discharged to the top of the storage tray 9 as they are without side feeding the paired tray discharge rollers 4 and 5.

Figure 39:
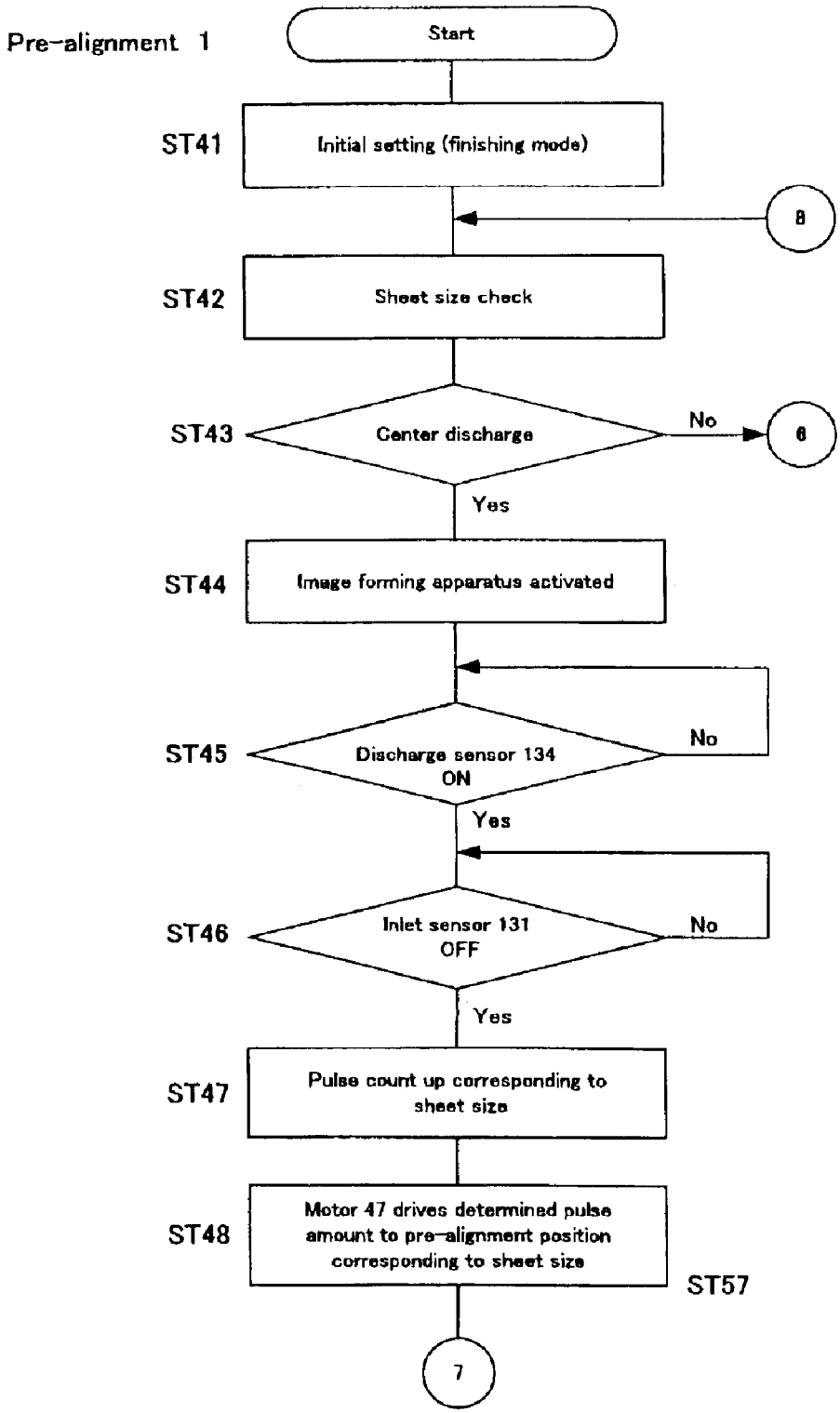
FIG. 39 is a drawing showing a portion of another control flow for operating the preparatory (pre) alignment, the alignment, the sheet finishing and the sheet bundle discharge processes according to the present invention.
Figure 40:
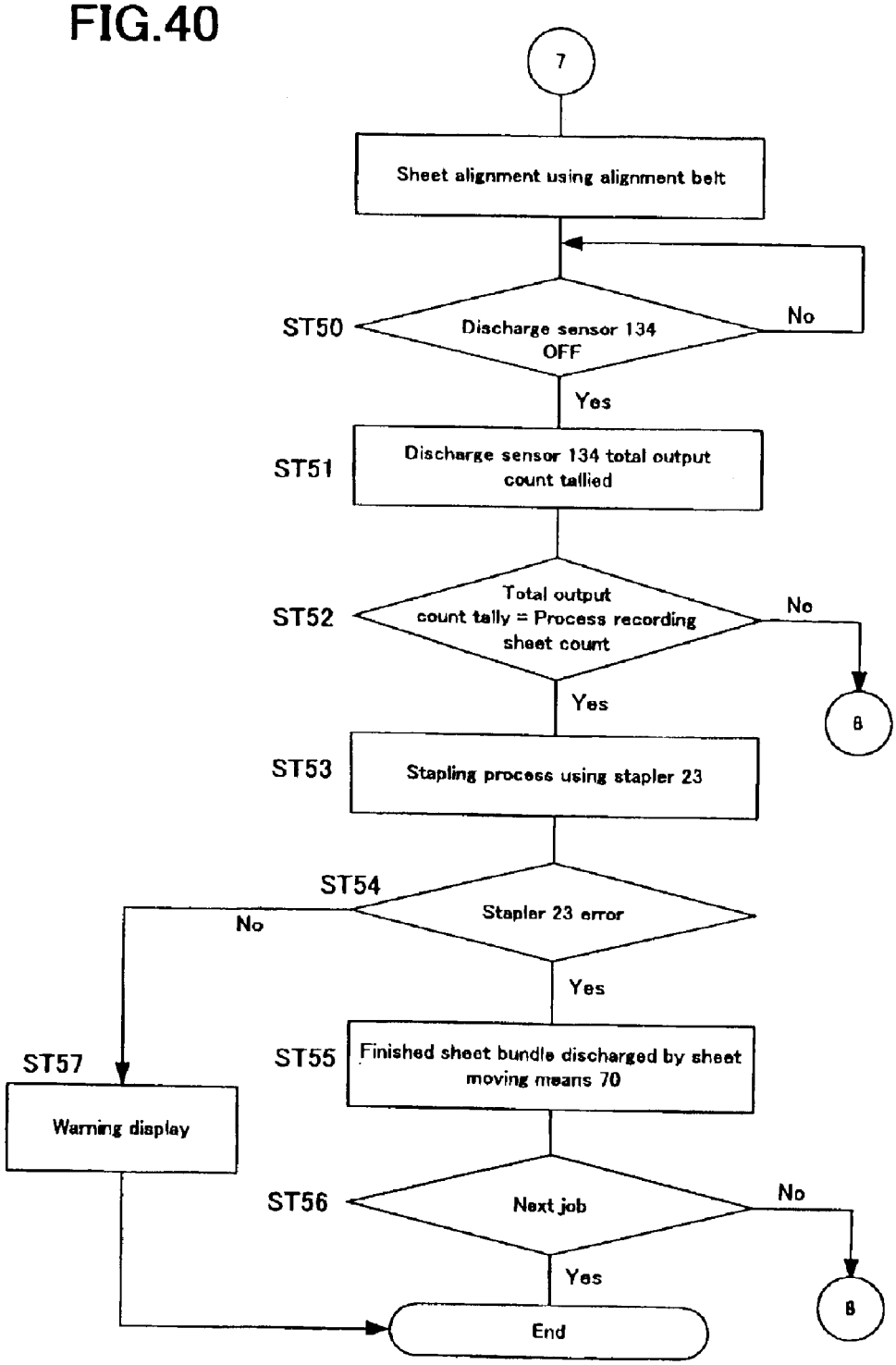
FIG. 40 is a drawing continued from FIG. 39 showing a portion of the control flow for operating the preparatory (pre) alignment, the alignment, the sheet finishing and the sheet bundle discharge processes in the sheet finishing apparatus according to the present invention.
Figure 41:
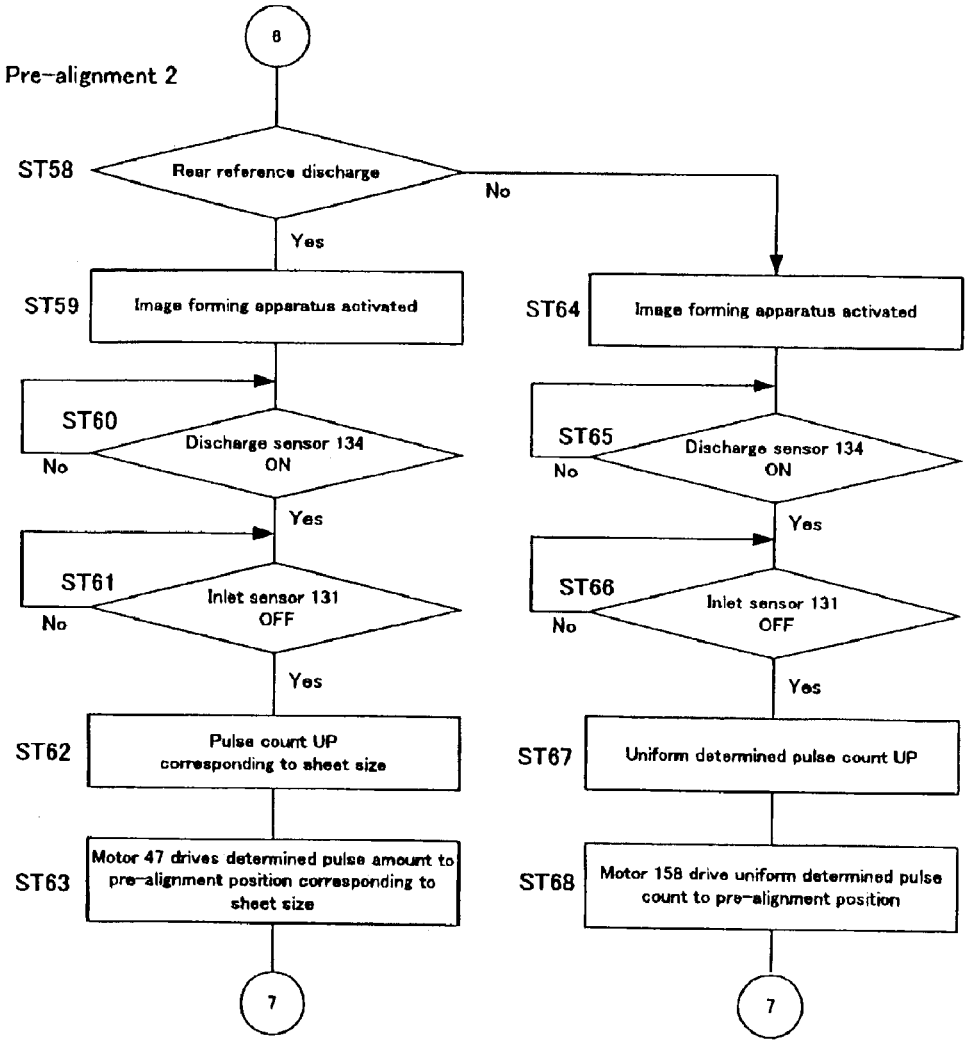
FIG. 41 is a drawing showing a portion of the control flow branched from FIG. 39 for operating the preparatory (pre) alignment, the alignment, the sheet finishing and the sheet bundle discharge processes in the sheet finishing apparatus according to the present invention.

(c) Finishing Mode (with Preparatory (Pre) Alignment) (FIG. 39 to FIG. 41)

When the start signal for the finishing mode is applied to the control apparatus" micro-computer, either from the image forming apparatus main unit 100 or a personal computer connected thereto, the finishing mode is executed according to the program shown in the flowcharts of FIG. 39 to FIG. 41, that are stored in the ROM 112 on the micro-computer.

First, at step ST41, the image forming apparatus main unit 100 is set to default.

Next, it checks the size of the sheets (step ST42) and it checks the discharge destination set by either the image forming apparatus main unit 100 or the personal computer connected thereto, to verify if it is a center reference or a side reference (step ST43).

If the discharge destination is a center reference, images are recorded on the sheet SS by the image forming apparatus main unit 100, based on the print signal from the print key on the image forming apparatus main unit, not shown in the drawings, or from the personal computer connected to the image forming apparatus main unit 100 (step ST44).

Next, the leading edge of the sheet SS is nipped by the paired tray discharge rollers 4 and 5 and when the output of the discharge sensor 134 turns ON (step ST45), it waits for the inlet sensor 131 to turn off (step ST46).

The output from the inlet sensor 131 turns off, and if the sheet SS trailing edge has finished passing through the inlet sensor 131 (step ST46), it waits for the pulse count corresponding to the sheet size of the transport motor 34 to finish (step ST47), then it drives the slide motor 47 for a determined number of pulses to the preparatory (pre) alignment position (preparatory alignment position) that corresponds to that sheet size (step ST48).

The rotating supporting shafts 11 and 12 receive, then, the drive from the transport motor and moves them in the direction of the arrow A (FIG. 3), the sheet being slidingly moved to the preparatory (pre) alignment position and preparatory (pre) alignment is performed on the sheet. Note that the distance of travel to the preparatory (pre) alignment position is set to be longer in the direction of the arrow A than when in the sorting discharge mode, described below.

In this way, by making the supporting shafts 11 and 12, namely the paired tray discharge rollers 4 and 5 travel to the direction of the arrow A, the sheet S being discharged is moved to the preparatory (pre) alignment position allowing the sheet SS to be discharged while straddling the fixed stacking portion 8 and the storage tray 9.

Thus, the sheet SS moved to the preparatory (pre) alignment position and discharged is pulled further by the belt units 61 and 61 and is aligned (main alignment) at the finishing position determined by the positioning plate 22 and the abutting plate 21 (step ST49).

Then, when the sheet has exited the discharge sensor 134 (step ST50), the "total output count" is tallied (step ST51) and it is checked if the total output count value matches the processing recording sheet count (step ST52). If matched, the main alignment of the determined number of sheets has been completed, so stapling (the binding process) with the stapler 32 is performed on the sheet bundle 90 (FIG. 28).

Continuing on, the transport motor 34 is driven and the sheet bundle 90 having been aligned is pushed in the direction traversing the sheet transport direction by the sheet bundle discharge means (the sheet transport means) 70 to be discharged from the fixed stacking portion 8 (the first tray) to the storage tray 9 (the second tray). Then, if the next job exists, it returns to step ST42 (step ST56). Note that at step T54, if an error occurs in the stapler 23, a warning will be displayed by the appropriate display means or warning means (step ST57).

FIG. 41 shows the processing when the discharge destination is determined not to be the center reference, in other words, the processing when the discharge destination is determined to be a side reference.

In that case, first, it checks to verify that the discharge destination is a rear side reference (rear side reference discharge). If the result is YES (rear side reference discharge), images are recorded onto the sheet SS (step ST59) by the image forming apparatus main unit 100 based on the print signal from the print key on the image forming apparatus main unit 100, not shown in the drawings, or from a personal computer connected to the image forming apparatus main unit 100.

Next, the leading edge of the sheet SS is nipped by the paired tray discharge rollers 4 and 5 and when the discharge sensor 134 turns on (step ST60), it waits for the inlet sensor 131 to turn off (step ST61).

The output from the inlet sensor 131 turns off, and if the sheet SS trailing edge has finished passing through the inlet sensor 131 (step ST61), it waits for the pulse count corresponding to the sheet size of the transport motor 34 to finish (step ST47), then it drives the slide motor 62 for a determined number of pulses to the preparatory (pre) alignment position (preparatory alignment position) that corresponds to that sheet size (step ST63). The rotating supporting shafts 11 and 12 receive, then, the drive from the transport motor and moves them in the direction of the arrow A (FIG. 3), the sheet being slidingly moved to the preparatory (pre) alignment position and preparatory (pre) alignment is performed on the sheet.

Then, the program returns to step ST50 where binding using the stapler 23 and discharging of finished sheet bundles are performed.

On the other hand, if at the aforementioned step ST58, it is determined to be no (front side reference), images are recorded on the sheet SS by the image forming apparatus main unit 100, based on the print signal from the print key on the image forming apparatus main unit, not shown in the drawings, or from the personal computer connected to the image forming apparatus main unit 100 (step ST44).

Next, the leading edge of the sheet SS is nipped by the paired tray discharge rollers 4 and 5 and when the discharge sensor 134 turns on (step ST65), it waits for the inlet sensor 131 to turn off (step ST66).

The output from the inlet sensor 131 turns off, and if the sheet SS trailing edge has finished passing through the inlet sensor 131 (step ST66), it waits for the pulse count corresponding to the sheet size of the transport motor 34 to finish (step ST67), then it drives the slide motor 47 for a determined number of pulses to the preparatory (pre) alignment position (preparatory alignment position) (step ST68). The rotating supporting shafts 11 and 12 receive, then, the drive from the transport motor and moves them in the direction of the arrow A (FIG. 3), the sheet being slidingly moved to the preparatory (pre) alignment position and preparatory (pre) alignment is performed on the sheet.

Then, the program returns to step ST50 where binding using the stapler 23 and discharging of finished sheet bundles are performed.

Figure 42:
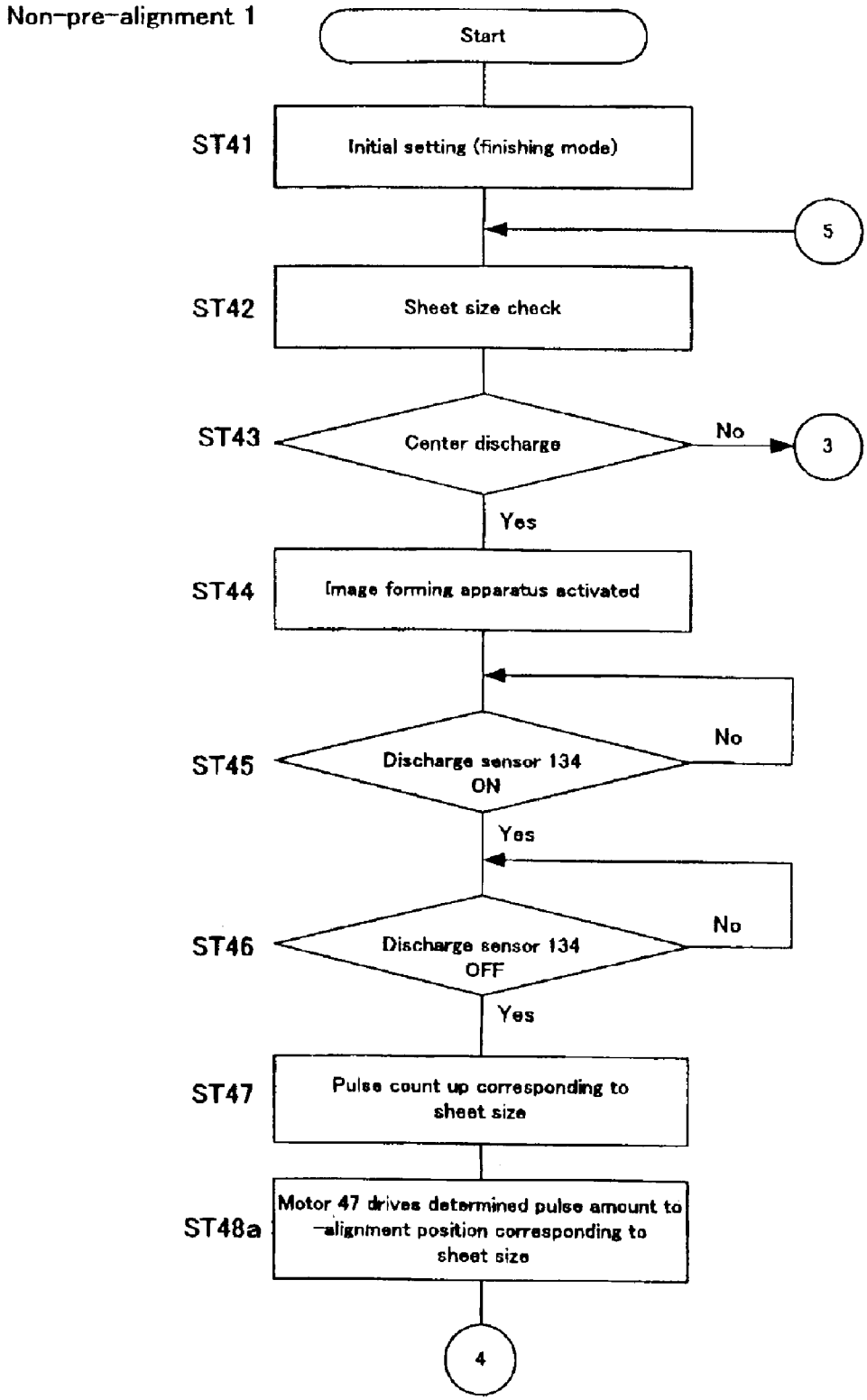
FIG. 42 is a drawing showing a portion of another control flow for operating the alignment, the sheet finishing and the sheet bundle discharge processes (without the preparatory (pre) alignment) according to the present invention.
Figure 43:
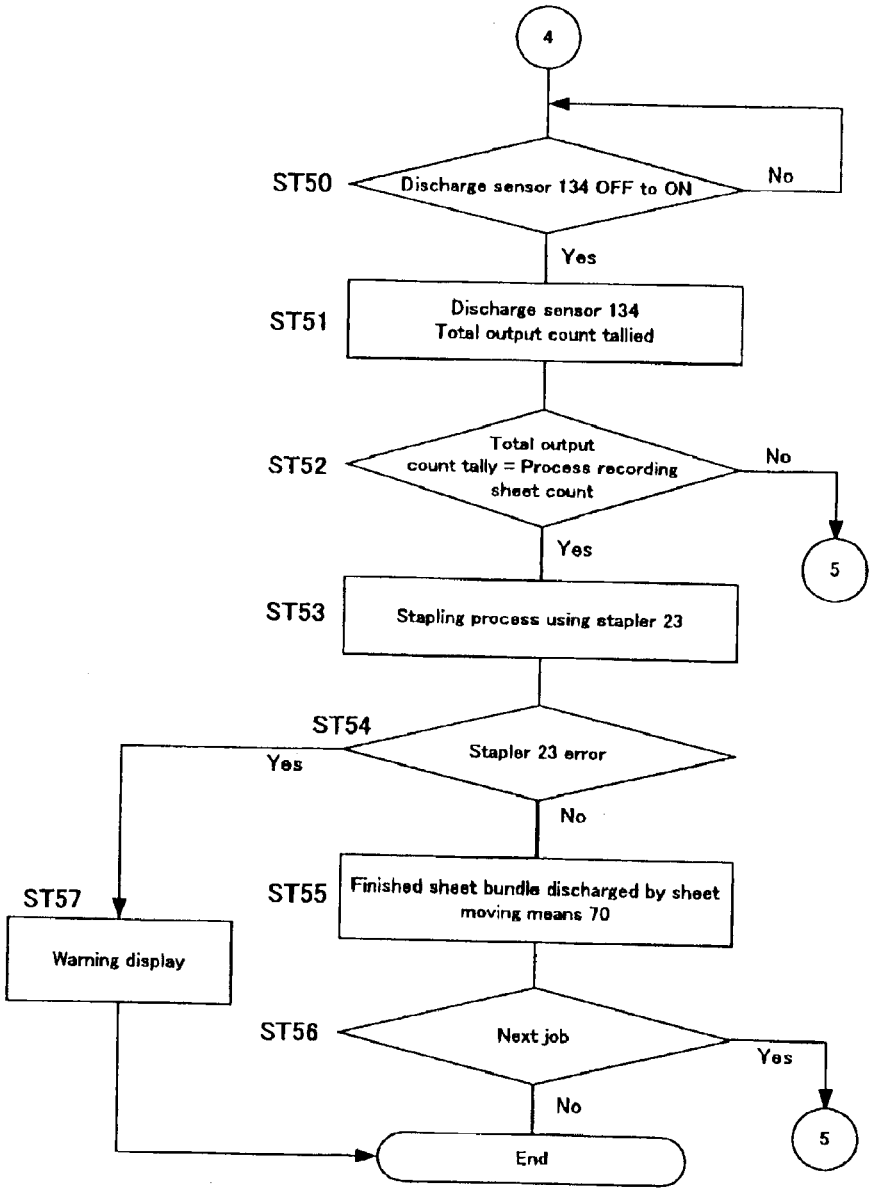
FIG. 43 is a drawing continued from FIG. 42 showing a portion of the control flow for operating the alignment, the sheet finishing and the sheet bundle discharge processes (without the preparatory (pre) alignment) according to the present invention.
Figure 44:
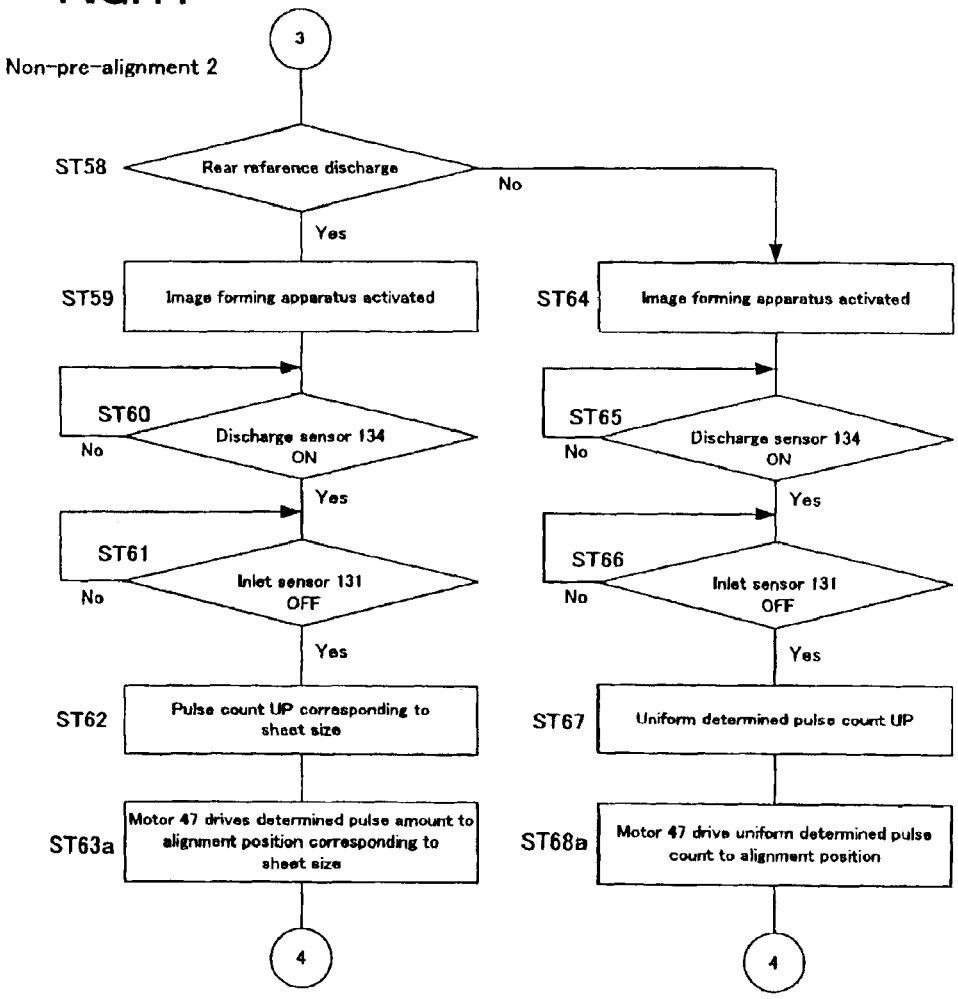
FIG. 44 is a drawing showing a portion of the control flow branched from FIG. 42 for operating the alignment, the sheet finishing and the sheet bundle discharge (without the preparatory (pre) alignment) according to the present invention.

(d) Modified Example of Finishing Mode (FIG. 42 to FIG. 44)

FIG. 42 to FIG. 44 show a control example when slidingly moving the sheet to the final finishing position once without performing the preparatory (pre) alignment described above. For that reason, at step ST48*a* in FIG. 42, step 63*a* and step ST68*a* in FIG. 44, the number of pulses to move the sheet not to the preparatory (pre) alignment position but to the final finishing position are applied to operate the slide motor 47.

Figure 45:
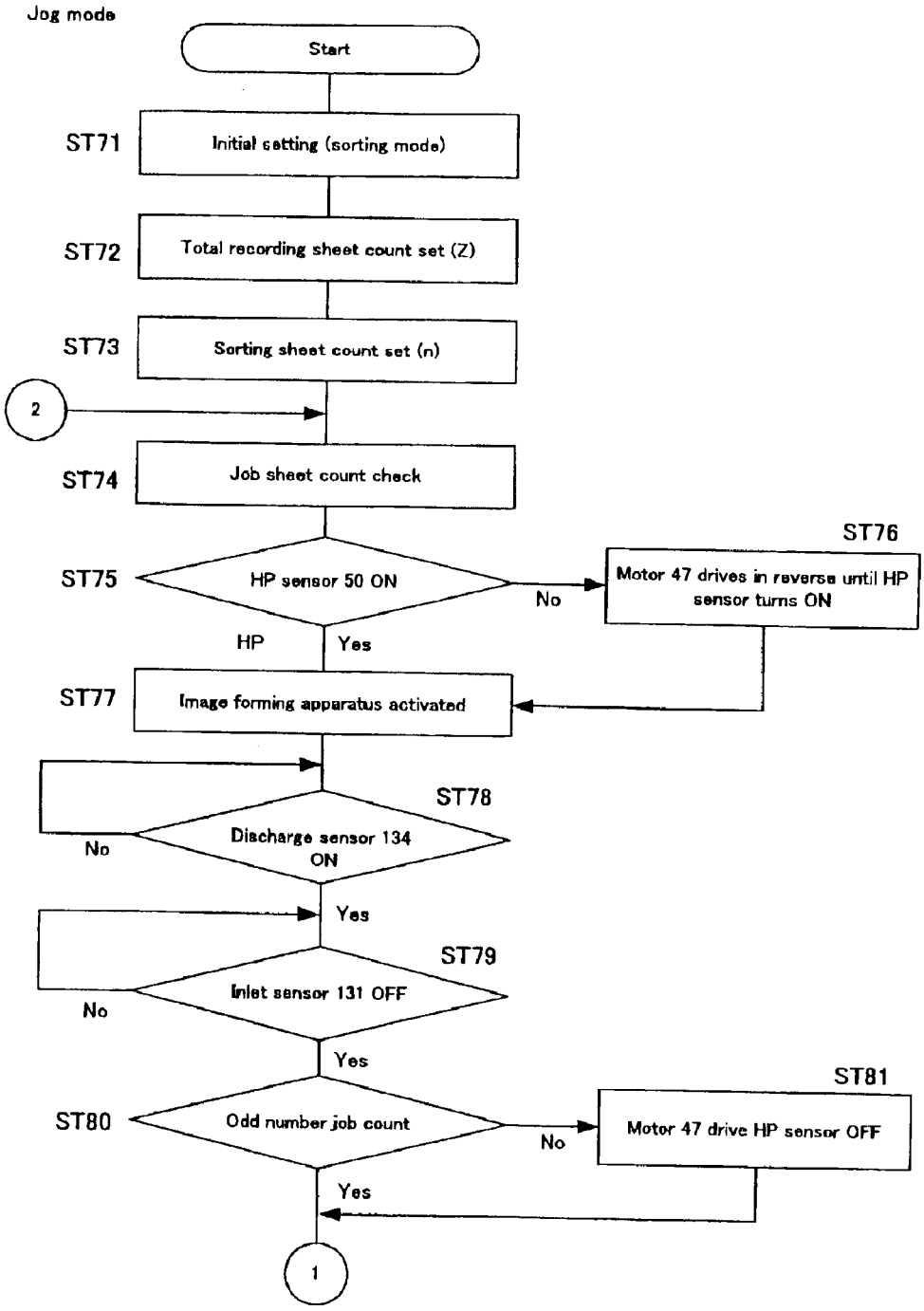
FIG. 45 is a drawing showing a portion of a control flow for operating a sorting process according to the present invention.
Figure 46:
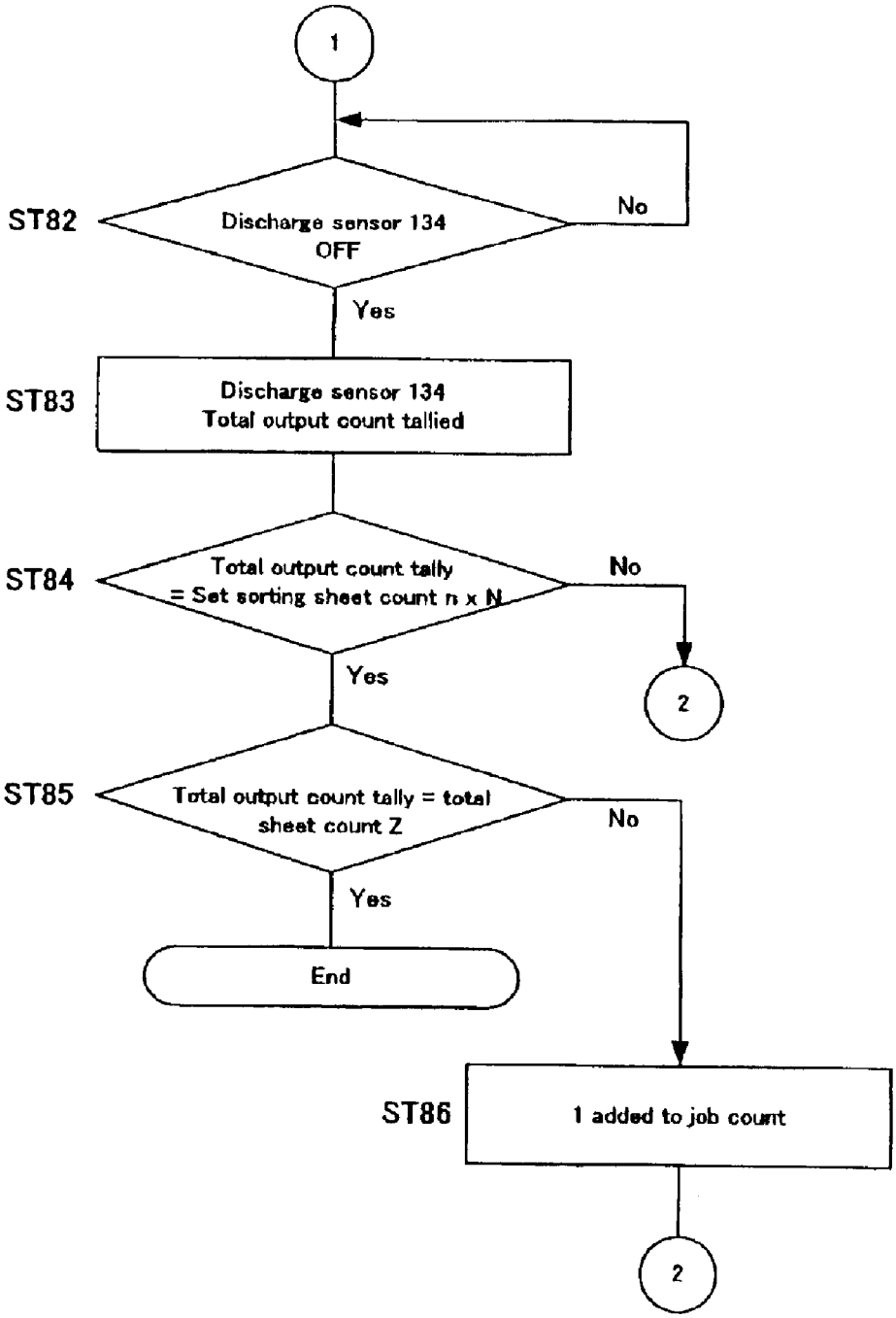
FIG. 46 is a drawing continued from FIG. 45 showing a portion of the control flow for operating the sorting process according to the present invention.

(e) Modified Example of Sorting Discharge Mode (FIG. 45 to FIG. 46)

The sheet finishing apparatus 1, described above, is equipped with a sheet shift means as the sorting means to execute the sorting discharge mode to sort discharged sheets for each sheet bundle by moving them in a direction that traverses the sheet transport direction or that is perpendicular thereto. However, a dedicated sheet shift means is not prepared, but rather the aforementioned preparatory (pre) alignment moving means (side moving means) 40 can be dually used as the sheet shift means.

The sheet shift means which is the sorting means, more accurately is composed of the sheet shift means (preparatory (pre) alignment moving means 40) and a jog mode control function that performs sorting (jog operation) with that. In the control apparatus shown in FIG. 20, the micro-computer calculates the number of outputs from the discharge sensor 134 when in the sorting discharge mode, and when the sorting count matches that of the output count and the sheet S, it can switch the offset positions from the normal discharge position, or the opposite thereof.

First Job (Odd Numbered Job)

When the start signal for the sorting discharge mode is applied to the control apparatus micro-computer 135, either from the image forming apparatus main unit 100 or a personal computer connected thereto, the sorting discharge mode is executed according to the program shown in the flowchart of FIG. 45 that is stored in the ROM on the micro-computer 135.

First, at step ST71, shown in FIG. 45, the image forming apparatus main unit 100 is set to default.

Next, at step ST72 and ST73, the settings for the "total recording number of sheets Z" to record images and the settings for the "number of sortings" of those recordings are performed by operating the total recording number of sheets setting key, not shown in the drawings, the number of sortings setting key and tenkeys, or by operating a personal computer connected to the image forming apparatus main unit 100.

Further to the explanation, in this embodiment, the "total recording number of sheets is 15" and the number of sortings is n=3.

Also, at step ST74, it checks the sheet "number of jobs" to be discharged. What is called a "job" is one bundle of sorted sheets (a sheet bundle). Therefore, if the discharged sheet belongs to the first bundle, the job number belonging to that sheet is N=1. If it belongs to the second bundle, the job number belonging to that sheet is N=2.

The initial job number N is 1, so after verifying that it is the job number N=1, it determines if the sliding joint plate is at the HP (home position) by the home position detection sensor 50 (HP detection sensor 50) at step ST75. When the home position detection sensor 50 is on, specifically, when the light from the light sources to the receptor elements is interrupted by the position detection protrusion 51 on the sliding joint plate 41, it determines that the sliding joint plate 41 is at the home position.

This is the first time the sliding joint plate 41 is at the HP (home position). However, if the decision at step ST75 is no, specifically, if the home position detection sensor 50 is off (the receptor elements are receiving light), it detects that the portion is not at the home position, it reversingly drives the slide motor 47, to return the sliding joint plate 41 to the HP at step ST76. The slide motor 47 is reversingly driven until the home position detection sensor 50 is detected to be on.

Next at step ST77, images are recorded on the sheet S1 by the image forming apparatus main unit 100 by operating the print key, not shown in the drawings, on the image forming apparatus main unit 100 or based on the print signal from the personal computer connected to the image forming apparatus main unit 100.

Continuing on, the first sheet S1 is transported, the leading edge thereof nipped by the paired tray discharge rollers 4 and 5. At step ST78, the output of the discharge sensor 134 established at the discharge outlet 7 (the receptor elements not receiving light) thereby detecting that the first sheet S1, recorded with images, is positioned at the discharge sensor 134.

Here, the output of the detection sensor turns ON first by the aforementioned first sheet S1, and it waits for the output of the inlet sensor 131 (transport path sensor) to turn off (step ST79). The reason is that if the trailing edge of the aforementioned sheet is still passing through the paired transport rollers 3 established at the inlet of the paper path 2, the sliding of the sheet by moving the paired tray discharge rollers 4 and 5 in the shaft direction should be prohibited. That is because it is necessary to verify that the trailing edge of the sheets have exited the transport path sensor established near the paired transport rollers 3 or further downstream in the sheet transport direction. If the trailing edge of sheets nipped by the paired transport rollers 3 is passing through, the leading edge is being slid by moving the paired tray discharge rollers 4 and 5 which will tear the paper.

There, at step ST79, the output from the inlet sensor 131 turns off. If it is verified that the trailing edge of the sheet S1 has finished passing through the paired transport rollers 3, at step ST80, it determines whether or not the job number belonging to the sheet currently being discharged is an odd number. Specifically, at step ST80, it determines whether or not the first sheet S1 (first job) is a sheet belonging to the odd numbered jobs, using the job signal from either the image forming apparatus main unit 100 or the personal computer connected thereto.

When it is handling the first sheet S1, it belongs to an odd numbered job so the decision at step ST80 is YES and it shifts to step ST82 in FIG. 46.

However, as described below, if the currently discharging sheet is an even numbered job, the decision at step ST80 is NO and it shifts to step ST81. At step ST81, the slide motor 47 is rotated in forward the determined number of pulses that corresponds to the distance from the HP to the sorting position to slidingly move the paired tray discharge rollers 4 and 5 to the sorting position (offset position).

At step ST82, shown in FIG. 46, when the trailing edge of the first sheet S1 passes the discharge sensor 131, that detection output turns off, meaning the trailing edge of the first sheet S1 has been discharged to the storage tray 9. Then, at step ST83, the discharge sensor 134 tallies the "total output count" of the number of sheets that have passed the discharge sensor 134.

Continuing, it proceeds to step ST84, it is judged whether or not the number n of sorted sheets set by the aforementioned step ST73 and the cumulative job number N–"the set sorting number n×job number n" and the actual count (total output count) by the discharge sensor 134 at step ST81, are the same. The job number N is an integer value that varies by being added to by 1 at the step ST86, described below, for each time a sorting of sheets of the sorting number n is completed that was set, the initial value being 1.

At this point, the job number N is N=1. However, in this embodiment, the "total recording number Z=15" and the "sorting sheet count is n=3," and because this is handling the initial sheet of the group of sheets in the first sheet S1, the relationship becomes total output count<n×N and the judgment at step ST84 turns on. If the set sorting sheet count n×job number N (in this case N=1) does not equal the total output count at the discharge sensor 134 at the judgment at step ST84, in other words, if the total count of sheet output up to the determined job number N has not been completed, it returns to step ST74.

Then, at step ST75, the home position detection sensor 50 determines whether or not the sliding joint plate 41 is at the home position. Then, at step ST80, if it is the first sheet S1 recognized to belong to the odd numbered jobs, the home position detection sensor 50 turns on by the sliding joint plate 41 at the HP (home position) so without driving the slide motor 47, it exits step ST75 with the sliding joint plate 41 at the home position.

Subsequently, for each of the subsequent first sheet S1, the operations from step ST74 to ST84 are repeated and the first sheet S1 recorded with images, are sequentially discharged to the first position of the paired tray discharge rollers 4 and 5, namely stacked in order to the position J1 (first jog position) indicated by the dotted line on the storage tray 9 in FIG. 15.

In this way, when the total sheet count is discharged (sorting sheet count n=3) for the job number N=1, it determines at step ST84 if the set sorting sheet count n×job number N=discharge sensor total output count, then proceeds to step ST85.

At step ST85, it is determined whether or not the set total recording sheet count Z matches the total output count of the discharge sensor 134. At step ST85, if the "set total recording sheet count=total output count," sorting by the sorting means is ended. However, in this embodiment, the total recording sheet count is set to Z=15 and it is to end when the sorting sheet count n=3 for the first bundle (job number N=1), so the decision at step ST85 is that the "set total recording sheet count does not equal the total output count of the discharge sensor 134." Here, it proceeds to step ST86, increases the aforementioned job number N by 1, and after the job number N is set to 2, it returns to the sorting step ST74.

Second Job (Even Numbered Job)

Operations for the third job (job number N=2) after returning to step ST74 are explained below.

First, the job number N is verified (step ST74). Here, the job number N should be the result 1 at the aforementioned step ST86 and job number N=2. Specifically, at step ST74, it determines whether or not sheet the next third sheet S3, and not relating to the first job, using the job signal from either the image forming apparatus main unit 100 or the personal computer connected thereto.

Also, the home position detection sensor 50 verifies if the sliding joint plate 41 is at the HP position (step ST75), proceeds to step ST77 and shifts further to step ST78.

The second sheet S of the next job is nipped by the paired tray discharge rollers 4 and 5 and when the discharge sensor 134 turns on, the inlet sensor 131 turns off (step ST78 and ST79).

Here, it is determined whether or not it is an odd numbered job. (step ST80). The second sheet S2 belongs to an even numbered job, so the decision at step ST80 is NO and it proceeds to step ST81. At step ST81, the slide motor 47 is rotated in forward the determined number of pulses that corresponds to the distance D from the HP to the sorting position (second jog position J2) to slidingly move the paired tray discharge rollers 4 and 5 to the determined sorting position (offset position), namely, the second jog position J2 shown in FIG. 15.

In this state, the trailing edge of the second sheet S2 passes the discharge sensor 134, the detection output turns off, to mean the trailing edge of the second sheet S2 has been discharged to the storage tray 9. At that time, the second sheet S2 is sequentially discharged and stacked in the second position of the paired tray discharge rollers 4 and 5, namely, a determined distance D to the position J2 (second jog position), indicated by the dotted lines on the storage tray 9 in FIG. 15. Expressed differently, the second sheet S2 is moved to a position separated a determined distance of D from the HP by the sliding joint plate 41, at step ST81, specifically, for the first sheet S1 on the storage tray 9, it is discharged to the storage tray 9 by the paired tray discharge rollers 4 and 5 a determined distance.

Then, at step ST83, in the same way as for the first sheet S1, the sheet count that passes the discharge sensor 134 is tallied by the total output count of the discharge sensor 134.

Continuing, proceeding to step ST84, it determines whether or not the total of the set sorting sheet count n×job number N and the total output count of the discharge sensor 134 tallied at step ST83 are the same.

Here, the job number N is incremented at step ST86 and is N=2. Also, until the determined sorting sheet count n (sorting sheet count n=3) is discharged, the relationship is total output count<n×N, so the decision is on at step ST84. If the set sorting sheet count n×job number N (in this case N=2) does not equal the total output count at the discharge sensor 134 at the judgment at step ST84, it returns to step ST74.

Then, at step ST74, after verifying the job number N, the home position detection sensor 50 determines whether or not the sliding joint plate 41 is at the home position.

Here, when processing the initial sheet of the second sheet S2 group, at step ST81, the slide motor 47 is driven to move the sliding joint plate 41 from the HP to the a printing position separated a determined distance of D. With the home position detection sensor 50 OFF, the decision at step ST75 is ON and it shifts from step ST75 to step ST76. Also, at step ST76, the sliding joint plate 41 returns to the HP and it shifts to step ST77. Doing so recovers the paired tray discharge rollers 4 and 5 from the position that discharged the aforementioned second sheet S2, to the position to receive the subsequent second sheet S2.

Subsequently, at step ST84, until the "set sorting sheet count n (n 3)×job number N (N=2)=total output count from the discharge sensor 134, for each of the subsequent first sheet S1, the operations from step ST74 to ST84 are repeated and the first sheet S1 recorded with images, are sequentially discharged in order to the position (second jog position J2) indicated by the dotted line on the storage tray 9 in FIG. 15.

Note that at the aforementioned step ST81, moving the sliding joint plate 41 moves the supporting shafts 11 and 12 as well a determined distance D. At that time, the supporting shafts 11 and 12 receive the drive force of the transport motor 43 and continue rotating. Therefore, the paired tray discharge rollers 4 and 5 mounted to the supporting shafts 11 and 12 move in the shaft direction of the supporting shafts 11 and 12 while discharging sheets to discharge them to the aforementioned second jog position J2 on the storage tray 9. Also, the distance of travel D to the aforementioned second jog position J2 is controlled, for example, by a pulse count from the slide motor 47 or a timer counter operated by a different timer means.

The discharge of sheets for the set sorting sheet count n (n=3) for the second sheet S2 group, specifically, the discharge of sheets of the total number of sheets (n×N=3×2) up to the determined job number N (N=2) that use the set sorting sheet count n (n=3) as the units and at step ST84, it determines if it has reached the "set sorting sheet count n×job count N=discharge sensor 134 total output count," and proceeds to step ST85.

At step ST85, it is determined whether or not the set total recording sheet count Z matches the total output count of the discharge sensor 134. At step ST85, if the "set total recording sheet count=total output count," sorting by the sorting means is ended. However, in this embodiment, the total recording sheet count is set to Z=15 and it is to end when the sorting sheet count n=3 for the second bundle (job number N=2), so the decision at step ST85 is that the "set total recording sheet count does not equal the total output count of the discharge sensor 134." Here, it proceeds to step ST86, increases the aforementioned job number N by 1, and after the job number N is set to 3, it returns to the sorting step ST74.

Third Job (Odd Numbered Job)

Operations for the third job (job number N=3) after returning to step ST74 are explained below.

First, the job number N (N=3) is verified (step ST74) Specifically, at step ST74, it determines whether or not sheet the next third sheet S3, and not relating to the first job, using the job signal from either the image forming apparatus main unit 100 or the personal computer connected thereto.

Then, at step ST75, the home position detection sensor 50 determines whether or not the sliding joint plate 41 is at the home position. The initial sheet of the third sheet S3 group (odd numbered job) is moved to the second jog position J2 at step ST81, namely the home position detection sensor 50 is OFF. Therefore, at step ST75, because the home position detection sensor 50 is OFF, it determines that the sliding joint plate 41 is not at the HP, so it shifts from step ST75 to step ST76 and reversingly drives the slide motor 47 to return the sliding joint plate 41 to the HP. Doing so returns the paired tray discharge rollers 4 and 5 to the HP to allow it to discharge the second sheet S2 to the first jog position J1.

The third sheet S3 is fed by paired tray discharge rollers 4 and 5 and the output from the discharge sensor 134 turns on at step ST78; the inlet sensor 131 turns off at step ST79.

Here, it is determined whether or not it is an odd numbered job. (step ST80). The third sheet S3 belongs to an odd numbered job, so the decision at step ST80 is YES and nothing occurs while the paired tray discharge rollers 4 and 5 are at the HP.

In this state, the trailing edge of the third sheet S3 passes the discharge sensor 134 at step ST82, the detection output turns off, to mean the trailing edge of the third sheet S has been discharged to the storage tray 9. At that time, the third sheet S is sequentially discharged to the first jog position J1 indicated by the dotted line in the storage tray 9 shown in FIG. 15, on the first position side of the paired tray discharge rollers 4 and 5. Therefore, it is stacked having been offset the distance of D with regard to the lower side second sheet S2 group.

Then, at step ST83, in the same way as for the first sheet S1 and the second sheet S2, the sheet count that passes the discharge sensor 134 is tallied by the total output count of the discharge sensor 134.

Continuing, proceeding to step ST84, it determines whether or not the total of the set sorting sheet count n×job number N and the total output count of the discharge sensor 134 tallied at step ST83 are the same.

In this case, the job count N is N=3. Until the determined sorting sheet count n (sorting sheet count n=3) is discharged, the relationship is total output count<n×N, so the decision is on at step ST84 and it returns to step ST74.

Then, at step ST74, after verifying the job number N, the home position detection sensor 50 determines whether or not the sliding joint plate 41 is at the home position.

At step ST81, the slide motor 47 is driven to move the sliding joint plate 41 from the HP to the printing position separated a determined distance of D. With the home position detection sensor 50 OFF, the decision at step ST75 is ON and it shifts from step ST75 to step ST76. Also, at step ST76, the sliding joint plate 41 returns to the HP and it shifts to step ST77. Doing so recovers the paired tray discharge rollers 4 and 5 from the position that discharged the aforementioned second sheet S2, to the position to receive the subsequent second sheet S2.

Here, when processing the initial sheet of the third sheet S3 group, when the initial sheet is processed, the slide motor 47 has already returned the sliding joint plate 41 to the HP at step ST76, and because the home position detection sensor 50 is off, it does not shift to step ST76, and proceeds to step ST77.

Subsequently, at step ST84, until the "set sorting sheet count n (n 3)×job number N (N=3)=total output count from the discharge sensor 134, for each of the subsequent first sheet S1, the operations from step ST74 to ST84 are repeated and the first sheet S1 recorded with images, are sequentially discharged in order to the position (second jog position J2) indicated by the dotted line on the storage tray 9 in FIG. 15.

The discharge of sheets for the set sorting sheet count n (n=3) for the second sheet S2 group, specifically, the discharge of sheets of the total number of sheets (n×N=3×2) up to the determined job number N (N=2) that use the set sorting sheet count n (n=3) as the units and at step ST84, it determines if it has reached the "set sorting sheet count n×job count N=discharge sensor 134 total output count," and proceeds to step ST85.

However, in this embodiment, the total recording sheet count is set to Z=15 and it has not exceeded the sorting sheet count n=3 for the third bundle (job number N=9), so the decision at step ST85 is that the "set total recording sheet count does not equal the total output count of the discharge sensor 134". Here, it proceeds to step ST86, increases the aforementioned job number N by 1, and after the job number N is set to 3, it returns to the sorting step ST74.

Fourth Job (Even Numbered Job) to the Fifth Job (Odd Numbered Job)

The control for the fourth sheet S4 (fourth job) is the same as for the even numbered job for the second sheet S2 (the second job), described above, and the control for the fifth sheet S5 (fifth job) is the same as for the odd numbered job for the third sheet S3 (the third job), described above.

Specifically, at step ST85, until "set total recording sheet count Z (Z=15)=total output count by discharge sensor 134," it repeats the controls relating to the aforementioned second sheet S2 and the third sheet S3.

At step ST85, if the "set total recording sheet count (Z=15)=total output count," sorting by the sorting means is ended.

<Effects of the Actions of the Embodiment>

In conventional apparatuses, after sheets are completely discharged to the tray, either the alignment plate or the alignment bar pushes the sheets to move them to the alignment reference member to align the sheets, while in this embodiment of the sheet finishing apparatus 1, the sorting means positioned further upstream in the direction of sheet transport than the belt units 61 and 61 that are the alignment means, can align the sheet SS using preparatory (pre) alignment with high precision and high efficiency without having to add a dedicated alignment means.

Because the advancing and retracting of the slide joint plate 41 of the sorting means, the supporting shafts 11 and 12 and the paired tray discharge rollers 4 and 5 mounted on each supporting shaft and the sheet transport by the paired tray discharge rollers 4 and 5 are performed in parallel simultaneously, the alignment operation to the preparatory (pre) alignment position can be started while the sheet SS is being discharged by the paired tray discharge rollers 4 and 5 further increasing alignment efficiency.

Note that according to the present embodiment, if preparatory (pre) alignment is performed, it is necessary for this alignment to move the sheets to the positioning plate 22 (alignment reference position) by the belt units 61 and 61 after that, but before this alignment using the belt units 61 and 61, the sorting means sheet shift means (preparatory (pre) alignment movement means) 40 moves the sheets SS to a position near the alignment position regulated by the positioning plate 22, so the time for alignment is shortened, the process for sheet alignment is more efficient than conventional apparatuses that move the sheets from a discharge position separated far from the alignment reference to the side alignment reference member.

Furthermore, the configuration according to this embodiment, calls for the sheets SS to be preparatory (pre) aligned in advance by the sorting means, but by setting the slide movement distance of the slide joint plate 41 and the supporting shaft 11 and the supporting shaft 12 so that the sorting means directly aligns the sheets SS at the alignment reference position using the positioning plate 22, it is possible to provide a finisher apparatus that is even more compact.

Because the belt units 61 and 61 rotate to drive sheets to the positioning plate 22, which is the finishing position and the abutting plate 21 while sheets are being discharged by the paired tray discharge rollers 4 and 5 and are being aligned, an alignment action (preparatory (pre) alignment) is applied to the sheets by the sorting means and alignment action is also applied by the belt units 61 and 61 enabling alignment to the finishing position with even more reliability.

Note that in the embodiment of the present invention, the paired tray discharge rollers 4 and 5 are advanced and retracted in the shaft direction to shift sheets, but it is also perfectly acceptable to establish an independent means for shifting sheets upstream of the paired discharge rollers, and sheets shifted by the independent shift means can be discharged by the paired discharge rollers, or the diameter of each roller on the same shaft composing the paired discharge rollers can be varied to transport sheets at an angle.

Note that in this embodiment of the invention, to align sheets after pre-alignment, the belt units 61 and 61 are used, but it is also perfectly acceptable to use conventional aligning members such as alignment plates or aligning bars that abut a side of the sheet to move it to the positioning plate 22 (the alignment reference position) after a side of the sheet has overcome the level difference between the fixed stacking portion (the first tray) 8 and storage portion (the second tray) 9 by the shift of the paired tray discharge rollers 4 and 5.

Note that this invention is configured as a sheet finishing apparatus but it can also be configured as an image forming apparatus equipped with a sheet finishing apparatus.

As described above, according to the sheet discharge apparatus or the image forming apparatus of the present invention, because the finishing tray that finishes sheets is compact to support only a portion of the sheets, the overall finishing apparatus is compact and improves processing efficiency. Also, in making the finishing tray compact, to differentiate the storage tray that stores finished sheets from the finishing tray it is necessary to vertically arrange both trays, but by structuring the paired discharge rollers 4 and 5 disposed above the finishing tray and the storage tray to shift to move a side of the sheet to the finishing tray, so the finished sheet does not get caught on the level difference created by the vertical arrangement of both trays (regardless of the discharge reference and particularly for small sized sheets), without the movement to the alignment position on the finishing tray being hindered. Still further, when moving the sheet by the shifting of the paired tray discharge rollers 4 and 5, the finishing tray is configured so that the upstream portion of the sheet touches earlier than the downstream portion in the discharge direction of the paired tray discharge rollers 4 and 5 to securely prevent the sheet from begin caught on the level differences of both trays.

What is claimed is:

1. A sheet finishing apparatus, comprising:

discharge means for discharging a sheet, support means arranged below the discharge means, storage means arranged below the support means, alignment means disposed adjacent to the support means and having a reference member as a reference for aligning the sheet and aligning rotating members for moving the sheet to the reference member by rotating while contacting the sheet on the support means, shift means for shifting the discharge means to move the sheet to a position where the aligning rotating members can contact the sheet, finishing means for finishing the sheet aligned by the discharge means, the shift means and the aligning means in a state that the sheet straddles between the support means and the storage means, and transport means for transporting the sheet finished by the finishing means to the storage means.

2. A sheet finishing apparatus according to claim 1, wherein said support means is disposed between the storage means and the reference member in a direction that the shift means shifts.

3. A sheet finishing apparatus according to claim 2, wherein said support means is formed in a shape so that the support means contacts an upstream portion of the sheet in a direction that the discharge means discharges before the support means contacts a downstream portion of the sheet when the sheet is moved by the shift means.

4. A sheet finishing apparatus according to claim 3, further comprising guide means for guiding an leading edge of the sheet in a direction that the sheet moves to a position where the aligning rotating members can contact the sheet when the sheet is moved by the shift means.

5. A sheet finishing apparatus according to claim 3, wherein said transport means acts a step on the sheet according to a level difference between the support means and the storage means to transport the sheet to the storage means.

6. A sheet finishing apparatus according to claim 2, further comprising guide means for guiding an leading edge of the sheet in a direction that the sheet moves to a position where the aligning rotating members can contact the sheet when the sheet is moved by the shift means.

7. A sheet finishing apparatus according to claim 2, wherein said transport means acts on a step on the sheet according to a level difference between the support means and the storage means to transport the sheet to the storage means.

8. A sheet finishing apparatus according to claim 1, wherein said support means is formed in a shape so that the support means contacts an upstream portion of the sheet in a direction that the discharge means discharges before the support means contacts a downstream portion of the sheet when the sheet is moved by the shift means.

9. A sheet finishing apparatus according to claim 8, further comprising guide means for guiding an leading edge of the sheet in a direction that the sheet moves to a position where the aligning rotating members can contact the sheet when the sheet is moved by the shift means.

10. A sheet finishing apparatus according to claim 8, wherein said transport means acts on a step on the sheet according to a level difference between the support means and the storage means to transport the sheet to the storage means.

11. A sheet finishing apparatus according to claim 1, further comprising guide means for guiding an leading edge of the sheet in a direction that the sheet moves to a position where the aligning rotating members can contact the sheet when the sheet is moved by the shift means.

12. A sheet finishing apparatus according to claim 1, wherein said transport means acts on a step on the sheet according to a level difference between the support means and the storage means to transport the sheet to the storage means.

13. A sheet finishing apparatus according to claim 1, wherein said support means is formed in a shape so that the support means contacts an upstream portion of the sheet in a direction that the discharge means discharges before the support means contacts a downstream portion of the sheet when the sheet is moved by the shift means.

14. A sheet finishing apparatus, comprising:

discharge means for discharging a sheet, support means arranged below the discharge means, storage means arranged below the support means, shift means for shifting the discharge means to move a side of the sheet to the support means, a step portion disposed between the support means and the storage means in a direction that the shift means shifts the discharge means;

a reference member disposed adjacent to the support means as a reference for aligning the sheet, aligning means having aligning members for moving the sheet discharged by the discharge means to the aligning member to align the sheet;

finishing means for finishing the sheet aligned by the discharge means, the shift means and the aligning means in a state that the sheet straddles between the support means and the storage means; and transport means for transporting the sheet finished by the finishing means to the storage means.

15. An image forming apparatus for forming an image on a sheet, comprising:

discharge means for discharging a sheet, support means arranged below the discharge means, storage means arranged below the support means, alignment means disposed adjacent to the support means and having a reference member as a reference for aligning the sheet and aligning rotating members for moving the sheet to the reference member by rotating while contacting the sheet on the support means, shift means for shifting the discharge means to move the sheet to a position where the aligning rotating members can contact the sheet, finishing means for finishing the sheet aligned by the discharge means, the shift means and the aligning means in a state that the sheet straddles between the support means and the storage means, and transport means for transporting the sheet finished by the finishing means to the storage means.

16. A sheet finishing apparatus according to claim 15, wherein said support means is disposed between the storage means and the reference member in a direction that the shift means shifts.

17. A sheet finishing apparatus according to claim 15, further comprising guide means for guiding an leading edge of the sheet in a direction that the sheet moves to a position where the aligning rotating members can contact the sheet when the sheet is moved by the shift means.

18. A sheet finishing apparatus according to claim 15, wherein said transport means acts a step on the sheet according to a level difference between the support means and the storage means to transport the sheet to the storage means.

* * * * *